United States Patent [19]

Fujita et al.

[11] Patent Number: 4,914,007

[45] Date of Patent: Apr. 3, 1990

[54] IMAGE FORMING PROCESS COMPRISING CONTROLLING THE SWELLING DEGREE OF THE PHOTOGRAPHIC MATERIAL

[75] Inventors: Yoshihiro Fujita; Takatoshi Ishikawa, both of Kanagawa, Japan

[73] Assignee: Fuji Photo Film Co., Ltd., Kanagawa, Japan

[21] Appl. No.: 268,610

[22] Filed: Nov. 7, 1988

Related U.S. Application Data

[63] Continuation of Ser. No. 927,490, Nov. 6, 1986, abandoned.

[30] Foreign Application Priority Data

| | | | |
|---|---|---|---|
| Nov. 6, 1985 | [JP] | Japan | 60-247223 |
| Apr. 18, 1986 | [JP] | Japan | 61-89512 |
| Jul. 31, 1986 | [JP] | Japan | 61-178886 |

[51] Int. Cl.[4] ..... G03C 1/30; G03C 1/76; G03C 7/32

[52] U.S. Cl. ..... 430/372; 430/377; 430/386; 430/387; 430/421; 430/435; 430/436; 430/621; 430/538; 430/539; 430/558

[58] Field of Search ..... 430/387, 386, 372, 421, 430/337, 435, 436, 621, 539, 538, 558

[56] References Cited

U.S. PATENT DOCUMENTS

| | | | |
|---|---|---|---|
| 4,336,324 | 6/1982 | Koboshi et al. | 430/372 |
| 4,548,899 | 10/1985 | Nakayama et al. | 430/386 X |
| 4,576,910 | 3/1986 | Hirano et al. | 430/386 X |
| 4,621,046 | 11/1986 | Sato et al. | 430/381 |
| 4,639,413 | 1/1987 | Kawagishi et al. | 430/386 X |
| 4,647,528 | 3/1987 | Yamada et al. | 430/567 |
| 4,681,835 | 7/1987 | Ishikawa et al. | 430/372 |

*Primary Examiner*—Paula R. Michl
*Assistant Examiner*—Patrick Doody
*Attorney, Agent, or Firm*—Sughrue, Mion, Zinn, Macpeak & Seas

[57] ABSTRACT

An image forming process is disclosed, which comprises, in the photographic processing of silver halide color photographic materials, processing the color photographic material having a swelling degree of the photographic layer(s) of from 1.5 to 4.0 in the water washing step for the total water washing processing time of from 30 to 90 seconds. According to the process of the invention, the storage stability of color images obtained after processing and/or after lapsing a time does not reduce even when the water washing processing time is shortened.

13 Claims, No Drawings

IMAGE FORMING PROCESS COMPRISING CONTROLLING THE SWELLING DEGREE OF THE PHOTOGRAPHIC MATERIAL

This is a continuation of application Ser. No. 927,490, filed 11/6/86, now abandoned.

FIELD OF THE INVENTION

This invention relates to an image forming process and more particularly to an image forming process for a silver halide color photographic material which does not reduce the storage stability of color images even when water washing time is shortened.

BACKGROUND OF THE INVENTION

Hitherto, various studies have been made about shortening of processing time for silver halide color photographic materials. For example, it is known to increase the temperature or pH of a developer or use a development accelerator for shortening a development time. Also, as a method of shortening a desilvering step, methods of adding various accelerators, etc., are known.

For shortening the processing time for silver halide color photographic materials, it is effective to shorten a water washing step in addition to shortening of the aforesaid development step and desilvering step. A conventionally employed water washing time is generally from 2 to 3 minutes.

Now, in the case of shortening a water washing step, it is inevitable that washing of bleach components and fix components becomes insufficient. In this case, the storage stability of color images of processing color photographic materials is also reduced. Hitherto, it has been attempted to incorporate various fading preventing agents in color photographic materials for improving the storage stability of color images as described, for example, in U.S. Pat. Nos. 2,816,028, 3,457,079, 3,698,909, 30764,337, and 3,700,455, etc., but these fading preventing agents are ineffective when the water washing time in photographic processing for color photographic material is shorter than 90 seconds. In other words, if washing of iron complexes present in a bleach or a bleach fix is insufficient, there occurs a problem that the remaining iron complexes react with remaining couplers to increase yellow stains during storing color image in the dark.

Also, in the case of long continuous processing, yellow and/or magenta stains which are considered to be mainly caused by the oxidation product of a color developing agent attach to color photographic materials and when the water washing time is short as described in this invention, washing of the aforesaid attached stains becomes insufficient to leave these stains after processing as a new trouble.

On the other hand, in a water washing step for photographic processing, a process of greatly saving water has been recently proposed mainly for saving water resources and omitting of plumbing of washing. These techniques are disclosed in Japanese Patent Application (OPI) Nos. 70549/81, 132146/82, 8543/82, 18631/83, 184343/84, 184345/84, and 14834/83, etc. (the term "OPI" as used herein means an "unexamined published application").

However, it has now been found that when a water washing step of a shortened period of time as in this invention is practiced using the above-described water saving step, the washing effect in the water washing step becomes insufficient and the above-described stain problem occurred after processing and/or after a lapse of time becomes larger.

SUMMARY OF THE INVENTION

An object of this invention is, therefore, to provide a process for processing color photographic materials with a shortened washing time, without reducing the storage stability of color images formed and without being accompanied by the stain problem directly after processing in photographic processing, in particular, long continuous photographic processing.

Another object of this invention is to provide a process for processing color photographic materials without reducing the storage stability of color images formed and without being accompanied by the stain problem directly after processing even in the case of shortening the water washing time and employing a water saving processing.

It has now been discovered that the above-described objects can be attained by controlling the swelling degree of photographic layers of a silver halide color photographic material to the range of from 1.5 to 4.0 in photographic processing for the color photographic material in which the water washing time is shortened so that the whole water washing time in water washing steps is in the range of from 30 to 90 seconds.

Furthermore, it has been discovered that even in the case of performing the so-called water saving processing that the replenishing amount of washing water for above-described water washing step is from 0.5 to 50 times the amount of the liquid carried over by color photographic materials from the pre-bath, the above-described objects can be effectively attained by the aforesaid process of this invention and further that when the silver halide color photographic materials contain therein at least one kind of magenta couplers of formulae (I) and (II) described below, the aforesaid objects can be more effectively attained.

DETAILED DESCRIPTION OF THE INVENTION

Now, water washing processing or step in this invention includes not only an ordinary "water wash processing" but also a convenient processing process such as a so-called "stabilization process" only which is performed without employing a substantial water washing step. The term "water washing processing or step" in this invention is thus used in the broad meaning as described above.

The water washing time in this invention is from 30 to 90 seconds, preferably from 40 to 70 seconds. The term "water washing time" in this invention means the time from the instance when a light-sensitive material is brought into contact with washing water to the instance when the light-sensitive material reaches a drying zone which is the final step of the photographic processing. When the water washing step is a multistage conuntercurrent water washing step using two or more tanks, the water washing time means the whole water washing time from the instance when a light-sensitive material is brought into contact with washing water in the first tank to the instance when the light-sensitive material reaches the drying zone. In the case of performing so-called "stabilization" in place of the ordinary water washing, the above-described definition is applied. The water washing time of less than 30 seconds is undesirable since the occurrence of yellow stain increases directly after processing and after lapsing a time even when the swelling degree of photographic layer(s) is in the range defined in this invention.

Also, the invention is aimed to process color photographic materials with a shortened water washing time of at most 90 seconds.

For shortening the water washing step in photographic processing, the amount of washing water and the water washing temperature are further important for practical purpose. The amount of water washing in ordinary "water washing step" cannot be unequivocally defined because it varied depending upon the number of tanks in the multistage countercurrent water washing step and the amount of pre-bath components carried over by light-sensitive materials from the pre-bath but in this invention, the amount of washing water may be sufficient such that the content of the component(s) from the pre-bath in washing water in the final water washing tank is less than $1\times10^{-4}$ of that in the pre-bath. The "pre-bath" as referred to herein is generally a fix or a bleach fix but is not limited to such a fix or bleach fix only. In the case of, for example, a 3-tank countercurrent water washing step, the amount of washing water is preferably more than about 1,000 ml, more preferably more than 5,000 ml, per $m^2$ of light-sensitive material.

The water washing step is preferably a water washing step with water saving, for example, in a multistage countercurrent water washing step using 2 or more tanks (e.g., 2 to 9 tanks) for saving washing water. Furthermore, it is more preferred to employ a multistage countercurrent stabilization step (so-called stabilization) as described in Japanese Patent Application (OPI) No. 8543/82 in place of an ordinary water washing step. In this case, the content of pre-bath components in washing water in the final tank or bath is preferably less than $5\times10^{-2}$ of that in the pre-bath. The amount of the replenisher for washing water or a stabilizing liquid in the case of the aforesaid water saving step or stabilization step is preferably from 0.5 time to 50 times (by volume), more preferably from 3 times to 30 times, the amount carried over from the "pre-bath" per unit area of the light-sensitive material.

For the water washing step and stabilization step in this invention, various compounds can be used for various purposes. For example, it is known to use sterilizers or antimolds for preventing the generation of bacteria, molds, algae, etc. For example, the compounds described in *Journal of Antibacterial and Antifungal Agents*, Vol. 11, No. 5, 207–223 (1983), the compounds described in Hiroshi Horiguchi, *Bokin bobai no Kagaku* (*Antibacterial and Antifungal Chemistry*), Sankyo Shuppan K.K. (1982), and the compounds and methods described in Japanese Patent Application (OPI) Nos. 8543/82, 58143/82, 97530/82, 105145/83, 134636/83, 91440/84, 126533/84, 184344/84, 185336/84, 239750/85, 239751/85, 247241/85, 260952/85, 2149/86, 28947/86, 28945/86, and 35446/81; U.S. patent application Ser. No. 863,907, filed May 16, 1986; etc. can be employed in this invention.

In particular, isothiazolone derivatives (e.g., 2-octyl-4-isothiazolin-3-one, 5-chloro-2-methyl-4-isothiazolin-3-one, etc.), sulfanylamide derivatives (e.g., sulfanylamide, etc.), and benzotriazole derivatives (e.g., benzotriazole, 5-methylbenzotriazole, 5-chlorobenzothiazole, etc.) are useful.

Also, it is known to use various kinds of chelating agents for improving the image stability after processing and inorganic phosphoric acids, organic carboxylic acids, aminopolycarboxylic acids, organic sulfonic acids, etc., are useful for this purpose. Futhermore, the compounds and methods described in Japanese Patent Application (OPI) Nos. 8543/83, 197540/82, 14834/83, 134636/83, 126533/84, 184343/84, 184344/84, 184345/84, 185336/84, 135942/85, 238832/85, 239748/85, 239749/85, 239750/85, 239751/85, 242458/85, 262161/85, 4047/86, 4050/86, 4051/86, 4052/86, 4053/86, 4054/86, 28942/86, and 28945/86, etc. can be employed in this invention. Of these compounds, ethylenediaminetetraacetic acid, diethylenetriaminepentaacetic acid, nitrilotriacetic acid, 1-hydroxyethylidene-1,1'-diphosphonic acid, ethylenediamine-N,N,N',N'-tetramethylphosphonic acid, and nitrilo-N,N,N-trimethylenephosphonic acid are useful.

These chelating agents may be used solely or as a mixture thereof.

A metal compound can be used in combination with these chelating compounds. For example, there are bismuth compounds as described in Japanese Patent Application (OPI) No. 134636/83, the compounds of Ba, Ca, Ce, Co, In, La, Mn, Ni, Pb, Ti, Sn, Zn, or Zr as described in Japanese Patent Application (OPI) No. 184344/84, and the compounds of Mg, Al, or Sr as described in Japanese Patent Application (OPI) No. 185336/84. Among these compounds, the compounds of Bi, Ca, Bg or Al are particularly useful.

Furthermore, for effectively proceeding the water washing in this invention, surface active agents can be used as described in Japanese Patent Application (OPI) No. 197540/82. Also, for removing components giving bad influences from washing water or stabilization liquid, a method of contacting with ion-exchange resin (as described in Japanese Patent Application (OPI) No. 220345/85), an inverse osmosis treatment method (as described in Japanese Patent Application (OPI) No. 241053/85), a method of contacting with activated carbon, a viscous material, a polyamide series high molecular weight compound, a polyurethane series high molecular weight compound, a phenol resin, an epoxy resin, a high molecular weight compound having hydrazido groups, a high molecular weight compound containing polytetrafluoroethylene, or a copolymer of a polyhydric alcohol methacrylic acid monoester and a polyhydric alcohol methacrylic acid polyester (as described in Japanese Patent Application (OPI) No. 263151/85), an electrodialysis treatment method (as described in Japanese Patent Application (OIP) No. 28949/86), etc. can be applied.

Furthermore, a method of passing the washing water or stabilization liquid through a ultraviolet irradiation zone or a magnetic field can be applied for preventing the generation of bacteria or molds.

In the case of continuously performing the photographic processing,, the methods described in Japanese Patent Application (OPI) Nos. 233651/85, 235133/85, 263941/85, 4048/86, 1049/86, 4055/86, 4056/86, 4057/86, 4058/86, and 4060/86, etc. can be applied.

The washing water or stabilization liquid for use in this invention may further contain a fluorescent whitening agent, a hardening agent, etc. in addition to the above-described additives.

Also, the washing water or stabilization liquid in this invention may preferably contain as a pH controlling agent for layers various ammonium salts such as ammonium chloride, ammonium nitrate, ammmonium sulfate, ammonium phosphate, ammonium sulfite, ammonium thiosulfate, etc. for improving the storage stability of color images formed.

Various additives as described above may be used as a combination of two or more same kind or different kinds of compounds according to the purposes. The amount of the additive(s) is preferably as small as possible if the purpose is obtained from the standpoint of properties (stickiness, etc.) of emulsion layers of the light-sensitive material after processing.

For increasing the washing out effect of the components in emulsion layers in water washing or stabilization, it is preferred to perform stirring by calculation of water or liquid and a method of strongly striking the emulsion layer surface of the light-sensitive material by liquid stream (e.g., gas stirring, blowing of liquid, etc.) is particularly preferred.

Each processing tank may be, if necessary, equipped with a heater, a temperature sensor, a liquid level sensor, a circulation pump, a filter, a floating lid, a squeezer, a nitrogen gas agitator, an air agitator, etc.

On the other hand, the swelling degree of the photographic layer(s) of the light-sensitive material which is used in this invention is from 1.5 to 4.0, preferably from 2.0 to 3.5. The swelling degree in this invention is shown by the value of the thickness of the photographic layer(s) after immersing the color photographic material in distilled water of 33° C. for 2 minutes divided by the thickness of the dry photographic layers.

If the swelling degree is less than 1.5, the yellow stain directly after processing and after a lapse of time undesirably increases when the water washing time is shortened (to 30 to 90 seconds) as in this invention. Also, if the swelling degree is more than 4.0, the yellow stain density undesirably increases. Furthermore, if the swelling degree is more than 4.0, the mechanical strength of the photographic layers in the photographic processing decreases to cause such troubles as the occurrence of scratches, etc., and also the amount of water absorbed in the layers increases to generate a drying load.

The photographic layers in this invention mean laminated hydrophilic colloid layers including at least one light-sensitive silver halide emulsion layer and at least one layer which is mutually in water permeable relation with this emulsion layer. The photographic layers do not include a back layer formed on the support at the opposite side to the photographic silver halide emulsion layer side. The photographic layers are usually formed from plural layers which contribute to the formation of photographic color images and may include intelayers, a filter layer, an antihalation layer, a protective layer(s), etc. in addition to the silver halide emulsion layer(s).

The swelling degree of the photographic layers may be controlled in the range defined in this invention by any desired method. For example, the swelling degree can be controlled by suitably selecting the amount and the kind of gelatin used for the photographic layers, the amount and the kind of a hardening agent, and/or the drying condition or storage condition after coating the photographic layers.

For photographic layers, gelatin is advantageously used as a binder but other hydrophilic colloid(s) can be used. For example, there are gelatin derivatives; graft polymers of gelatin and other polymers; proteins such as albumin, casein, etc.; cellulose derivatives such as hydroxyethyl cellulose, carboxymethyl cellulose, cellulose sulfuric acid esters, etc.; saccharide derivatives such as sodium alginate, starch derivatives, etc.; and synthetic hydrophilic homopolymers or copolymers such as polyvinyl alcohol, polyvinyl alcohol partial acetal, poly-N-vinylpyrrolidone, polyacrylic acid, polymethacrylic acid, polyacrylamide, polyvinylimidazole, polyvinylpyrazole, etc.

As gelatin, lime-treated gelatin as well as acid-treated gelatin, hydrolyzed products of gelatin, or enzyme decomposition product of gelatin can be used.

As the gelatin derivatives which are used as a binder for the photographic layers, there are products obtained by reacting gelatin and various compounds such as acid halides, acid anhydrides, isocyanates, bromoacetic acid, alkanesultones, vinylsulfonamides, maleinimide compounds, polyalkylene oxides, epoxy compounds, etc. Specific examples of the gelatin derivatives are described, for example, in U.S. Pat. Nos. 2,614,928, 3,132,945, 3,186,846, and 3,312,553; British Patents 861,414, 1,033,189, and 1,005,784; Japanese Patent Publication No. 26845/67; etc.

Also, as the gelatin graft polymers which can be used as a binder for the photographic layers, there are products obtained by grafting homopolymers or copolymers of vinyl monomer(s) such as acrylic acid or methacrylic acid or derivatives thereof (e.g., esters, amides, etc.), acrylonitrile, styrene, etc., to gelatin. In particular, a graft polymer of gelatin and a polymer having a compatibility with gelatin to some extent, such as acrylic acid, methacrylic acid, acrylamide, methacrylamide, hydroxyalkyl methacrylates, etc., is preferred. Examples of these graft polymers are described in U.S. Pat. Nos. 2,763,625, 2,831,767, and 2,956,884, etc.

Also, specific examples of the synthetic hydrophilic homopolymers or copolymers which can also be used as a binder for the photographic layers are described, for example, in West German Patent Application (OLS) No. 2,312,708, U.S. Pat. Nos. 3,620,751 and 3,879,205, Japanese Patent Publication No. 7561/68, etc.

As a hardening agent which can be used for the photographic layers, there are, for example, chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloylhexahydro-s-triazine, bis(vinylsulfonyl)methyl ether, N,N'-methylenebis-[β-(vinylsulfonyl)propionamide], etc.), active halogen compounds (e.g., 2,4-dichloro-6-hydroxy-s-triazine, etc.), mucohalogenic acids (e.g., mucochloric acid, mucophenoxychloric acid, etc.), isooxazoles, dialdehyde starch, 2-chloro-6-hydroxytriazinylated gelatin, etc. They can be used solely or as a combination thereof. Specific examples of the hardening agents are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, and 3,543,292; British Patents 676,628, 825,544, and 1,270,578; German Patents 872,153 and 1,090,427; Japanese Patent Publication Nos. 7133/59 and 1872/71; etc.

Particularly preferred hardening agents are aldehydes, active vinyl compounds, and active halogen compounds.

The photographic emulsion layer of a color photographic material which is processed in this invention contains a dye-forming coupler, i.e., a compound capable of forming a color by oxidative coupling with an aromatic primary amine developing agent (e.g., phenylenediamine derivatives, aminophenol derivatives, etc.)

in color forming development. Examples of the dye-forming couplers are pyrazoloazole couplers, 5-pyrazolone couplers, pyrazolobenzimidazole couplers, cyanoacetylcoumarone couplers, open chain acylacetonitrile couplers, etc. for magenta couplers; acylacetamide couplers (e.g., benzoylacetanilides, pivaloylacetanilides, etc.), etc. for yellow couplers; and naphthol couplers, phenol couplers, etc. for cyan couplers. It is preferred that these couplers are non-diffusible couplers having a hydrophobic group called as a ballast group in the molecule, or polymerized couplers. The couplers may be of four equivalent or two equivalent for silver ion.

In the process of this invention, it is particularly preferred for restraining the occurrence of stain and light fading with the passage of time that the color photographic material to be processed by the process of this invention contains a two-equivalent magenta coupler represented by following formula (I) or (II):

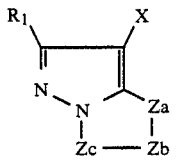

(I)

wherein $R_1$ represents a hydrogen atom or a substituent; X represents a hydrogen atom or a group capable of splitting off by coupling reaction with the oxidation product of an aromatic primary amine developing agent; and Za, Zb, and Zc each represents a methine, a substituted methine, =N—, or —NH—; and one of the Za-Zb bond and the Zb-Zc bond is a double bond and the other is a single bond. When Zb-Zc is a carbon-carbon double bond, it may be a part of an aromatic ring. Also, the coupler shown by formula (I) includes the case that the couplers form a dimer or more oligomer or polymer at $R_1$ or X. Furthermore, when said Za, Zb; or Zc is a substituted methine, the coupler includes the case that the couplers form a dimer or more oligomer or polymer by the substituted methine,

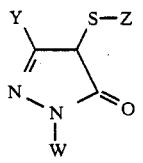

(II)

wherein W represents a substituted aryl group; Z represents a substituted or unsubstituted alkyl group, a substituted or unsubstituted aryl group, or a substituted or unsubstituted heterocyclic group; and Y represents a substituted or unsubstituted acylamino group, a substituted or unsubstituted ureido group, or a substituted or unsubstituted anilino group.

The magenta couplers shown by formula (I) described above are explained in detail.

An oligomer or polymer in formula (I) means a coupler having two or more moieties shown by formula (I) in one molecule and a bis-compound and a polymer coupler are included therein. In this case, the polymer coupler may be a homopolymer composed of only a monomer (preferably a monomer having a vinyl group; hereinafter referred to as "vinyl monomer") having a moiety shown by formula (I) or may be a copolymer of the aforesaid monomer and a non-color forming ethylenic monomer which does not cause coupling with the oxidation product of an aromatic primary amine developing agent.

The compound represented by formula (I) is a 5 membered ring-5 membered ring condensed nitrogen heterocyclic type coupler and the coloring matrix nucleus shows aromaticity isoelectric to naphthalene and has a chemical structure usually called as azapentalene. Preferred couplers shown by formula (I) are 1-H-imidazo[1,2-b]pyrazoles, 1H-pyrazolo[1,5-b]pyrazoles, 1H-pyrazolo[5,1-c][1,2,4]triazoles, 1H-pyrazolo[1,5-b][1,2,4]triazoles, 1H-pyrazolo[1,5-d]tetrazoles, and 1H-pyrazolo[1,5-a]benzimidazoles and they are represented by following formulae (III), (IV), (V), (VI), (VII), and (VIII), respectively. In these couplers, the couplers shown by formulae (V) and (VI) are particularly preferred.

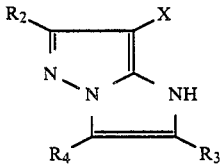

(III)

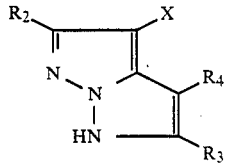

(IV)

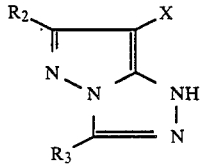

(V)

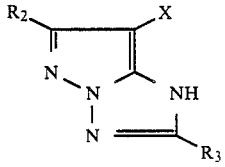

(VI)

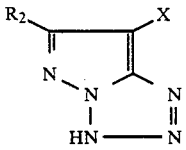

(VII)

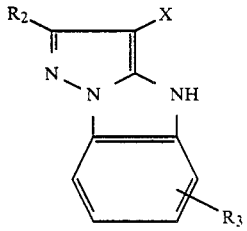

(VIII)

In formulae (III) to (VIII) described above, substituents $R_2$, $R_3$, and $R_4$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom or a group capable of splitting off by coupling reaction with the oxidation product of an aromatic primary amine developing agent (e.g., a halogen atom, a carboxyl group or a coupling split-off group bonded to a carbon atom of the coupling position through an oxygen atom, a nitrogen atom or a sulfur atom).

The couplers shown by formulae (III) to (VIII) include the case that said $R_2$, $R_3$, $R_4$, or X is a divalent group and the coupler forms a bis-compound by the divalent group. Also, when the moiety shown by formulae (III) to (VIII) is in the vinyl monomer, $R_2$, $R_3$, or $R_4$ represents a simple bond or a connecting group through which the moiety shown by formulae (III) to (VIII) is bonded to a vinyl group.

More specifically, $R_2$, $R_3$, and $R_4$ in formulae (III) to (VIII) described above each represents a hydrogen atom, a halogen atom (e.g., a chlorine atom, a bromine atom, etc.), an alkyl group (e.g., a methyl group, a propyl group, a t-butyl group, a trifluoromethyl group, a tridecyl group, a 3-(2,4-di-t-amylphenoxy)propyl group, a 2-dodecyloxyethyl group, a 3-phenoxypropyl group, a 2-hexylsulfonylethyl group, a cyclopentyl group, a benzyl group, etc.), an aryl group (e.g., a phenyl group, a 4-t-butylphenyl group, a 2,4-di-t-amylphenyl group, a 4-tetradecanamidophenyl group, etc.), a heterocyclic group (e.g., a 2-furyl group, a 2-thienyl group, a 2-pyrimidinyl group, a 2-benzothiazolyl group, etc.), a cyano group, an alkoxy group (e.g., a methoxy group, an ethoxy group, a 2-methoxyethoxy group, a 2-dodecyloxyethoxy group, a methanesulfonylethoxy group, etc.), an aryloxy group (e.g., a phenoxy group, a 2-methylphenoxy group, a 4-t-butylphenoxy group, etc.), a heterocyclic oxy group (e.g., a 2-benzimidazolyloxy group, etc.), an acyloxy group (e.g., an acetoxy group, a hexadecanoyloxy group, etc.), a carbamoyloxy group (e.g., an N-phenylcarbamoyloxy group, an N-ethylcarbamoyloxy group, etc.), a silyloxy group (e.g., a trimethylsilyloxy group, etc.), a sulfonyloxy group (e.g., a dodecylsulfonyloxy group, etc.), an acylamino group (e.g., an acetamido group, a benzamido group, a tetradecanamido group, an α-(2,4-di-t-aminophenoxy)butylamido group, a γ-(3-t-butyl-4-hydroxyphenoxy)butylamido group, an α-{4-(4-hydroxyphenylsulfonyl)phenoxy}decanamido group, etc.), an anilino group (e.g., a phenylamino group, a 2-chloroanilino group, a 2-chloro-5-tetradecanamidoanilino group, a 2-chloro-5-dodecyloxycarbonylanilino group, an N-acetylanilino group, a 2-chloro-5-{α-(3-t-butyl-4-hydroxyphenoxy)-dodecanamido}anilino group, etc.), a ureido group (e.g., a phenylureido group, a methylureido group, an N,N-dibutylureido group, etc.), an imido group (e.g., an N-succinimido group, a 3-benzylhydantoinyl group, a 4-(2-ethylhexanoylamino)phthalimido group, etc.), a sulfamoylamino group (e.g., an N,N-dipropylsulfamoylamino group, an N-methyl-N-decylsulfamoylamino group, etc.), a carbamoylamino group (e.g., a carbamoylamino group, an N,N-dimethylcarbamoylamino group, an N,N-diethylcarbamoylamino group, etc.), an alkylthio group (e.g., a methylthio group, an octylthio group, a tetradecylthio group, a 2-phenoxyethylthio group, a 3-phenoxypropylthio group, a 3-(4-t-butylphenoxy)propylthio group, etc.), an arylthio group (e.g., a phenylthio group, a 2-butoxy-5-t-octylphenylthio group, a 3-pentadecylphenylthio group, a 2-carboxyphenylthio group, a 4-tetradecanamidophenylthio group, etc.), a heterocyclic thio group (e.g., a 2-benzothiazolylthio group, etc.), an alkoxycarbonylamino group (e.g., a methoxycarbonylamino group, a tetradecyloxycarbonylamino group, etc.), an aryloxycarbonylamino group (e.g., a phenoxycarbonylamino group, a 2,4-tert-butylphenoxycarbonylamino group, etc.), a sulfonamido group (e.g., a methanesulfonamido group, a hexadecanesulfonamido group, a benzenesulfonamido group, a p-toluenesulfonamido group, an octadecanesulfonamido group, a 2-methyloxy-5-t-butylbenzenesulfonamido group, etc.), a carbamoyl group (e.g., an N-ethylcarbamoyl group, an N,N-dibutylcarbamoyl group, an N-(2-dodecyloxyethyl)carbamoyl group, an N-methyl-N-dodecylcarbamoyl group, an N-3-(2,4-di-tert-amylphenoxy)propyl carbamoyl group, etc.), an acyl group (e.g., an acetyl group, a (2,4-di-tert-amylphenoxy)acetyl group, an benzoyl group, etc.), a sulfamoyl group (e.g., an N-ethylsulfamoyl group, an N,N-dipropylsulfamoyl group, an N-(2-dodecyloxyethyl)sulfamoyl group, an N-ethyl-N-dodecylsulfamoyl group, an N,N-diethylsulfamoyl group, etc.), a sulfonyl group (e.g., a methanesulfonyl group, an octanesulfonyl group, a benzenesulfonyl group, a toluenesulfonyl group, etc.), a sulfinyl group (e.g., an octanesulfinyl group, a dodecylsulfinyl group, a phenylsulfinyl group, etc.), an alkoxycarbonyl group (e.g., a methoxycarbonyl group, a butyloxycarbonyl group, a dodecyloxycarbonyl group, an octadecyloxycarbonyl group, etc.), or an aryloxycarbonyl group (e.g., a phenyloxycarbonyl group, a 3-pentadecylphenoxycarbonyl group, etc.).

Also, X in formulae (III) to (VIII) represents a hydrogen atom, a halogen atom (e.g., a chlorine atom, a bromine atom, an iodine atom, etc.), a carboxyl group, a group bonded with an oxygen atom (e.g., an acetoxy group, a propanoyloxy group, a benzoyloxy group, a 2,4-dichlorobenzoyloxy group, an ethoxyoxazolyloxy group, a pyruvinyloxy group, a cinnamoyloxy group, a phenoxy group, a 4-cyanophenoxy group, a 4-methanesulfonamidophenoxy group, a 4-methanesulfonylphenoxy group, an α-naphthoxy group, a 3-pentadecylphenoxy group, a benzyloxycarbonyloxy group, an ethoxy group, a 2-cyanoethoxy group, a benzyloxy group, a 2-phenethyloxy group, a 2-phenoxyethoxy group, a 5-phenyltetrazolyloxy group, a 2-benzothiazolyloxy group, etc.), a group bonded with a nitrogen atom (e.g., a benzenesulfonamido group, an N-ethyltoluenesulfonamido group, a heptafluorobutanamido group, a 2,3,4,5,6-pentafluorobenzamido group, an octanesulfonamido group, a p-cyanophenylureido group, an N,N-diethylsulfamoylamino group, a 1-piperidyl group, a 5,5-dimethyl-2,4-dioxo-3-oxazolidinyl group, a 1-benzylethoxy-3-hydantoinyl group, a 2N-1,1-dioxo-3(2H)-oxo-1,2-benzoisothiazolyl group, a 2-oxo-1,2-dihydro-1-pyridinyl group, an imidazolyl group, a pyrazolyl group, a 3,5-diethyl-1,2,4-triazole-1-yl group, a 5- or 6-bromobenzotriazole-1-yl group, a 5-methyl-1,2,3,4-triazole-1-yl group, a benzimidazolyl group, a 3-benzyl-1-hydantoinyl group, a 1-benzyl-5-hexadecyloxy-3-hydantoinyl group, a 5-methyl-1-tetrazolyl group, a 4-methoxyphenylazo group, a 4-pivaloylaminophenylazo group, a 2-hydroxy-4-propanoylphenylazo group, etc.), or a group bonded with a sulfur atom (e.g., a phenylthio group, a 2-carboxyphenylthio group, a 2-methoxy-5-t-octylphenylthio group, a 4-methanesulfonylphenylthio group, a 4-octanesulfonamidophenylthio group, a 2-butoxyphenylthio group, a 2-(2-hexanesulfonylethyl)-5-tert-octylphenylthio group, a benzylthio group, a 2-cyanoethylthio group, a 1-ethoxycarbonyltridecylthio group, a 5-phenyl-2,3,4,5-tetrazolylthio group, a 2-benzothiazolylthio group, a 2-dodecylthio-5-thiophenylthio group, a 2-phenyl-3-dodecyl-1,2,4-triazolyl-5-thio group, etc.).

When $R_2$, $R_3$, $R_4$, or X is a divalent group and the coupler forms a bis-compound, the divalent group is a substituted or unsubstituted alkylene group (e.g., a methylene group, an ethylene group, a 1,10-decylene group, —$CH_2CH_2$—O—$CH_2CH_2$—, etc.), a substituted or unsubstituted phenylene group (e.g., a 1,4-phenylene group, a 1,3-phenylene group,

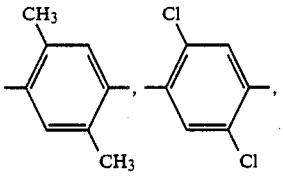

etc.), or an —NHCO—R'— group (wherein R' represents a substituted or unsubstituted alkylene group or a substituted or unsubstituted phenylene group).

The connecting group shown by $R_2$, $R_3$, or $R_4$, when the moiety shown by formulae (III) to (VIII) described above is in the vinyl monomer, includes a group composed of a combination of groups selected from a substituted or unsubstituted alkylene group (e.g., a methylene group, an ethylene group, a 1,10-decylene group, —$CH_2CH_2OCH_2CH_2$—, etc.), a substituted or unsubstituted phenylene group (e.g., a 1,4-phenylene group, a 1,3-phenylene group,

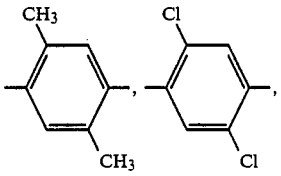

etc.), —NHCO—, —CONH—, —O—, —OCO—, and an aralkylene group (e.g.,

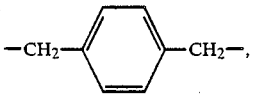

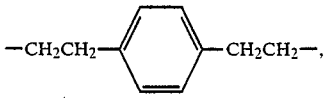

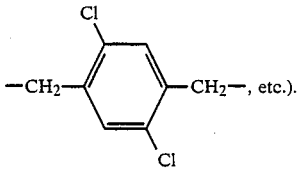

In addition, the vinyl group in the vinyl monomer may further have other substituent than the moiety shown by formulae (III) to (VIII). Examples of the preferred substituent are a hydrogen atom, a chlorine atom, or a lower alkyl group having from 1 to 4 carbon atoms.

Examples of the non-color forming ethylenic monomer which does not cause coupling with the oxidation product of an aromatic primary amine developing agent are acrylic acid, α-chloroacrylic acid, α-alacrylic acids (e.g., methacrylic acid, etc.), esters or amides induced from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate, and β-hydroxy methacrylate), methylenebisacrylamide, vinyl esters (e.g., vinyl acetate, vinyl propionate, and vinyl laurate), acrylonitrile, methacrylonitrile, aromatic vinyl compounds (e.g., styrene and derivatives thereof, vinyltoluene, divinylbenzene, vinylacetophenone, and sulfostyrene), itaconic acid, citraconic acid, crotonic acid, vinylidene chloride, vinylalkyl ethers (e.g., vinylethyl ether), maleic acid, maleic anhydride, maleic acid esters, N-vinyl-2-pyrrolidone, N-vinylpyridine, 2-vinylpyridine, 4-vinylpyridine, etc. The above-described non-color forming ethylenic monomers may be used solely or as a mixture thereof.

Specific examples and synthesis processes of the couplers represented by formulae (III) to (VIII) are described in the following literatures.

That is, the couplers shown by formula (III) are described in Japanese Patent Application (OPI) No. 162548/84, etc.; the couplers shown by formula (IV) are in Japanese Patent Application (OPI) No. 43659/85, etc.; the couplers shown by formula (V) are in Japanese Patent Publication No. 27411/72, etc.; the couplers shown by formula (VI) are in Japanese Patent Application (OPI) Nos. 171956/84 and 172982/85, etc.; the couplers shown by formula (VII) are in Japanese Patent Application (OPI) No. 33552/85, etc.; and the couplers shown by formula (VIII) are in U.S. Pat. No. 3,061,432, etc.

Also, the highly color-forming ballast groups described in Japanese Patent Application (OPI) Nos. 42045/83, 214854/84, 177553/84, 177544/84, and 177557/84 can be applied to the compounds shown by formulae (III) to (VIII) described above.

Specific examples of the pyrazoloazole series magenta couplers for use in this invention are illustrated below but the magenta couplers are not limited thereto.

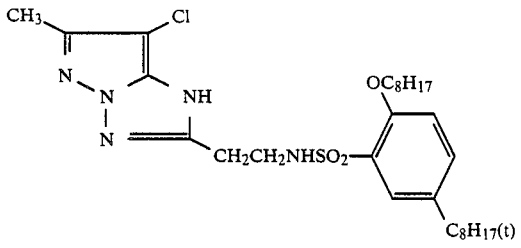

M-1

-continued
M-2
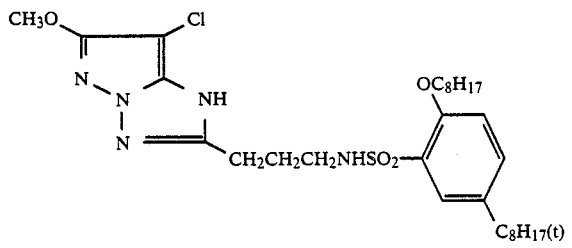
M-3
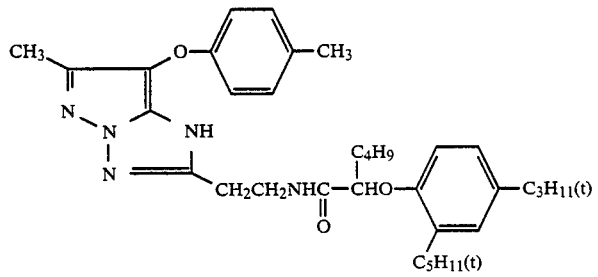
M-4
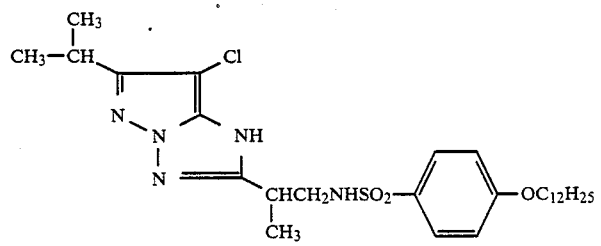
M-5
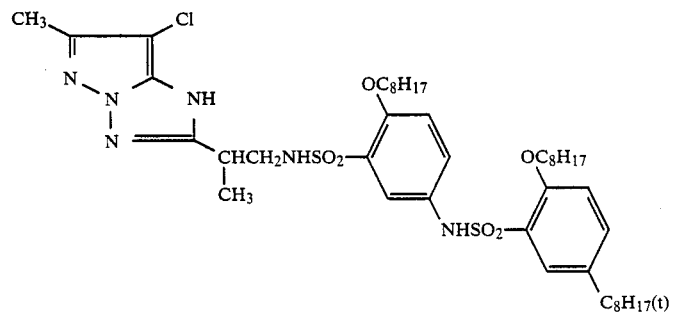
M-6
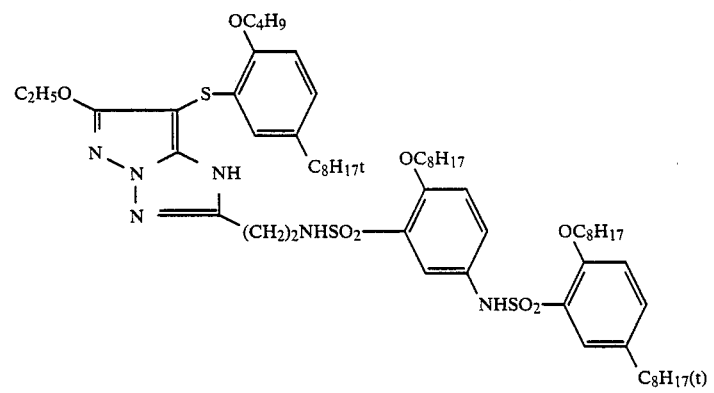

-continued
M-7
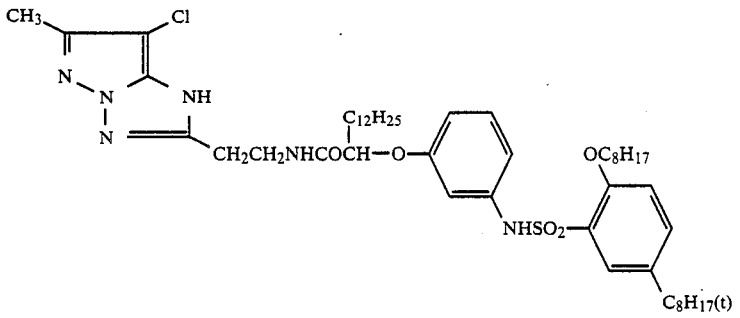
M-8
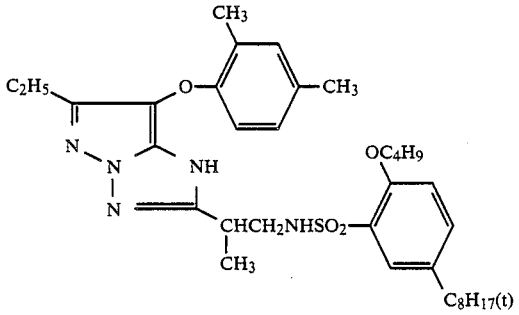
M-9
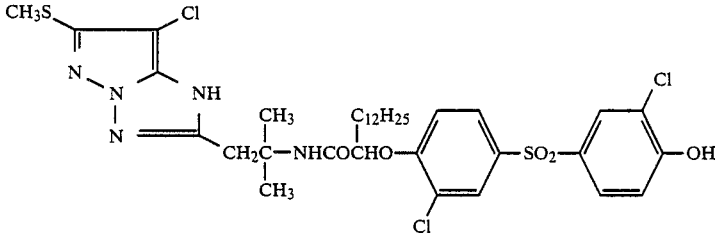
M-10
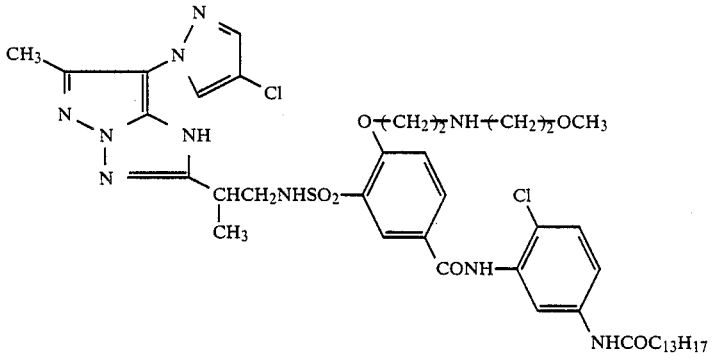
M-11
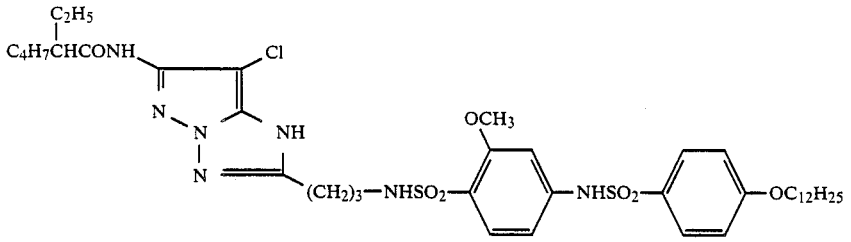

-continued
M-12
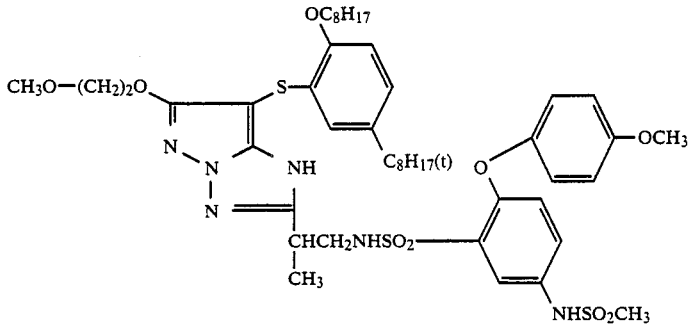
M-13
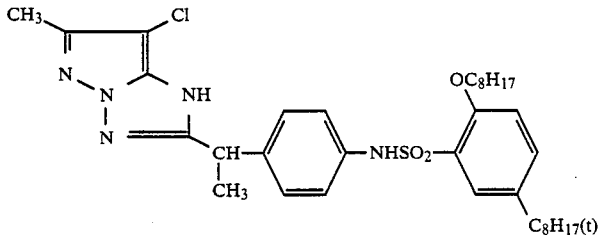
M-14
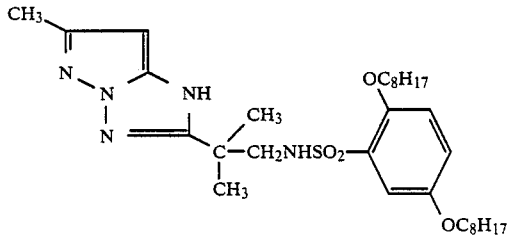
M-15
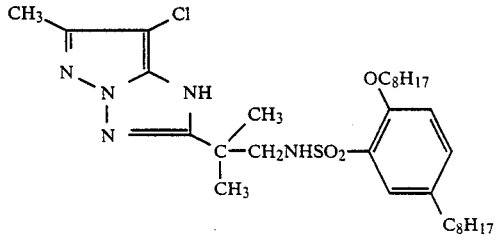
M-16
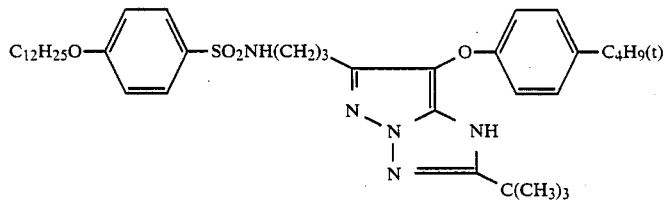
M-17
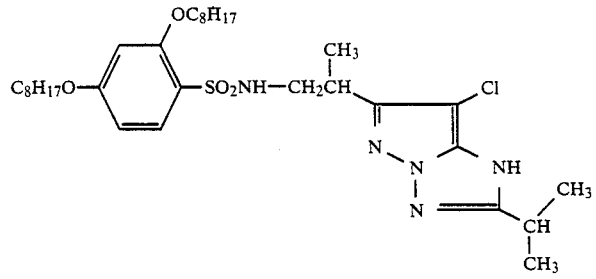

-continued
M-18
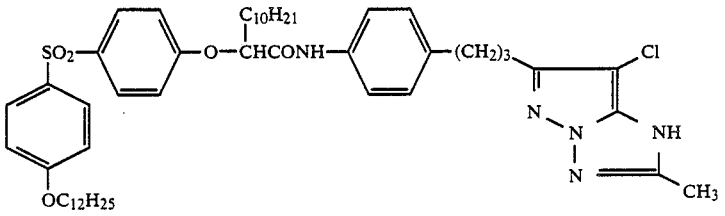
M-19
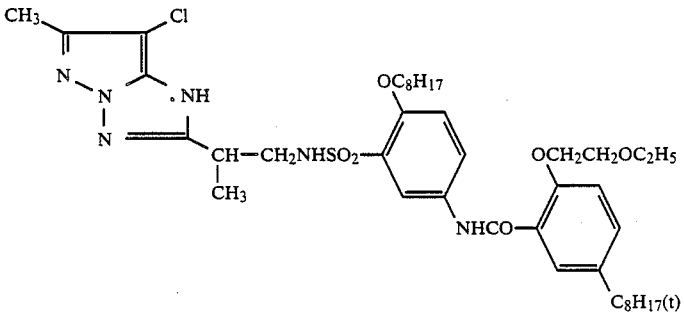
M-20
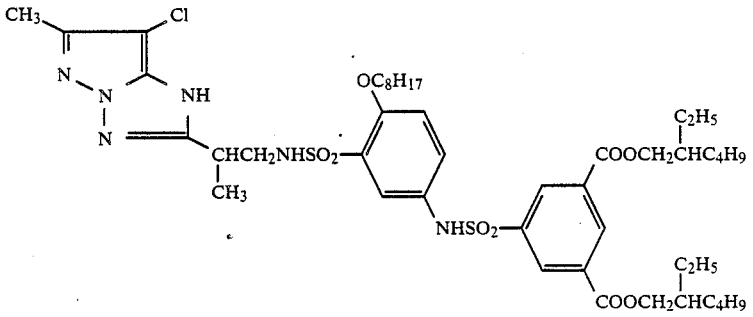
M-21
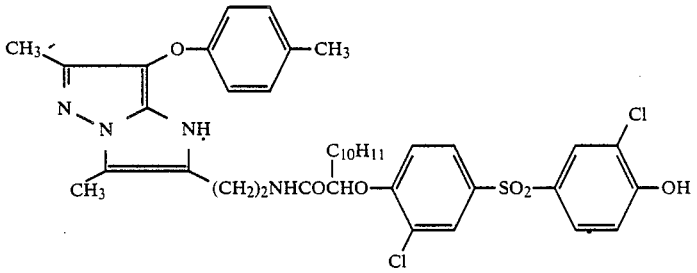
M-22
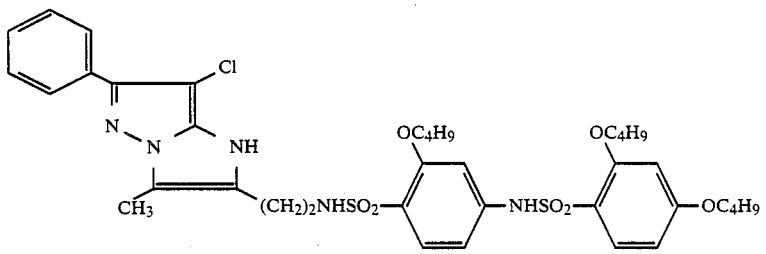
M-23
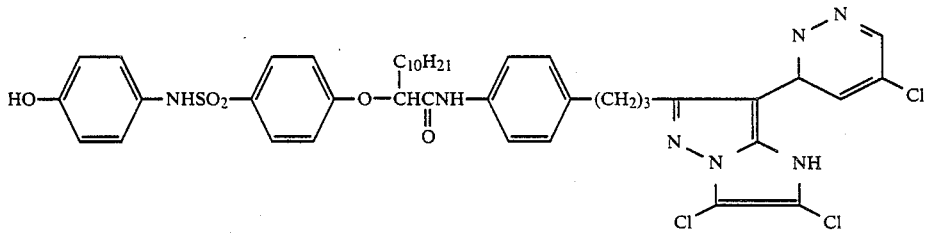

-continued
M-24
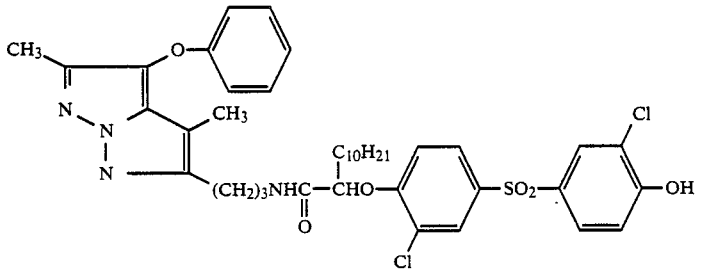
M-25
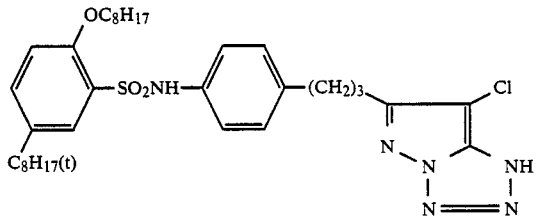
M-26
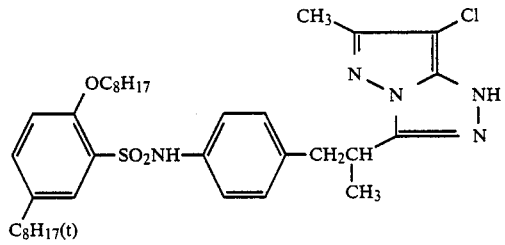
M-27
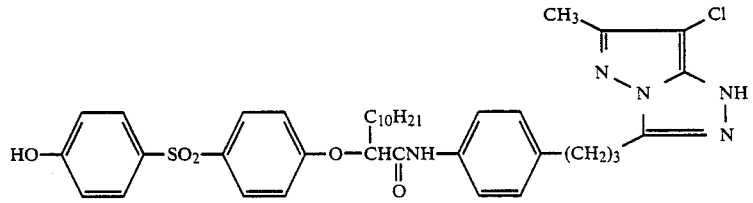
M-28
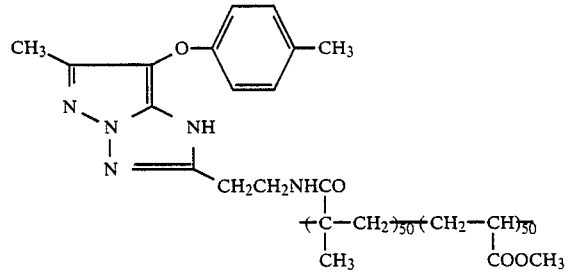
M-29
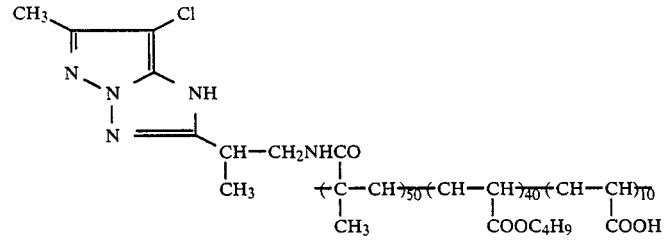

-continued
M-30
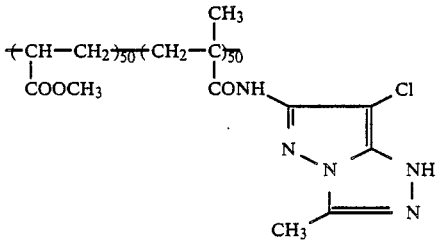
M-31
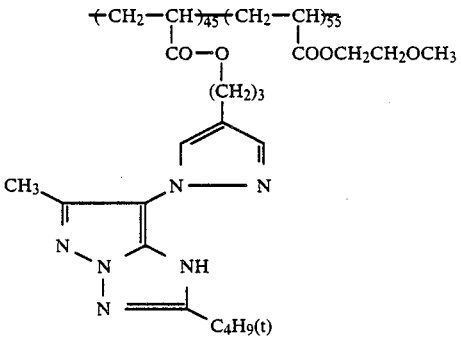
M-32
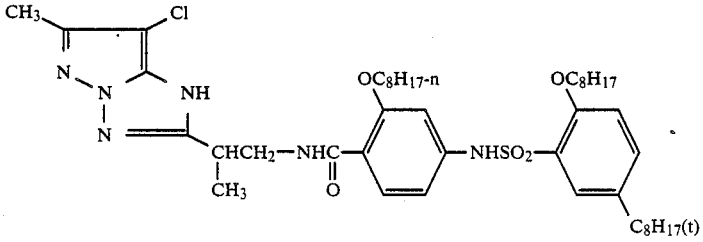
M-33
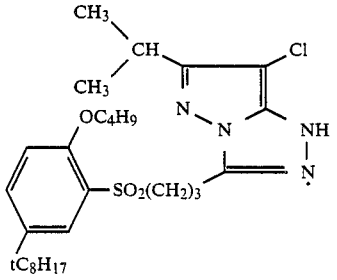
M-34
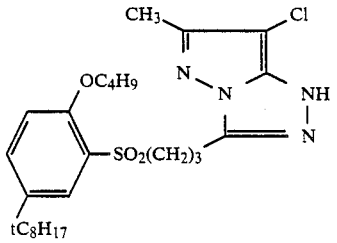
M-35
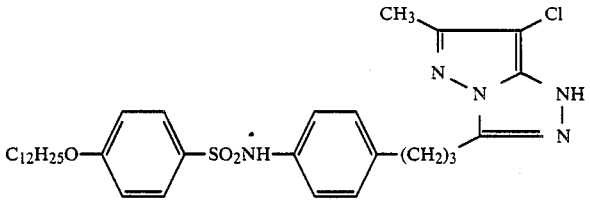

-continued
M-36
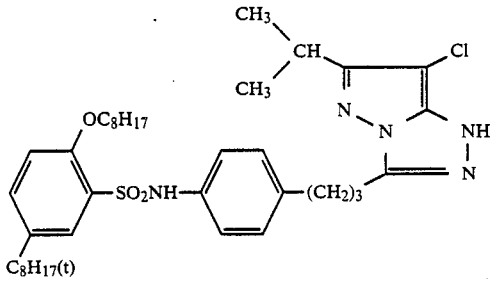
M-37
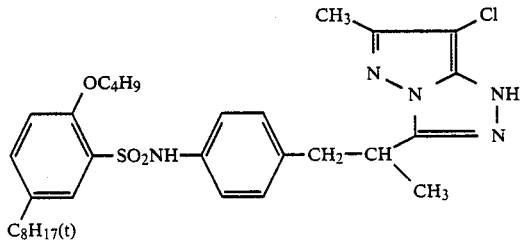
M-38
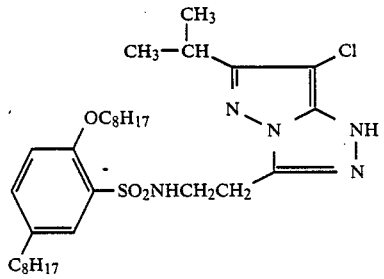
M-39
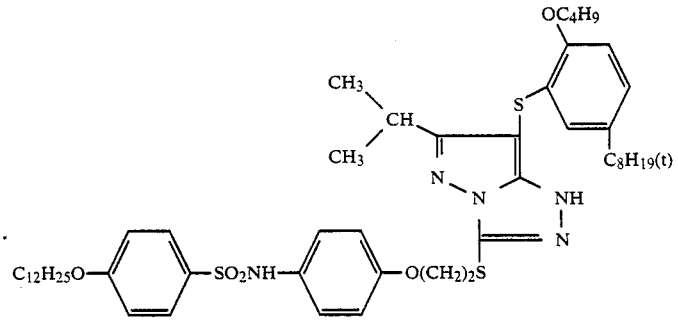
M-40
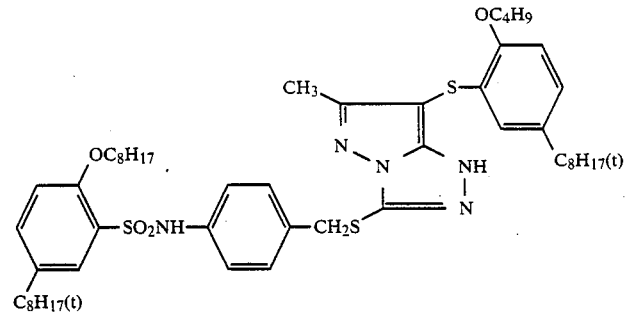

-continued
M-41
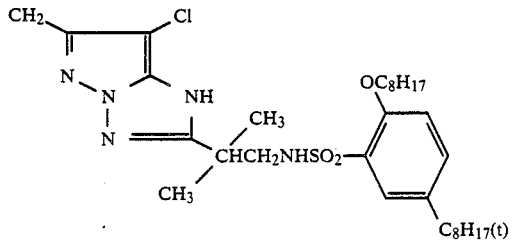
M-42
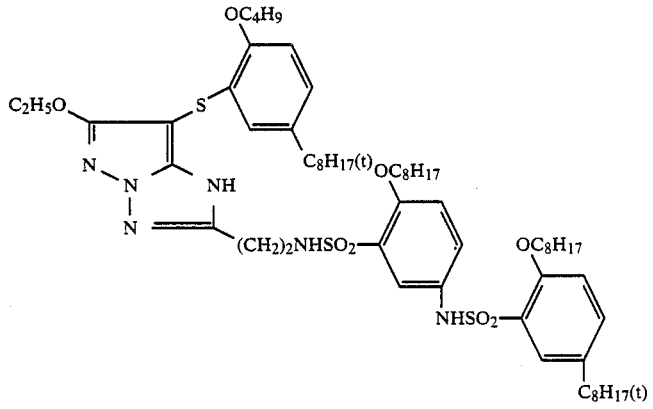
M-43
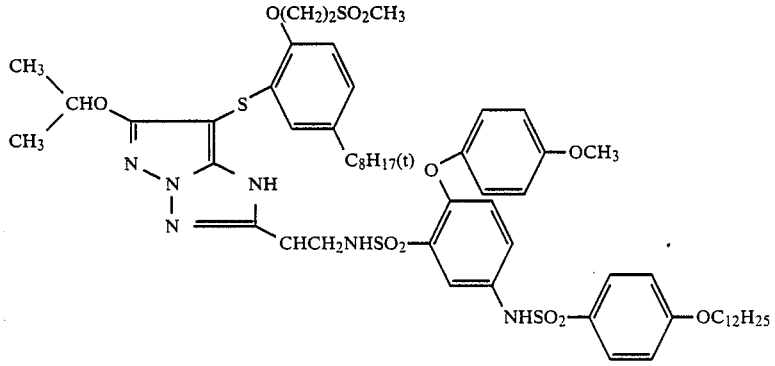
M-44
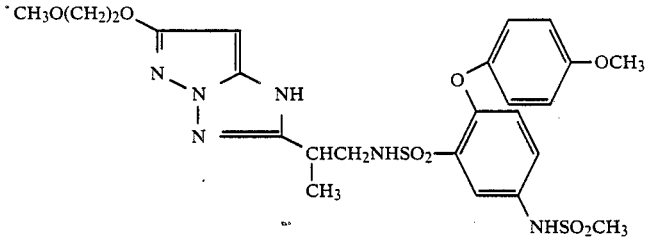
M-45
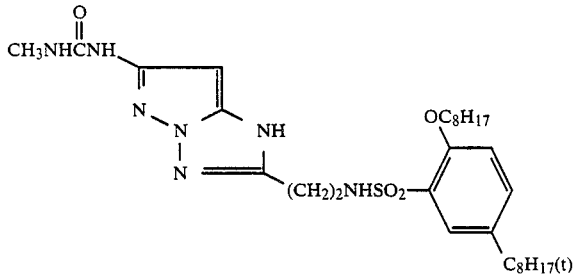

-continued

M-46

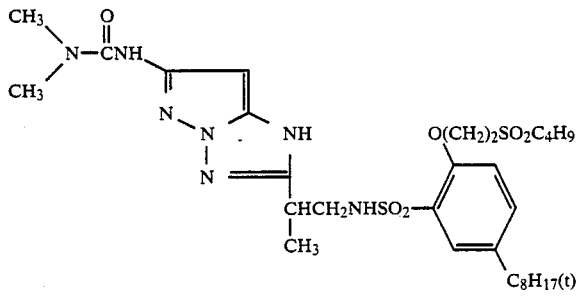

M-47

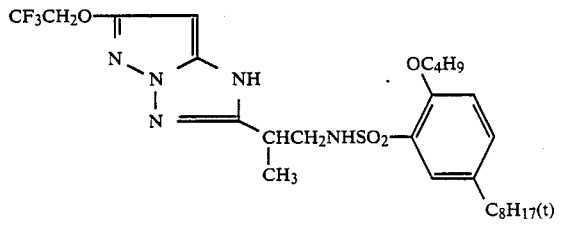

The two-equivalent magenta couplers shown by formula (II) described above are explained in detail.

In formula (II), W represents a phenyl group or a naphthyl group, substituted by at least one halogen atom, alkyl group, alkoxy group, alkoxycarbonyl group, or cyano group.

The alkyl group shown by Z in formula (II) includes a straight or branched chain alkyl group, an alkenyl group, a cycloalkyl group, an aralkyl group and an alkynyl group, each having from 1 to 42 carbon atoms and each of these groups may be substituted by a halogen atom, a hydroxyl group, a mercapto group, a cyano group, a nitro group, a carboxyl group, an aryl group, an alkoxy group, an aryloxy group, a heterocyclic oxy group, an acyloxy group, an alkoxycarbonyloxy group, an aryloxycarbonyloxy group, a silyloxy group, a carbamoyloxy group, a phosphoric acid oxy group, an acylamino group, a sulfonamido group, an alkoxycarbonylamino group, an aryloxycarbonylamino group, a diacylamino group, a carbamoylamino group, a sulfamoylamino group, an aromatic heterocyclic group (e.g., a pyrazolyl group, an imidazolyl group, a triazolyl group, etc.), a nonaromatic heterocyclic group (e.g., a piperidino group, a morpholino group, etc.), an imido group, a mono-oxo nitrogen heterocyclic group (e.g., a pyridone group, a saccharin group, etc.), an acyl group, an alkoxycarbonyl group, an aryloxycarbonyl group, a carbamoyl group, a sulfamoyl group, a silyl group, an alkylthio group, an arylthio group, a heterocyclic thio group, a sulfonyl group, an alkenyl group, an anilino group, etc.

The aryl group shown by Z in formula (II) is a phenyl group or a naphthyl group, having from 6 to 46 carbon atoms, and each of these groups may be substituted by an alkyl group and also the substituents described above about the substituents for the alkyl group shown by Z.

Furthermore, the heterocyclic group shown by Z is a 5-membered to 6-membered heterocyclic group containing a nitrogen atom, an oxygen atom, or a sulfur atom solely or in combination and may form a condensed ring with a benzene ring. Specific examples of the heterocyclic skeleton are as follows.

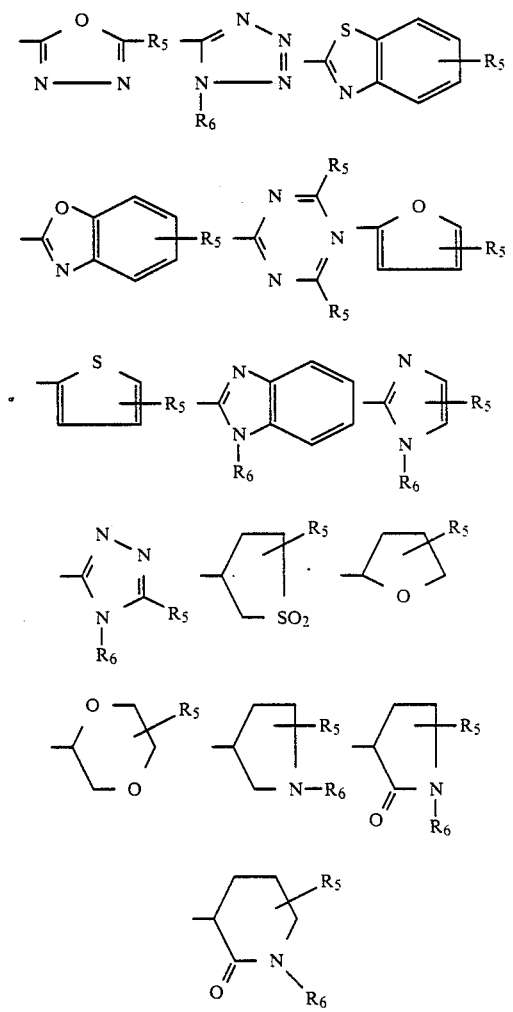

In the above formulae, $R_5$ represents a hydrogen atom, an alkyl group or other substituent the same as those described above about the substituents for the alkyl group shown by Z; and $R_6$ represents a hydrogen atom, an alkyl group, an aryl group, an acyl group, an alkylsulfonyl group, or an arylsulfonyl group.

The acylamino group shown by Y in formula (II) described above represents an alkanamido group having from 1 to 42 carbon atoms or a benzamido group having from 6 to 46 carbon atoms; the ureido group shown by Y represents an alkylureido group having from 1 to 42 carbon atoms or a phenylureido group having from 6 to 46 carbon atoms; and the anilino group shown by Y represents a phenylamino group having from 6 to 46 carbon atoms. The alkyl moiety of these groups may have a substituent the same as the substituents for the alkyl group shown by Z and also the phenyl moiety of the aforesaid group may have a substituent such as an alkyl group or a substituent the same as those described above about the substituent for the alkyl group shown by Z.

Particularly preferred magenta couplers in the 4-mercapto-5-pyrazolone type couplers represented by formula (II) described above are represented by following formulae (IX) and (X):

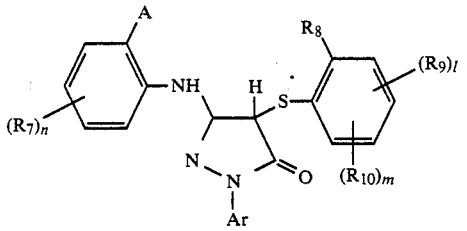

(IX)

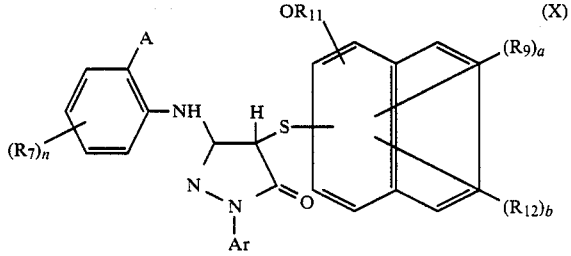

(X)

In the above formulae, Ar represents a phenyl group substituted by at least one halogen atom, alkyl group, alkoxy group, alkoxycarbonyl group or cyano group; A represents a halogen atom or an alkoxy group; $R_7$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, a ureido group, an acyl group, a nitro group, or a carboxy group; $R_8$ represents a halogen atom, a hydroxyl group, an amino group, an alkyl group, an alkoxy group, an aryloxy group, or an aryl group; $R_9$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group, or an alkylthio group; $R_{10}$ represents a hydrogen atom, a halogen atom, a hydroxyl group, an alkyl group, an alkoxy group, or an aryl group; at least one of said $R_8$ and $R_{10}$ represents an alkoxy group; m represents an integer of from 1 to 3; n represents an integer of from 1 to 4; l represents an integer of from 1 to 3; $R_{11}$ represents an alkyl group or an aryl group; $R_{12}$ represents a hydrogen atom, a halogen atom, an alkyl group, an alkoxy group, an aryloxy group, or an aryl group; and a and b each represents an integer of from 1 to 5.

The magenta couplers shown by formulae (IX) and (X) described above are explained in more detail.

In formulae (IX) and (X), Ar is a substituted phenyl group and as the substituent, there are a halogen atom (e.g., a chlorine atom, a bromine atom, a fluorine atom, etc.), an alkyl group having from 1 to 22 carbon atoms (e.g., a methyl group, an ethyl group, a tetradecyl group, a t-butyl group, etc.), an alkoxy group having from 1 to 22 carbon atoms (e.g., a methoxy group, an ethoxy group, an octyloxy group, a dodecyloxy group, etc.), an alkoxycarbonyl group having from 2 to 23 carbon atoms (e.g., a methoxycarbonyl group, an ethoxycarbonyl group, a tetradecyloxycarbonyl group, etc.), and a cyano group.

Also, A in the above formulae represents a halogen atom (e.g., a chlorine atom, a bromine atom, a fluorine atom, etc.) or an alkoxy group having from 1 to 22 carbon atoms (e.g., a methoxy group, an octyloxy group, a dodecyloxy group, etc.).

$R_7$ in the above formulae represents a hydrogen atom, a halogen atom (e.g., a chlorine atom, a bromine atom, a fluorine atom, etc.), an alkyl group (e.g., a methyl group, a t-butyl group, a 2-methanesulfonamidoethyl group, a t-butanesulfonylethyl group, a tetradecyl group, etc.), an alkoxy group (e.g., a methoxy group, an ethoxy group, a 2-ethylhexyloxy group, a tetradecyloxy group, etc.), an acylamino group (e.g., an acetamido group, a benzamido group, a butanamido group, a tetradecanamido group, an α-(2,4-di-tert-amylphenoxy)acetamido group, an α-(2,4-di-tert-amylphenoxy)butylamido group, an α-(3-pentadecylphenoxy)hexanamido group, an α-(4-hydroxy-3-tert-butylphenoxy)tetradecanamido group, an 2-oxopyrrolidin-1-yl group, a 2-oxo-5-tetradecylpyrrolidin-1-yl group, an N-methyltetradecanamido group, an α-(3-methanesulfonamidophenoxy)tetradecanamido group, etc.), a sulfonamido group (e.g., a methanesulfonamido group, a benzenesulfonamido group, a p-toluenesulfonamido group, an octanesulfonamido group, a p-dodecylbenzenesulfonamido group, an N-methyltetradecanesulfonamido group, etc.), a sulfamoyl group (e.g., an N-methylsulfamoyl group, an N-hexadecylsulfamoyl group, an N-[3-(dodecyloxy)propyl]sulfamoyl group, an N-[4-(2,4-di-tert-amylphenoxy)butyl]sulfamoyl group, an N-methyl-N-tetradecylsulfamoyl group, etc.), a carbamoyl group (e.g., an N-methylcarbamoyl group, an N-octadecylcarbamoyl group, an N-[4-(2,4-di-tert-amylphenoxy)butyl]carbamoyl group, an N-methyl-N-tetradecylcarbamoyl group, etc.), a diacylamino group (e.g., an N-succinimido group, an N-phthalimido group, a 2,5-dioxo-1-oxazolidinyl group, a 3-dodecyl-2,5-dioxo-1-hydantoinyl group, a 3-(N-acetyl-N-dodecylamino)succinimido group, etc.), an alkoxycarbonyl group (e.g., a methoxycarbonyl group, a tetradecyloxycarbonyl group, a benzyloxycarbonyl group, etc.), an alkoxysulfonyl group (e.g., a methoxysulfonyl group, an octyloxysulfonyl group, a tetradecyloxysulfonyl group, etc.), an aryloxysulfonyl group (e.g., a phenoxysulfonyl group, a 2,4-di-tert-amylphenoxysulfonyl group, etc.), an alkanesulfonyl group (e.g., a methanesulfonyl group, an octanesulfonyl group, a 2-ethylhexanesulfonyl group, a hexadecanesulfonyl group, etc.), an arylsulfonyl group (e.g., a benzenesulfonyl group, a 4-nonylbenzenesulfonyl group, etc.), an alkylthio group (e.g., an ethylthio group, a hexylthio group, a benzylthio group, a tetradecylthio group, a 2-(2,4-di-tert-amylphenoxy)ethylthio group, etc.), an arylthio group (e.g., a phenylthio group, a p-tolylthio group, etc.), an alkoxycarbonylamino group (e.g., an ethoxycarbonylamino group, a benzyloxycarbonylamino group, a hexadecyloxycarbonylamino group, etc.), a ureido group (e.g., an N-methylureido group, an N-phenylureido group, an N,N-dimethylureido group, an N-methyl-N-dodecylureido group, an N-hexadecylureido group, an N,N-dioctadecylureido group, etc.), an acyl group (e.g., an acetyl group, a benzoyl group, an octadecanoyl group, a p-dodecanamidobenzoyl group, etc.), a nitro group, or a carboxyl group. In the above substituents, however, the alkyl moiety has from 1 to 42 carbon atoms and the aryl moiety has from 6 to 46 carbon atoms.

$R_8$ in the above formulae represents a halogen atom (e.g., a chlorine atom, a bromine atom, etc.), a hydroxyl group, an amino group (a substituted or unsubstituted amino group such as an N-alkylamino group, an N,N-dialkylamino group, an N-anilino group, an N-alkyl-N-arylamino group, and a heterocyclic amino group and specific examples thereof are an N-butylamino group, an N,N-dibutylamino group, an N,N-dihexylamino group, an N-piperidino group, an N,N-bis(2-dodecyloxyethyl)amino group, an N-cyclohexylamino group, an N-phenylamino group, an N,N-bis(2-hexanesulfonylethyl)amino group, etc.), an alkyl group (a straight or branched chain alkyl, aralkyl, alkenyl, cycloalkyl, or cycloalkenyl group, such as a methyl group, a butyl group, an octyl group, a dodecyl group, a benzyl group, a cyclopentyl group, a 2-methanesulfonylethyl group, a 3-phenoxypropyl group, etc.), an alkoxy group (e.g., a methoxy group, a butoxy group, a benzyloxy group, a 2-ethylhexyloxy group, a dodecyloxy group, a 2-methanesulfonylethyloxy group, a 2-butanesulfonylethyloxy group, an isopropyloxy group, a 2-chloroethyloxy group, a 3-(2,4-di-tert-amylphenoxy)propyloxy group, a 2-(N-methylcarbamoyl)ethoxy group, a cyclopentyloxy group, a 2-ethoxytetradecyloxy group, a 4,4,4,3,3,2,2-heptafluorobutyloxy group, a 3-(N-butylcarbamoyl)propyloxy group, a 3-(N,N-dimethylcarbamoyl)propyloxy group, a 4-methanesulfonylbutoxy group, a 2-ethanesulfonamidoethyloxy group, etc.), an aryloxy group (e.g., a phenoxy group, a 2,4-dichlorophenoxy group, etc.), or an aryl group (a substituted or unsubstituted phenyl group having from 6 to 38 carbon atoms or an $\alpha$- or $\beta$-naphthyl group, such as a phenyl group, an $\alpha$- or $\beta$-naphthyl group, a 4-chlorophenyl group, a 4-t-butylphenyl group, a methanesulfonamidophenyl group, a 2,4-dimethylphenyl group, etc.).

$R_9$ in the above formulae represents a hydrogen atom, an amino group (a substituted or unsubstituted amino group such as an N-a kylamino group, an N,N-dialkylamino group, an N-anilino group, an N-alkyl-N-arylamino group, and a heterocyclic amino group and specific examples thereof are an N-butylamino group, an N,N-diethylamino group, an N-[2-(2,4-di-tert-amylphenoxy)ethyl]amino group, an N,N-dibutylamino group, an N-piperidino group, an N,N-bis(2-dodecyloxyethyl)amino group, an N-cyclohexylamino group, an N,N-dihexylamino group, an N-phenylamino group, a 2,4-di-tert-amylphenylamino group, an N-(2-chloro-5-tetradecanamidophenyl)amino group, an N-methyl-N-phenylamino group, an N-(2-pyridyl)amino group, etc.), an acylamino group (e.g., an acetamido group, a benzamido group, a tetradecanamido group, a (2,4-di-tert-amylphenoxy)acetamido group, a 2-chlorobenzamido group, a 3-pentadecylbenzamido group, a 2-(2-methanesulfonamidophenoxy)dodecanamido group, a 2-(2-chlorophenoxy)tetradecanamido group, etc.), a ureido group (e.g., a methylureido group, a phenylureido group, a 4-cyanophenylureido group, etc.), an alkoxycarbonylamino group (e.g., a methoxycarbonylamino group, a dodecyloxycarbonylamino group, a 2-ethylhexyloxycarbonylamino group, etc.), an imido group (e.g., an N-succinimido group, an N-phthalimido group, an N-hydantoinyl group, a 5,5-dimethyl-2,4-dioxooxazol-3-yl group, an N-(3-octadecenyl)succinimido group, etc.), a sulfonamido group (e.g., a methanesulfonamido group, an octanesulfonamido group, a benzenesulfonamido group, a 4-chlorobenzenesulfonamido group, a 4-dodecylbenzenesulfonamido group, an N-methyl-N-benzenesulfonamido group, a 4-dodecyloxybenzenesulfonamido group, a hexadecanesulfonamido group, etc.), a sulfamoylamino group (e.g., an N-octylsulfamoylamino group, an N,N-dipropylsulfamoylamino group, an N-ethyl-N-phenylsulfamoylamino group, an N-(4-butyloxy)sulfamoylamino group, etc.), a nitro group, an alkoxycarbonyl group (e.g., a methoxycarbonyl group, a butoxycarbonyl group, a dodecyloxycarbonyl group, a benzyloxycarbonyl group, etc.), a carbamoyl group (e.g., an N-octylcarbamoyl group, an N,N-dibutylcarbamoyl group, an N-phenylcarbamoyl group, an N-[N-(2,4-di-tert-amylphenoxy)propyl]carbamoyl group, etc.), an acyl group (e.g., an acetyl group, a benzoyl group, a hexanoyl group, a 2-ethylhexanoyl group, a 2-chlorobenzoyl group, etc.), a cyano group, or an alkylthio group (e.g., a dodecylthio group, a 2-ethylhexylthio group, a benzylthio group, a 2-oxocyclohexylthio group, a 2-(ethyltetradecanoate)thio group, a 2-(dodecylhexanoate)thio group, a 3-phenoxypropylthio group, a 2-dodecanesulfonylethylthio group, etc.).

$R_{10}$ in the above formulae represents hydrogen atom, a hydroxyl group, or the alkyl, alkoxy, or aryl group as stated above about $R_8$. At least one of said $R_8$ and $R_{10}$ is an alkoxy group.

$R_{11}$ in the above formulae represents an alkyl group or an alkyl group as described above about $R_8$ and $R_{12}$ in the above formulae represents a hydrogen atom or a halogen atom, an alkyl group, an alkoxy group or an aryl group as described above about $R_8$.

Among these couplers, those represented by formula (IX) are most preferred.

Specific examples of the magneta couplers shown by formula (II) described above are illustrated below but the magenta couplers for use in this invention are not limited thereto.

m-1
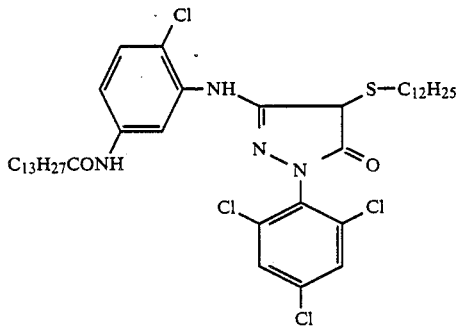
m-2.
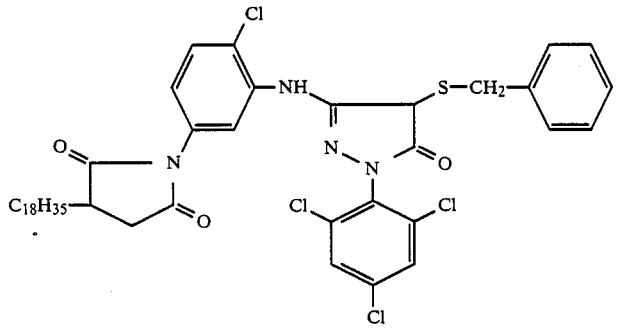
m-3
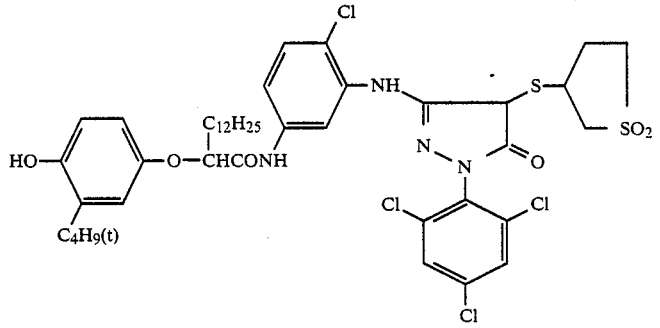
m-4
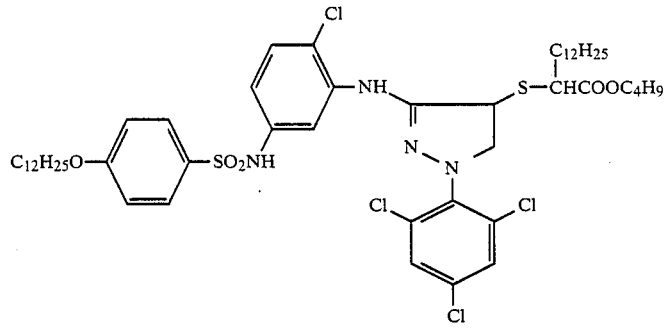
m-5
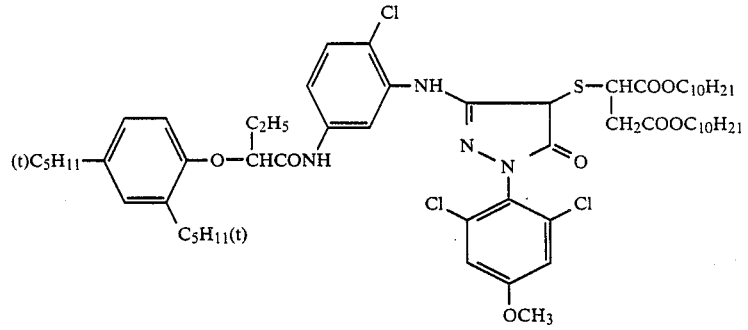

-continued
m-6
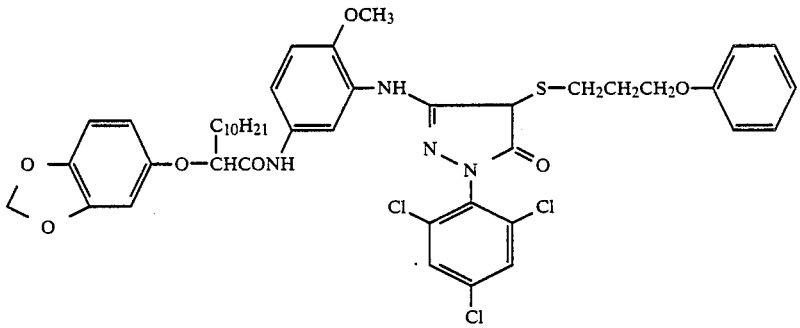
m-7
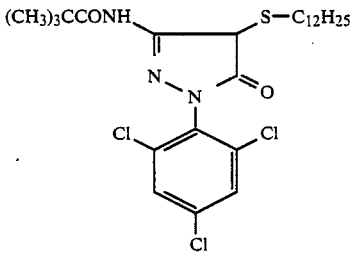
m-8
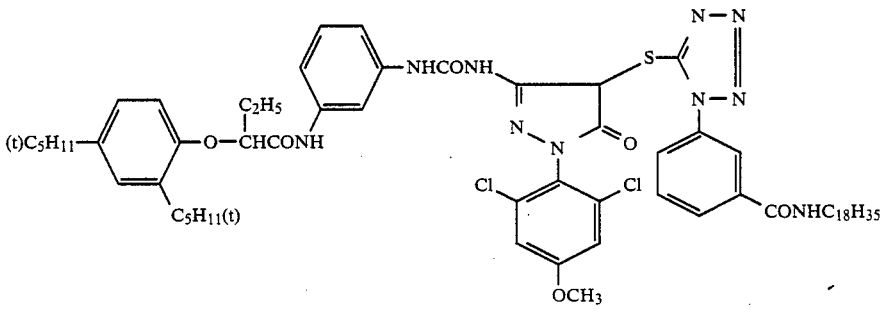
m-9
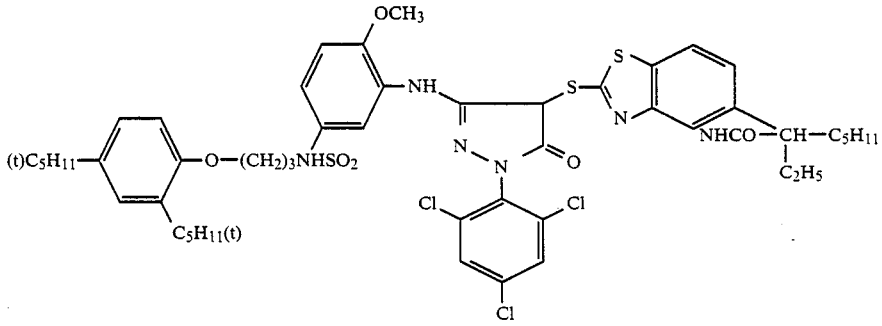
m-10
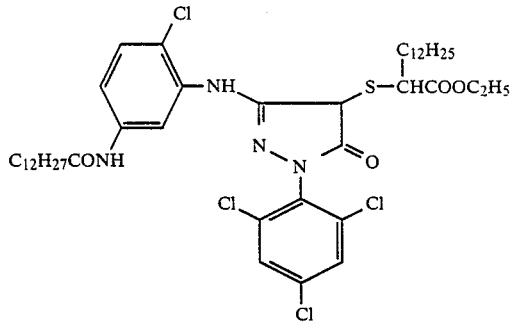

-continued
m-11
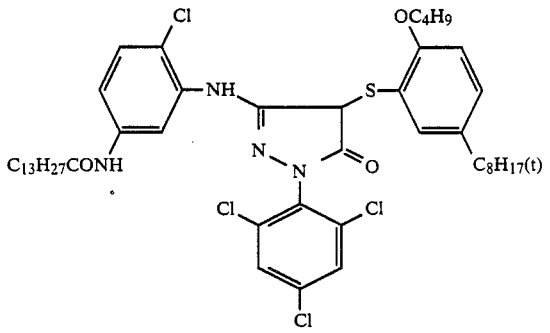
m-12
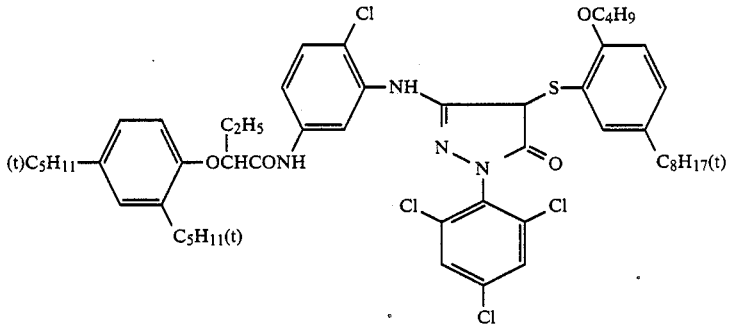
m-13
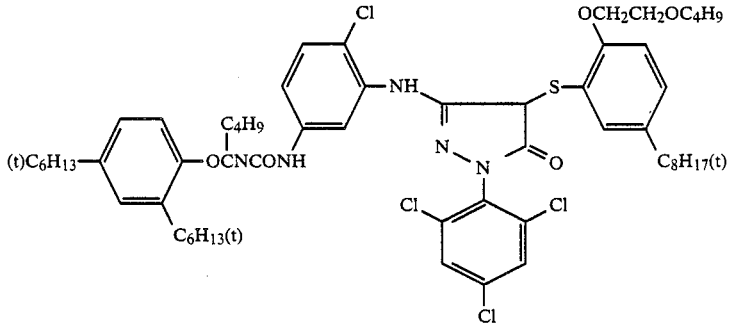
m-14
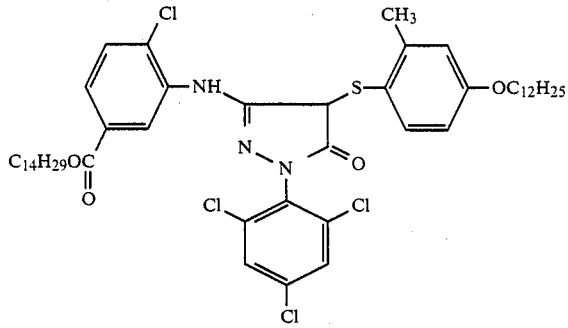
m-15
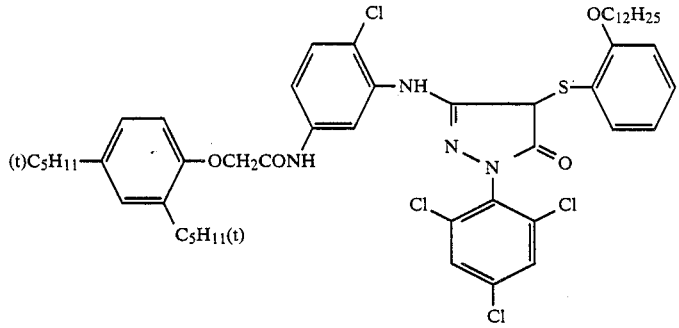

-continued
m-16
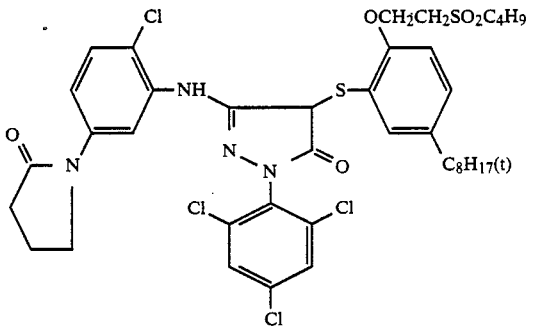
m-17
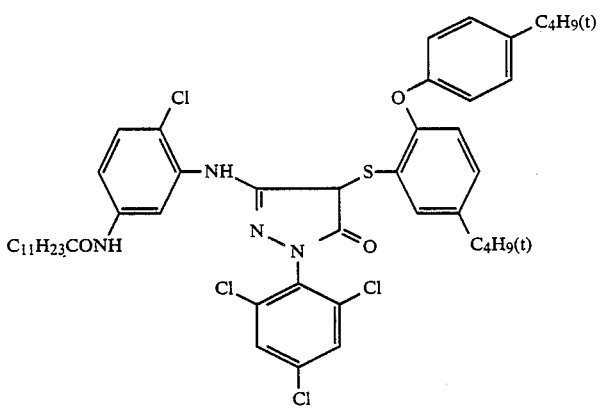
m-18
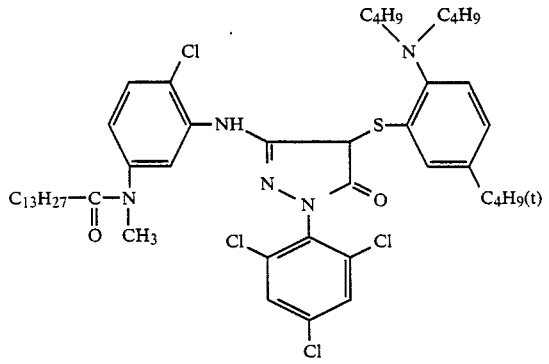
m-19
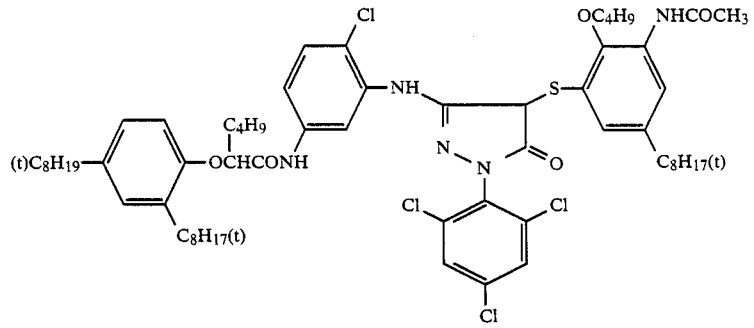

-continued
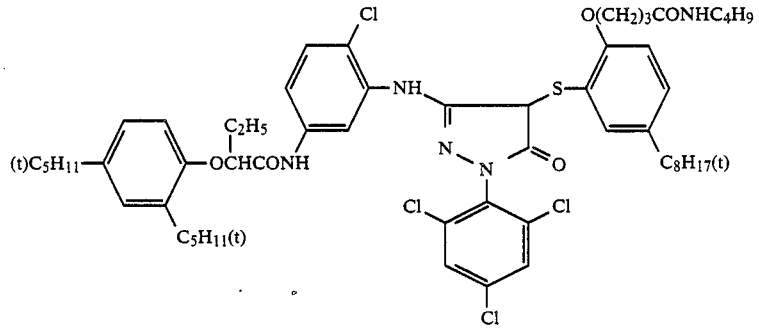
m-20
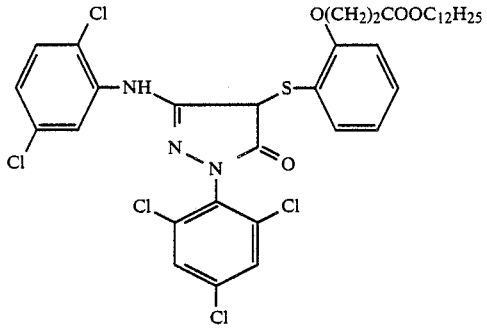
m-21
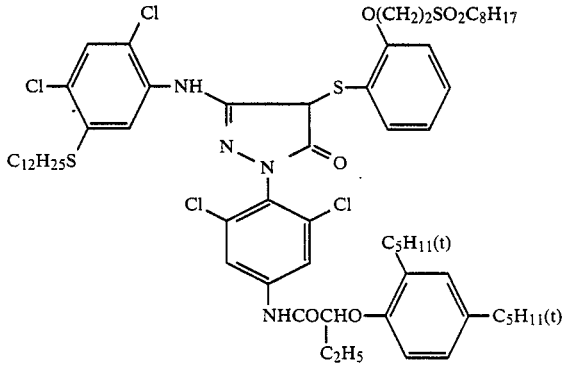
m-22
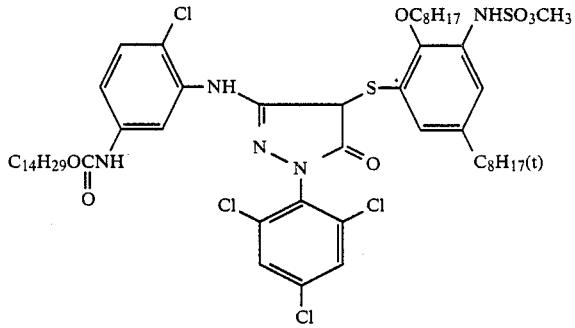
m-23

-continued
m-24
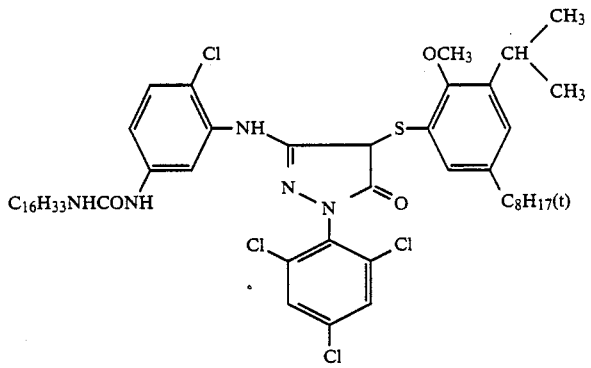
m-25
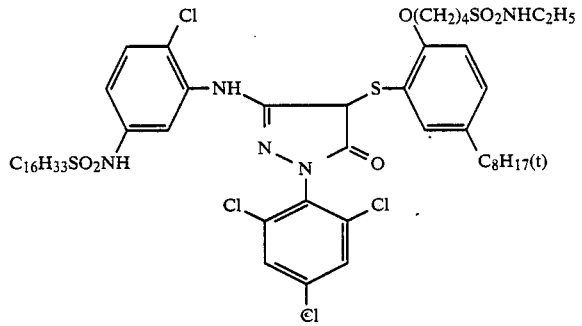
m-26
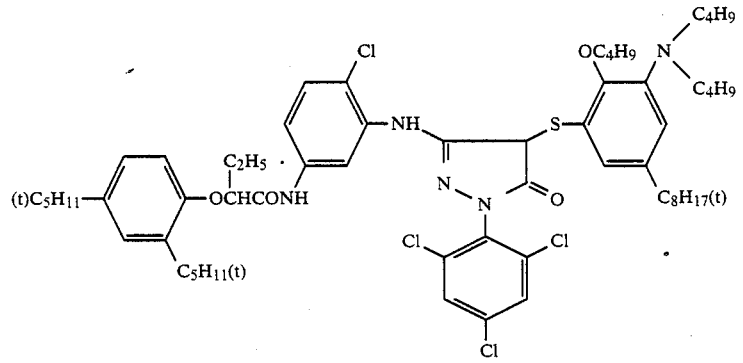
m-27
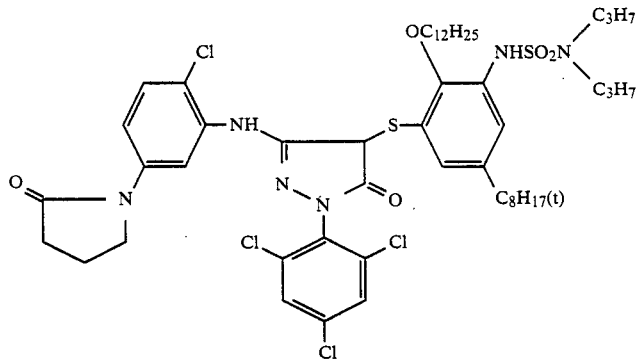

-continued
m-28
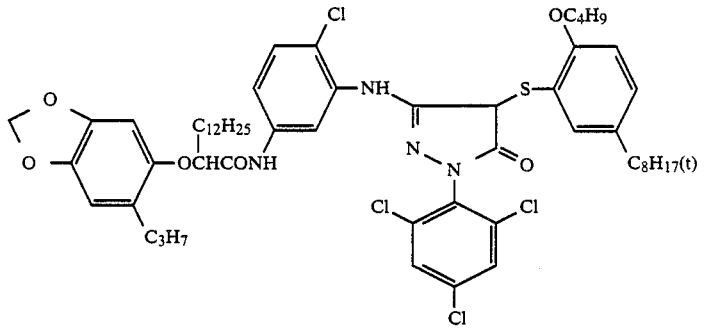
m-29
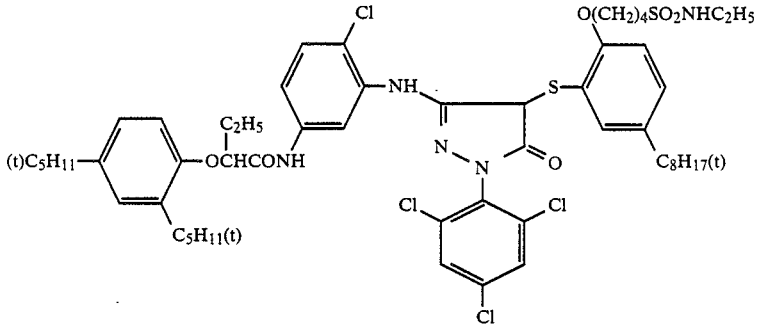
m-30
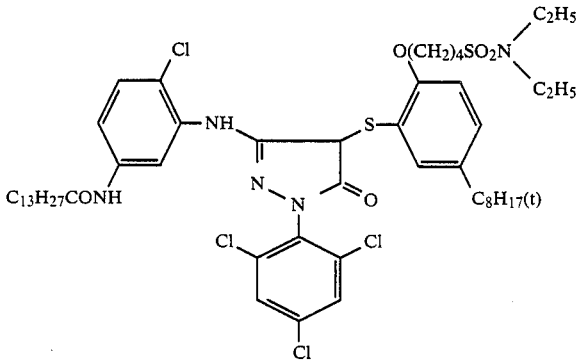
m-31
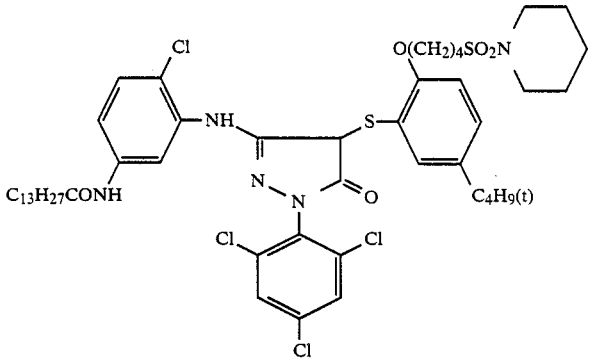

-continued
m-32
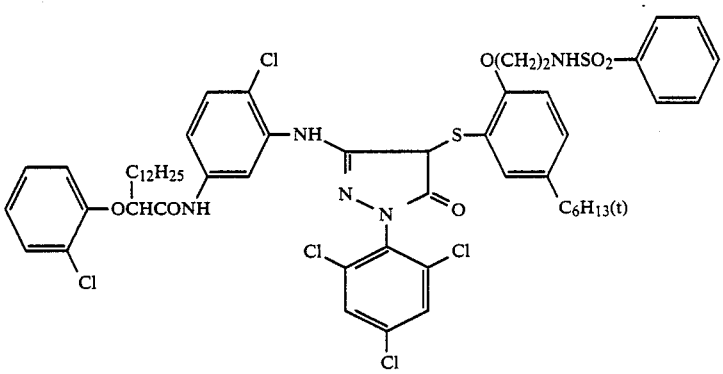
m-33
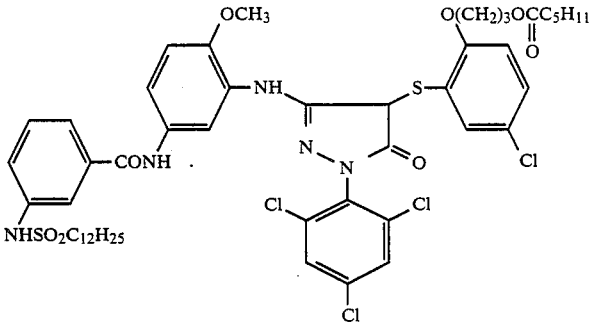
m-34
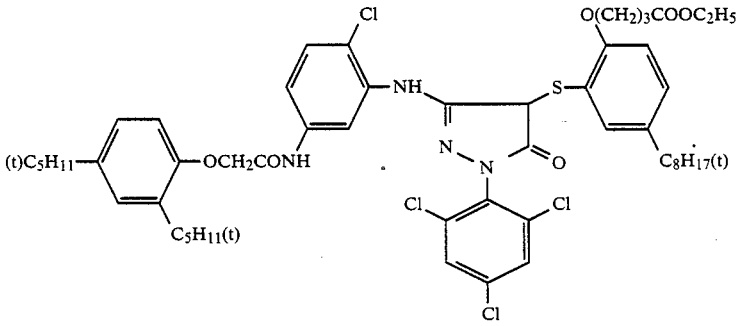
m-35
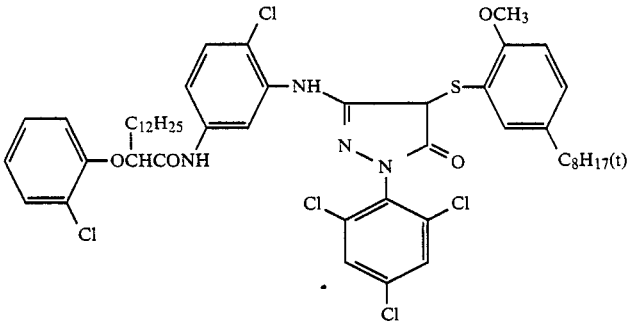

-continued m-36

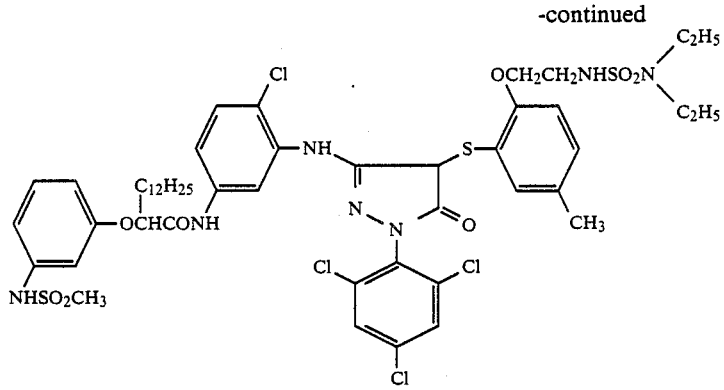

m-37

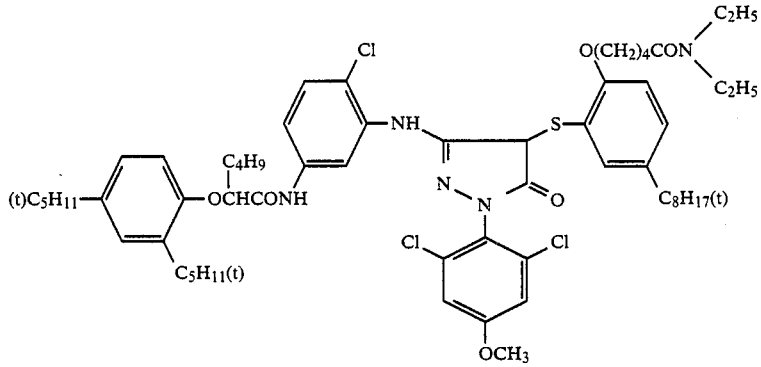

The magenta couplers for use in this invention can be synthesized based on the methods described, for example, in Japanese Patent Publication No. 34044/78, Japanese Patent Application (OPI) No. 62454/80, U.S. Pat. No. 3,701,783, etc.

Yellow couplers for use in this invention are typically hydrophobic acylacetamide series couplers having a ballast group as described in U.S. Pat. Nos. 2,407,210, 2,875,057, and 3,265,506, etc. In this invention, the use of two-equivalent yellow couplers is preferred, and typical examples of these yellow couplers are the oxygen atom-releasing type yellow couplers described in U.S. Pat. Nos. 3,408,194, 3,447,928, 3,933,501, and 4,002,620, etc.; and the nitrogen atom-releasing type yellow couplers described in Japanese Patent Publication No. 10739/83, U.S. Pat. Nos. 4,401,752 and 4,326,024, *Research Disclosure,* RD No. 18053 (April 1979), British Patent 1,425,020, West German Patent Application (OLS) Nos. 2,219,917, 2,261,361, 2,329,587, and 2,433,812, etc. Of these yellow couplers, α-pivaloylacetanilide series yellow couplers are excellent in fastness, in particular light fastness of colored dyes, while α-benzoylacetanilide series yellow couplers give high color density.

As cyan couplers for use in this invention, there are hydrophobic and non-diffusible naphthol or phenol series cyan couplers. As naphthol series cyan couplers, there are the naphthol series couplers described, for example, in U.S. Pat. No. 2,474,293 and preferably the oxygen atom-releasing type two-equivalent naphthol series couplers described, for example, in U.S. Pat. Nos. 4,052,212, 4,146,396, 4,228,233, and 4,296,200, etc. Specific examples of the phenol series couplers are described in U.S. Pat. Nos. 2,369,929, 2,801,171, 2,772,162, and 2,895,826, etc.

Cyan couplers capable of forming cyan dyes having fastness to humidity and temperature are preferably used in this invention, and specific examples of such cyan couplers are the phenol series cyan couplers having an alkyl group having at least 2 carbon atoms at the meta-position of the phenol nucleus as described in U.S. Pat. No. 3,772,002; the 2,5-diacylamino-substituted phenol series couplers described in U.S. Pat. Nos. 2,722,162, 3,758,308, 4,126,396, 4,334,011, and 4,327,173, West German Patent Application (OLS) No. 3,329,729, European Patent 121,365, etc.; and the phenol series couplers having a phenylureido group at the 2-position and an acylamino group at the 5-position as described in U.S. Pat. Nos. 3,446,622, 4,333,999, 4,451,559, and 4,427,767, etc.

In particular, the naphthol series cyan couplers having a sulfonamido, an amido group, etc. at the 5-position of the naphthol nucleus as described in Japanese Patent Application (OPI) Nos. 237448/85, 145557/61, 153640/86, and 179438/86, etc are excellent in the fastness of color images formed and can be preferably used in this invention.

Also, in this invention, colored couplers having a color correction effect or so-called DIR couplers or DAR couplers, i.e., couplers releasing a development inhibitor or a development accelerator with color development can be used.

Typical colored couplers are the yellow-colored magenta couplers described in U.S. Pat. No. 4,163,670, Japanese Patent Publication No. 39413/82, etc., and the magenta-colored cyan couplers described in U.S. Pat. Nos. 4,004,929 and 4,138,258, British Patent 1,146,368, etc. Other colored couplers which can be also used in this invention are described in *Research Disclosure,* RD No. 17643, VII-G.

Useful DIR couplers releasing a development inhibitor are described in *Research Disclosure,* RD No. 17643, VII-F.

Non-color forming DIR coupling compounds capable of releasing a development inhibitor, which provide colorless products upon coupling reaction, may also be contained in addition to the DIR coupler.

In place of the DIR couplers, compounds capable of releasing a development inhibitor or other photographically useful residue with development can be used in this invention.

In this invention, the graininess of color images can be improved using couplers giving colored dyes having proper diffusibility together with the above-described couplers. Specific examples of these couplers are the magenta couplers describedin U.S. Pat. No. 4,366,237 and British Patent 2,125,570 and the yellow, magenta and cyan couplers described in European Patent 96,570 and West German Patent Application (OLS) No. 3,234,533.

The dye-forming coupler and the specific coupler described above may form a dimer or more oligomer or polymer. Typical examples of polymerised dye-forming couplers are described in U.S. Pat. Nos. 3,451,820 and 4,080,211. Furthemore, specific examples of the polymerized magenta couplers are described in British Patent 2,102,173 and U.S. Pat. No. 4,367,282.

These couplers are incorporated in the silver halide emulsion layer(s) in an amount of generally from $2\times10^{-3}$ mol to $5\times10^{-1}$ mol, preferably from $1\times10^{-2}$ mol to $5\times10^{-1}$ mol, per mol of silver in the emulsion layer(s).

The above-described couplers can be used in one emulsion layer as a combination of two or more kinds thereof or, as a matter of course, the same kind of coupler may be used in the two or more emulsion layers for satisfying the characteristics required for color photographic materials, such as photographic characteristics (e.g., sensitivity, gradation, fog, etc.), image storage stability, color forming properties, etc.

For introducing couplers in the silver halide emulsion layer(s), the methods described, for example, in U.S. Pat. No. 2,322,027, etc. can be used. For example, a coupler or couplers are dissolved in a high-boiling organic solvent such as a phthalic acid alkyl ester (e.g., dibutyl phthalate, dioctyl phthalate, etc.), a phosphoric acid ester (e.g., diphenyl phosphate, triphenyl phosphate, tricresyl phosphate, dioctylbutyl phosphate, etc.), a citric acid ester (e.g., tributyl acetylcitrate, etc.), a benzoic acid ester (e.g., octyl benzoate, etc.), an alkylamide (e.g., diethyllaurylamide, etc.), a fatty acid ester (e.g., dibutoxyethyl succinate, diethyl azerate, etc.), trimesinic acid ester (e.g., tributyl trimesinate, etc.), etc. or a low-boiling organic solvent having a boiling point of from about 30° C. to about 150° C., such as a lower alkyl acetate (e.g., ethyl acetate, butyl acetate, etc.), ethyl propionate, sec-butyl alcohol, methyl isobutyl ketone, -ethoxyethyl acetate, methyl cellosolve acetate, etc., etc. and then dispersed in a hydrophilic colloid. The above-described high-boiling organic solvent and low-boiling organic solvent may be used as a mixture thereof.

For the photographic emulsion layer(s) of the color photographic material processed by the process of this invention, a silver halide such as silver bromide, silver iodobromide, silver iodochlorobromide, silver chlorobromide, and silver chloride can be used.

A silver chloride emulsion and a silver chlorobromide emulsion containing at least 10 mol% silver bromide can be preferably used in this invention. It is preferred for obtaining a silver halide emulsion having a sufficient sensitivity without increasing fog that the content of silver bromide is at least 20 mol% but it is sometimes preferred in the case of requiring quick processing for color photographic materials that the content of silver bromide is less than about 20 mol% or less than about 10 mol%. When the content of silver bromide in a silver halide emulsion is low, not only the speed of photographic processing is increased but also in the case of continuously processing the color photographic materials containing the silver halide emulsion in running system, the equilibrium amount of bromide ion accumulated in the developer, said amount being determined in the relation with the amount of the replenisher, is small, that is, the bromide ion in the equilibrium state exists in a low concentration, whereby the quick developing property of the developer itself can be established at a high level.

The silver halide grains in the photographic emulsion(s) for use in this invention may be so-called regular grains having a regular crystal form such as cube, octahedron, tetradecahedron, etc. or may be irregular grains having an irregular crystal form such as sphere. The silver halide grains may have a crystal defect such as twin, etc. or may have a composite form thereof.

The silver halide may be fine grains having grain sizes of less than about 0.1 micron or large grains having a projected area diameter of up to about 10 microns. Also, the silver halide emulsion may be a monodispersed emulsion having a narrow grain size distribution or a polydispersed emulsion having a broad grain size distribution.

Two or more kinds of silver halide emulsions separately prepared may be used as a mixture thereof.

A typical monodispersed silver halide emulsion contains silver halide grains having a mean grain size of at least about 0.1 micron wherein at least about 95% by weight of the silver halide grains are within 40% of the mean grain size. A silver halide emulsion containing silver halide grains having a mean grain size of about 0.25 to 2 microns wherein at least 95% by weight or by number of the silver halide grains are within 20% of the mean grain size can be used in this invention.

Also, tabular silver halide grains having an aspect ratio of at least about 5 can be used in this invention. A tabular grain silver halide emulsion can be easily prepared by the methods described in Gutoff, *Photographic Science and Engineering,* Vol. 14, 248–257 (1970); U.S. Pat. Nos. 4,434,226, 4,141,310, 4,433,048, and 4,439,520; British Patent 2,112,157, etc. In the case of using the tabular grain silver halide emulsion, the merits that the color sensitization efficiency by sensitizing dye(s) is improved and that the graininess and sharpness are improved are obtained as described in detail, in U.S. Pat. No. 4,434,226 cited above.

The crystal structure of silver halide may have a uniform halogen composition throughout the whole grain or may be differ in halogen composition between the inside and the outside thereof. The silver halide may have a stratiform structure. These emulsions are disclosed in British Patent 1,027,146; U.S. Pat. Nos. 3,505,068 and 4,444,877; Japanese Patent Application (OPI) No. 143331/85, etc. Also, silver halides each having a different halogen composition and jointed by epitaxial junction can be also used in this invention.

Furthermore, a mixture of silver halide grains having various crystal forms may be used.

The silver halide emulsions for use in this invention are generally subjected to physical ripening, chemical ripening, and spectral sensitization. Additives which are used for these treatments are described in *Research Disclosure,* RD No. 17643 and ibid., RD No. 18716 and the corresponding portions are shown in the following table.

Furthermore, other photographic additives known in the field of art, which can be also used in this invention, are described in the aforesaid two literatures and these corresponding portions are also known in the following table.

| Additives | RD 17643 | RD 18716 |
|---|---|---|
| 1. Chemical Sensitizer | Page 23 | Page 648, right column |
| 2. Sensitivity Increasing Agent | | " |
| 3. Spectral Sensitizer, Supersensitizer | Pages 23 to 24 | Page 648, right column to Page 649, right column |
| 4. Whitening Agent | Page 24 | |
| 5. Antifoggant and Stabilizer | Pages 24 to 25 | Page 649, right column |
| 6. Light-Absorbent, Filter Dye, Ultra-violet Light Absorbent | Pages 25 to 26 | Page 649, right column to Page 650, left column |
| 7. Stain Preventing Agent | Page 25, right column | Page 650, left column to right column |
| 8. Dye Image Stabilizer | Page 25 | |
| 9. Hardening Agent | Page 26 | Page 651, left column |
| 10. Binder | Page 26 | " |
| 11. Plasticizer, Lubricant | Page 27 | Page 650, right column |
| 12. Coating Aid, Surface Active Agent | Pages 26 to 27 | " |
| 13. Antistatic Agent | Page 27 | " |

RD: Research Disclosure

The process of this invention can be applied to various kinds of color photographic materials such as general or cinematic color negative films, color reversal films for slide or television, color papers, color positive films, and color reversal papers. This invention can be also applied to black-and-white photographic materials utilizing a mixture of three color couplers described in *Research Disclosure,* RD No. 17123 (July 1978).

Also, the above-described color photographic materials can be processed by an ordinary process with exception that the water washing step is performed according to this invention.

The color developer for use in this invention contains an aromatic primary amine color developing agent. Preferred color developing agents are p-phenylenediamine derivatives. Specific examples are shown below although the color developers for use in this invention are not limited to these compounds.

D-1: N,N-Diethyl-p-phenylenediamine
D-2: 2-Amino-5-diethylaminotoluene
D-3: 2-Amino-5-(N-ethyl-N-laurylamino)toluene
D-4: 4-[N-Ethyl-N-(β-hydroxyethyl)amino]aniline
D-5: 2-Methyl-4-[N-ethyl-N-(β-hydroxyethyl-)anilino]aniline
D-6: N-Ethyl-N-(β-methanesulfonamidoethyl)-3-methyl-4-aminoaniline
D-7: N-(2-Amino-5-diethylaminophenylethyl)methansulfonamide
D-8: N,N-Dimethyl-p-phenylenediamine
D-9: 4-Amino-3-methyl-N-ethyl-N-methoxyethylaniline
D-10: 4-Amino-3-methyl-N-ethyl-N-β-ethoxyethylaniline
D-11: 4-Amino-3-methyl-N-ethyl-N-β-butoxyethylaniline.

Also, these p-phenylenediamine derivatives may be in the form of salts such as sulfates, hydrochlorides, sulfites, p-toluenesulfonates, etc. The amount (concentration) of the aromatic primary amine developing agent is generally from about 0.1 g to about 20 g, preferably from about 0.5 g to about 10 g, per liter of the developer.

The color developer which is used for the process of this invention may contain various hydroxylamines.

A hydroxylamine may be used in the form of free amines in a color developer but is generally used in the form of a water-soluble acid salt, such as a sulfate, an oxalate, a chloride, a phosphate, a carbonate, an acetate, etc. The hydroxylamine may be substituted or unsubstituted and also the nitrogen atom of the hydroxylamine may be substituted by an alkyl group (having, for example, from 1 to 33 carbon atoms). A hydroxylamine substituted by two alkyl groups (each having, for example, from 1 to 3 carbon atoms) is preferred.

The addition amount of the hydroxylamine is preferably from 0 g to 10 g, more preferably from 0 g to 5 g, per liter of the color developer. If the stability of the color developer is kept, the addition amount of the hydroxylamine is preferably as small as possible from the standpoint of fog.

Also, the color developer preferably contains a sulfite such as sodium sulfite, potassium sulfite, sodium hydrogensulfite, potassium hydrogensulfite, sodium metasulfite, potassium metasulfite, etc. or a carbonylsulfurous acid addition product as a preservative. The addition amount of the preservative is preferably from 0 g to 20 g, more preferably from 0 g to 5 g, per liter of the color developer. If the stability of the color developer is kept, the amount is preferably as small as possible.

Examples of other preservatives are aromatic polyhydroxy compounds described in Japanese patent application (OPI) Nos. 49828/77, 47038/81, 32140/81, and 160142/84; U.S. Pat. No. 3,746,544, etc.; hydroxyacetones described in U.S. Pat. No. 3,615,503, British Pat. No. 1,306,176, etc.; α-aminocarbonyl compounds described in Japanese patent application (OPI) Nos. 143020/77 and 89425/78, etc.; various metals described in Japanese patent application (OPI) Nos. 44148/82 and 53749/82, etc.; various zsaccharides described in Japanese patent application (OPI) No. 102727/77; hydroxamic acids described in Japanese patent application (OPI) No. 27638/77; α,α'-dicarbonyl compounds described in Japanese patent application (OPI) No.

160141/84; salicylic acids described in Japanese patent application (OPI) No. 180588/84; alkanolamines described in Japanese patent application (OPI) No. 3532/79; poly(alkyleneimines) described in Japanese patent application (OPI) No. 94349/81; gluconic acid derivatives described in Japanese patent application (OPI) No. 75647/81; etc.

These preservatives may be, if desired, used as a mixture thereof. In particular, a combination of alkanolamines such as a combination of an N,N-dialkyl-substituted hydroxylamine and triethanolamine is preferred.

The pH of the color developer for use in this invention is preferably from 9 to 12, more preferably from 9 to 11.0.

The color developer may further contain other developer components. For example, the color developer may preferably contain various buffers for keeping the aforesaid pH.

Examples of the buffer are carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, lysine salts, etc. In particular, carbonates, phosphates, tetraborates, and hydroxybenzoates are preferably used because they are excellent in solubility and buffering faculty in the high pH range of at least 9.0, they give no adverse influences (e.g., the formation of fog, etc.) on photographic performance of color photographic materials when added to a color developer, and they are inexpensive.

Specific examples of these buffers are sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxylbenzoate (sodium salicylate), potassium o-hydroxybenzoate, sodium 5-sulfo-2-hydroxybenzoate (sodium 5-sulfosalicylate), potassium 5-sulfo-2-hydroxybenzoate (potassium 5-sulfosalicylate), etc. The buffers for use in this invention are not limited to these exemplified materials.

The addition amount of the buffer to a color developer is preferably at least 0.1 mol/liter, more preferably from about 0.1 mol/liter to about 0.4 mol/liter.

Futhermore, the color developer can contain various chelating agents as a precipitation preventing agent for calcium and magnesium and for improving the stability of the color developer.

Examples of the preferred chelating agents are organic acid compounds such as aminopolycarboxylic acids described in Japanese Patent Publication Nos. 30496/73 and 30232/69, etc.; organic phosphoric acids described in Japanese patent application (OPI) No. 97347/81, Japanese Patent Publication No. 39359/81, West German Pat. No. 2,227,639, etc.; phosphonocarboxylic acids described in Japanese patent application (OPI) Nos. 102726/77, 42730/78, 121127/79, 126241/80, and 65956/80, etc.; and the compounds described in Japanese patent application (OPI) Nos. 195845/83 and 203440/83, Japanese Patent Publication No. 40900/78, etc. Specific examples of the chelating agent are shown below but the chelating agents for use in this invention are not limited to these compounds.

Nitrilotriacetic acid
Diethylenetriaminepentaacetic acid
Nitrilo-N,N,N-trimethylenephosphonic acid
Ethylenediamine-N,N,N',N'-tetramethylenephosphonic acid
1,3-Diamino-2-propanoltetraacetic acid
Trans-cyclohexanediaminetetraacetic acid
Nitrilotripropionic acid
1,2-Diaminopropanetetraacetic acid
Hydroxyethyliminodiacetic acid
Glycol ether diaminetetraacetic acid
Hydroxyethylenediaminetriacetic acid
Ethylenediamine o-hydroxyphenylacetic acid
2-Phosphonobutane-1,2,4-tricarboxylic acid
1-Hydroxyethylidene-1,1-diphosphonic acid
N,N-Bis(2-hydroxybenzyl)ethylenediamine-N,N'-diacetic acid.

These chelating agents may be used as a mixture of two or more thereof, if desired.

The addition amount of the chelating agent may be one sufficient for blocking metal ions in the color developer and, for example, from about 0.1 g to about 10 g per liter of the color developer.

The color developer for use in this invention may also contain various development accelerators. Examples of the development accelerator are thioether series compounds described in Japanese Patent Publication Nos. 16088/62, 5987/62, 7826/63, 12380/69, and 9019/70, U.S. Pat. No. 3,813,247, etc.; p-phenylenediamine series compounds described in Japanese patent application (OPI) Nos. 49829/77 and 15554/75, etc.; quaternary ammonium salts described in Japanese Patent Publication No. 30074/69, Japanese patent application (OPI) Nos. 137726/75, 156826/81, and 43429/77, etc.; p-aminophenols described in U.S. Pat. Nos. 2,610,122 and 4,119,462, etc.; amine series compounds described in U.S. Pat. Nos. 2,494,903, 3,128,182, 4,230,796, 3,253,919, 2,482,546, 2,596,926, and 3,582,346, Japanese Patent Publication No. 11431/66, etc.; and polyalkylene oxides described in Japanese Patent Publication Nos. 16088/62, 25201/67, 11431/66, and 23883/67, U.S. Pat. Nos. 3,128,183 and 3,532,501, etc. Furthermore, 1-phenyl-3-pyrazolidones, hydrazines, mesoion type compounds, thion type compounds, imidazoles, etc. may be used as the chelating agent. In the aforesaid compounds, thioether series compounds and 1-phenyl-3-pyrazolidones are preferred.

In this invention, it is preferred that the color developer contains a bromine ion for preventing the fog formation. The amount of the bromine ion is preferably as small as possible taking into account the acceleration of the development but when the amount of the replenisher is reduced, the amount is preferably large.

Furthermore, the color developer may contain a compound giving a chlorine ion, such as sodium chloride and potassium chloride, as an inorganic antifoggant. Also, if desired, an organic antifoggant may be added to the developer. Examples of such an organic antifoggant are adenines, benzimidazoles, benzotriazoles, and tetrazoles.

The amount of the antifoggant is preferably as small as possible if it can prevent the formation of fog and is preferably from 0.001 g to 10 g, more preferably from 0.010 g to 2 g, per liter of the color developer.

These antifoggants may elute out from the color photographic material during the processing to accumulate in the color developer.

It is preferred that the color developer of this invention contains a fluorescent whitening agent. As the fluorescent whitening agent, 4,4'-diamino-2,2'-disulfostilbene compounds are preferred. The addition amount thereof is preferably from 0 g to 5 g/liter, more preferably from 0.1 g to 2 g/liter.

Also, if desired, the color developer may further contain a surface active agent such as an alkylphosphonic acid, an arylphosphonic acid, an aliphatic carboxylic acid, an aromatic carboxylic acid, etc.

The processing temperature of the color developer in this invention is preferably from 20° to 50° C., more preferably from 30° to 40° C. Also, the color development time is preferably from 20 seconds to 3 minutes 30 seconds, more preferably from 30 seconds to 2 minutes. Now, the "color development time" referred to herein is the time required for the color photographic material from the contact with the color developer to the contact with a processing liquid in the subsequent bath and includes a so-called transfer time.

The amount of the replenisher for the color developer is preferably from 20 to 600 ml, more preferably from 50 to 300 ml, particularly preferably from 100 to 200 ml, per square meter of the color photographic material.

In this invention, after color development, the light-sensitive material is usually bleached. The bleach process may be performed simultaneously with (i.e., bleach fix processing) or separately from a fix process. Furthermore, for quickening the photographic process, a process of bleach fixing after bleaching may be employed.

As a bleaching agent for the bleach process or bleach fix process, there are, for example, organic complex salts of iron(III) (e.g., complex salts of aminopolycarboxylic acids such as ethylenediaminetetraacetic acid, diethylenetriaminepentaacetic acid, etc. or of organic phosphonic acids such as aminopolyphosphonic acid, phosphonocarboxylic acid, organic phosphonic acids, etc.); organic acids such as citric acid, tartaric acid, malic acid, etc; persulfates; hydrogen peroxide, etc. In these materials, organic complex salts of iron(III) are preferred from the viewpoint of quick processing and prevention of environmental pollution.

Examples of the aminopolycarboxylic acids, aminopolyphosphonic acids, and organic phosphonic acids or the salts thereof are as follows:

Ethylenediaminetetraacetic acid
Diethylenetriaminepentaacetic acid
Ethylenediamine-N-(β-oxyethyl)-N,N',N'-triacetic acid
1,2-Diaminopropanetetraacetic acid
Triethylenetetraminehexaacetic acid
Propylenediaminetetraacetic acid
Nitrilotriacetic acid
Nitrilotripropionic acid
Cyclohexanediaminetetraacetic acid
1,3-Diamino-2-propanoltetraacetic acid
Methyliminodiacetic acid
Iminodiacetic acid
Hydroxyliminodiacetic acid
Dihydroxyethylglycine ethyl ether diaminetetraacetic acid
Glycol ether diaminetetraacetic acid
Ethylenediaminetetrapropionic acid
Ethylenediaminedipropionic acid
Phenylenediaminetetraacetic acid
2-Phosphonobutane-1,2,4-triacetic acid
1,3-Diaminopropanol-N,N,N',N'-tetramethylenephosphonic acid
Ethylenediamine-N,N,N',N'-tetramethylenephosphonic acid
1,3-Propylenediamine-N,N,N',N'-tetramethylenephosphonic acid
1-Hydroxyethylidene-1,1'-diphosphonic acid.

These compounds may be in the forms of sodium salts, potassium salts, lithium salts, or ammonium salts. In the aforesaid compounds, the iron(III) complex salts of ethylenediaminetetraacetic acid, diethylenetriaminepentaacetic acid, cyclohexanediaminetetraacetic acid, 1,3-diaminopropanetetraacetic acid, or methyliminodiacetic acid are preferred because of their high bleaching power.

As the iron(III) complex salt(s), one or more complex salts already formed or ferric ion complex salt(s) formed by reacting iron(III) salt(s) (e.g., ferric sulfate, ferric chloride, ferric nitrate, ferric ammonium sulfate, ferric phosphate, etc.) and a chelating agent (e.g., aminopolycarboxylic acid, aminopolyphosphonic acid, phosphonocarboxylic acid, etc.) in a solution may be used. In the case of forming the complex salt in a solution, two or more kinds of ferric salts or chelating agents may be used. In both of the complex salt already formed and the complex salt formed in a solution, a stoichiometric amount or more of a chelating agent may be used.

Also, the bleach or bleach fix containing the above-described ferric ion complex salt(s) may further contain ions of metals other than iron, such as cobalt, copper, etc. or complex salts thereof, or hydrogen peroxide.

The persulfate for use in the bleach or bleach fix processing of the present invention includes an alkali metal persulfate such as potassium persulfate, sodium persulfate, etc., or ammonium persulfate.

Furthermore, the bleach or bleach fix may contain a rehalogenating agent such as a bromide (e.g., potassium bromide, sodium bromide, ammonium bromide, etc.), a chloride (e.g., potassium chloride, sodium chloride, ammonium chloride, etc.), or an iodide (e.g., ammonium iodide, etc.). Also, if desired, the bleach or bleach fix may further contain a corrosion inhibitor, etc., for example, inorganic acids or organic acids having a pH buffer faculty, or alkali metal salts or ammonium salts thereof, such as boric acid, borax, sodium metaborate, acetic acid, sodium acetate, sodium carbonate, potassium carbonate, phosphorus acid, phosphoric acid, sodium phosphate, citric acid, sodium citrate, tartaric acid, or ammonium nitrate, guanidine, etc.

A proper amount of the bleaching agent is from 0.1 to 2 mols per liter of the bleach and a preferred pH range of the bleach is from 0.5 to 8.0 in the case of ferric ion complex salts, in particular from 4.0 to 7.0 in the case of ferric ion complex salts of aminopolycarboxylic acid, aminopolyphosphonic acid, phosphonocarboxylic acid, or organic phosphonic acid. In the case of using a persulfate, the concentration thereof is 0.1 to 2 mols/liter and the pH range is from 1 to 5.

As a fixing agent for the fix or the bleach fix which is used in this invention, known fixing agents can be used. That is, water-soluble silver halide solvents, e.g., thiosulfates such as sodium thiosulfate, ammonium thiosulfate, etc.; thiocyanates such as sodium thiocyanate, ammonium thiocyanate, etc.; thioether compounds such as ethylenebisthioglycolic acid, 3,6-dithia-1,8-octanediol, etc.; thioureas, etc., can be used as the fixing agent. They may be used solely or as a mixture thereof. Furthermore, for bleach fix processing, a specific bleach fix containing a combination of a fixing agent and a large amount of a halogen compound such as potassium iodide described in Japanese patent application (OPI) No. 155354/80 can be used.

In the case of the fix or bleach fix processing, the concentration of the fixing agent is preferably from 0.2 to 4 mols/liter. Also, in the bleach fix processing it is preferred that the concentration of the ferric ion complex salt is from 0.1 to 2 mols and that of the fixing agent is from 0.2 to 4 mols per liter of the bleach fix. Furthermore, the pH of the fix or bleach fix is usually from 4.0 to 9.0, preferably from 5.0 to 8.0.

The fix or bleach fix may further contain a preservative such as sulfites (e.g., sodium sulfite, potassium sulfite, ammonium sulfite, etc.), hydrogensulfites, hydroxylamine, hydrazine, hydrogensulfite addition products of aldehyde compounds (e.g., acetaldehyde-sodium hydrogensulfite addition product), etc. in addition to the above-described additives. Furthermore, the fix or bleach fix may further contain a fluorescent whitening agent, a defoaming agent, a surface active agent, and an organic solvent such as polyvinylpyrrolidone, methanol, etc.

For the bleach, bleach fix, or the pre-bath thereof, a bleach accelerator may be, if desired, used. Specific examples of useful bleach accelerators are compounds having a mercapto group or a disulfido group described in U.S. Pat. No. 3,893,858, West German Patents 1,290,812 and 2,059,988, Japanese Patent Application (OPI) Nos. 32736/78, 57831/78, 37481/78, 65732/78, 72623/78, 95630/78, 95631/78, 104232/78, 124424/78, 141623/78, and 28426/78, Research Disclosure, RD No. 17129 (July 1978), etc.; thiazolidine derivatives described in Japanese Patent Application (OPI) No. 140129/75; thioureas described in Japanese Patent Publication No. 8506/70, Japanese Patent Application (OPI)Nos. 20832/77 and 32735/78, and U.S. Pat. No. 3,706,561; iodides described in West German Patent 1,127,715, and Japanese Patent Application (OPI) No. 16235/83; polyethylene oxides described in West German Patents 860,410 and 2,748,430; polyamine compounds described in Japanese Patent Publication No. 8836/70; and compounds described in Japanese Patent Application (OPI) Nos. 42434/74, 59644/74, 94927/78, 35727/79, 26506/80, and 163940/83, as well as iodide ions and bromide ions. In these compounds, the compounds having a mercapto group or a disulfido group are preferred from the viewpoint of high acceleration effect. The compounds described in U.S. Pat. 3,893,858, West German Patent 1,290,812, and Japanese Patent Application (OPI) No. 95630/78 are particularly preferred.

After the fix step or bleach fix step, the water washing step according to this invention as described hereinbefore is performed.

Also, in the case of continuous processing, a constant finish is obtained by using each replenisher for the respective processing liquids. The amount of the replenisher can be reduced to a half or lower of a standard amount of the replenisher for reducing the processing cost.

Each tank may be, if desired, equipped with a heater, a temperature sensor, a liquid sensor, a circulating pump, a filter, a floating lid, various squeezers, a nitrogen agitator, an air agitator, etc.

The invention is explained in more detail by the following examples.

EXAMPLE 1

After imagewise exposing a color photographic paper, Fuji Color Paper Type 12 (made by Fuji Photo Film Co., Ltd.), the color photographic paper was continuously processed using Fuji Color Roll Processor FPRP 115 (made by Fuji Photo Film Co., Ltd.) by the following processing steps. In the processor, the processing time for water washing step was variable.

| | Time | Temperature | Tank Volume |
|---|---|---|---|
| Color Development | 3'30" | 38° C. ± 0.3° C. | 60 liters |
| Blix | 1'30" | 33° C. ± 1° C. | 40 liters |
| Wash (1) | 1'00" | 30° C. ± 3° C. | 20 liters |
| Wash (2) | 1'00" | 30° C. ± 3° C. | 20 liters |
| Wash (3) | 1'00" | 30° C. ± 3° C. | 20 liters |

The water washing step was a three-stage countercurrent water washing system from Wash (3) to Wash (1).

Also, the amount of each processing liquid carried over from each pre-bath in the steps from the bleach fix step to Wash (3) was 40 ml/m$^3$. The amount of the replenisher for the color development step was 161 ml per square meter of the color photographic paper. The composition of the processing liquid was as follows.

| Color Developer | Tank Liquid | Replenisher |
|---|---|---|
| Water | 800 ml | 800 ml |
| Nitrilotriacetic Acid.3Na | 2.0 g | 2.0 g |
| Benzyl Alcohol | 14 ml | 18 ml |
| Diethylene Glycol | 10 ml | 10 ml |
| Sodium Sulfite | 2.0 g | 2.5 g |
| Hydroxylamine Sulfate | 3.0 g | 3.5 g |
| Potassium Bromide | 1.0 g | — |
| Sodium Carbonate | 30 g | 35 g |
| N-Ethyl-N-(β-methanesulfonamidoethyl)-3-methyl-4-aminoaniline Sulfate | 5.0 g | 8.0 g |
| Water to make | 1000 ml | 1000 ml |
| pH | 10.15 | 10.65 |

The amount of the replenisher for the bleach fix step was 60 ml per square meter of the color photographic paper and the composition of the processing liquid used was as follows.

| Bleach Fix | Tank Liquid | Replenisher |
|---|---|---|
| Water | 400 ml | 400 ml |
| Ammonium Thiosulfate (70% solution) | 150 ml | 300 ml |
| Sodium Sulfite | 18 g | 36 g |
| Ethylenediaminetetraacetic Acid Iron (III) Ammonium | 55 g | 110 g |
| Ethylenediaminetetraacetic Acid 2Na | 5 g | 10 g |
| Water to make | 1000 ml | 1000 ml |
| pH | 6.70 | 6.50 |

The amount of the replenisher for the water washing step was 10 liters per square meter of the color photographic paper.

The photographic processing was continuously performed for 90 days with respectto the above-described color photographic paper of 8.25 cm in width per 180 meters a day. Thereafter, various color photographic materials were prepared as described hereinbelow and processed in the unexposed state by the above-described processor using the processing liquids described above for the water washing time as shown in Table 1 below.

A multilayer silver halide color photographic material was prepared by forming Layer 1 (the lowermost layer) to Layer 7 (the uppermost layer) on a paper support laminated with polyethylene on both sides thereof.

| | |
|---|---|
| Layer 1: Blue-Sensitive Emulsion Layer | |
| Silver Chlorobromide Emulsion (Br 80 mol %) | 0.40 g/m$^2$ as Ag |
| Yellow Coupler Y-1 | 0.60 g/m$^2$ |
| Yellow Coupler Solvent (Dibutyl Phthalate) | 1.00 g/m$^2$ |
| Fading Preventing Agent F-3 | 0.10 g/m$^2$ |
| Layer 2: Interlayer | |
| Gelatin | 1.50 g/m$^2$ |
| Layer 3: Green-Sensitive Emulsion Layer | |
| Silver Chlorobromide Emulsion (Br 70 mol %) | 0.22 g/m$^2$ as Ag* |
| Magenta Coupler (See Table 1) | 0.35 g/m$^2$ |
| Magenta Coupler Solvent (Tri-n-octyl Phosphate) | 0.44 g/m$^2$ |
| Fading Preventing Agent F-1 | 0.050 g/m$^2$ |
| Fading Preventing Agent F-2 | 0.100 g/m$^2$ |
| Layer 4: Ultraviolet Light Absorptive Layer | |
| Gelatin | 2.00 g/m$^2$ |
| Ultraviolet Light Absorbent UV-1 | 0.015 g/m$^2$ |
| Ultraviolet Light Absorbent UV-2 | 0.045 g/m$^2$ |
| Ultraviolet Light Absorbent UV-3 | 0.090 g/m$^2$ |
| Solvent (Dibutyl Phthalate) | 0.060 g/m$^2$ |
| Layer 5: Red-Sensitive Emulsion Layer | |
| Silver Chlorobromide Emulsion (Br 50 mol %) | 0.300 g/m$^2$ as Ag |
| Cyan Coupler C-1 | 0.200 g/m$^2$ |
| Cyan Coupler C-2 | 0.200 g/m$^2$ |
| Cyan Coupler Solvent (Dibutyl Phthalate) | 0.240 g/m$^2$ |
| Ultraviolet Light Absorbent UV-1 | 0.020 g/m$^2$ |
| Ultraviolet Light Absorbent UV-2 | 0.050 g/m$^2$ |
| Ultraviolet Light Absorbent UV-3 | 0.060 g/m$^2$ |
| Layer 6: Ultraviolet Light Absorptive Layer | |
| Gelatin | 1.50 g/m$^2$ |
| Ultraviolet Light Absorbent UV-1 | 0.050 g/m$^2$ |
| Ultraviolet Light Absorbent UV-2 | 0.150 g/m$^2$ |
| Ultraviolet Light Absorbent UV-3 | 0.300 g/m$^2$ |
| Solvent (Dibutyl Phthalate) | 0.200 g/m$^2$ |
| Layer 7: Protective Layer | |
| Gelatin | 1.50 g/m$^2$ |

The coating composition for Layer 1 described above was prepared as follows.

That is, 100 g of the yellow coupler shown in Table 1 below was dissolved in a mixed solution of 166.7 ml of dibutyl phthalate (DBP) and 200 ml of ethyl acetate, the solution thus obtained was dispersed by emulsification in 800 ml of an aqueous 10% gelatin solution containing 80 ml of an aqueous 1% sodium dodecylbenzenesulfonate solution, and the emulsified dispersion was mixed with 1450 g (containing 66.7 g of silver) of the blue-sensitive silver chlorobromide emulsion (Br 80%) to provide the coating composition.

The coating compositions for other layers were also prepared by the similar manners. Each layer further contained 2,4-dichloro-6-hydroxy-s-triazine sodium salt as a hardening agent. In this case, the amount of the hardening agent was controlled so that the swelling degree became as shown in Table 1 for each color photographic material.

Also, the following spectral sensitizer was used for each emulsion layer.

Blue-Sensitive Emulsion Layer: 3,3'-Di-(γ-sulfopropyl)-selenacyanine Sodium Salt ($2\times10^{-4}$ mol per mol of silver halide)

Green-Sensitive Emulsion Layer: 3,3'-Di-(γ-sulfopropyl)-5,5'-diphenyl-9-ethyloxacarbocyanine Sodium Salt ($2.5\times10^{-4}$ mol per mol of silver halide)

Red-Sensitive Emulsion Layer: 3,3'-Di-(γ-sulfopropyl)-9-methylthiadicarbocyanine Sodium Salt (b $2.5\times10^{-4}$ mol per mol of silver halide)

As the irradiation preventing dyes for the aforesaid emulsions layers, the following dyes were used.

Green-Sensitive Emulsion Layer:

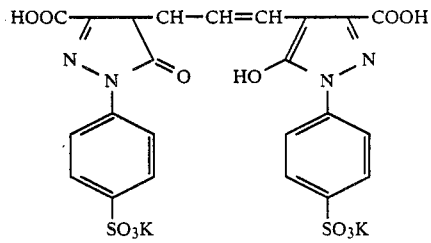

Red-Sensitive Emulsion Layer:

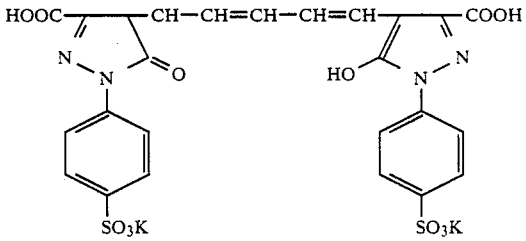

The chemical structures of the compounds used for preparing the aforesaid samples were as follows.

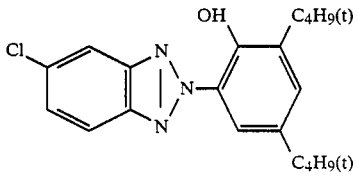

UV-1

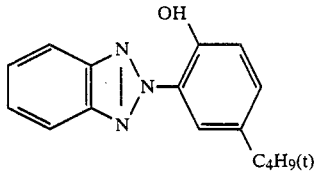

UV-2

-continued
UV-3
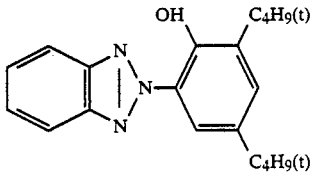
F-1
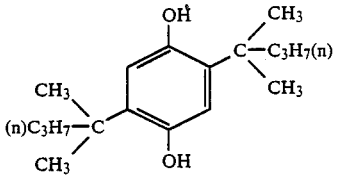
F-2
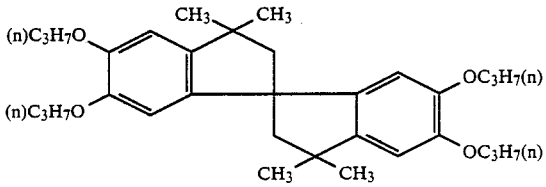
F-3
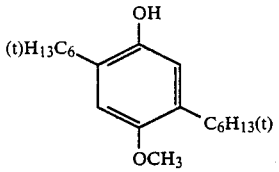
C-1
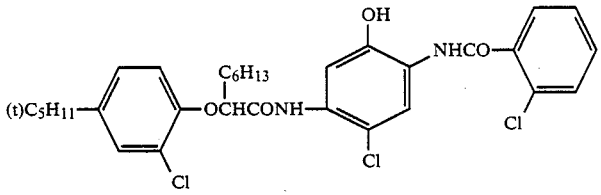
C-2
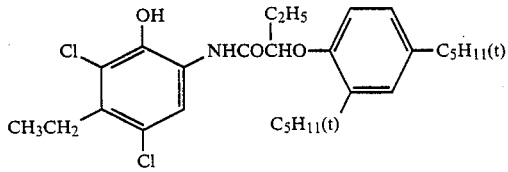
Y-1
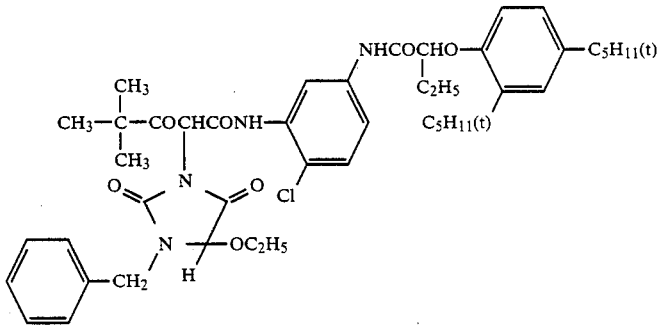
The structure of Magenta Coupler (a) used above was as follows.
Magenta Coupler (a)
-continued
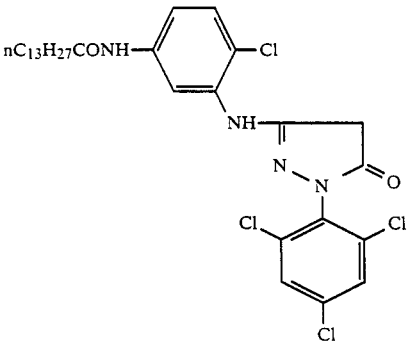

(*): In addition, when Magenta Coupler (a) was used for Layer 3 described above, the silver amount in the green-sensitive emulsion layer was 0.44 g/m².

The yellow stain density of each sample directly after processing and after allowing to stand for 8 weeks at 60° C. and 70% RH (relative humidity) are shown in Table 1 below.

TABLE 1

| Sample No.* | Light-Sensitive Material: Magenta Coupler | Light-Sensitive Material: Swelling Degree | Total Water Washing Time** (sec) | Yellow Stain Density: Directly After Processing | Yellow Stain Density: After Passing Time*** |
|---|---|---|---|---|---|
| 1R | (a) | 1.1 | 15 | 0.19 | 0.51 |
| 2R | " | " | 30 | 0.17 | 0.45 |
| 3R | " | " | 60 | 0.15 | 0.41 |
| 4R | " | " | 90 | 0.14 | 0.35 |
| 5R | " | " | 120 | 0.08 | 0.21 |
| 6 | " | 1.5 | 30 | 0.08 | 0.20 |
| 7 | " | " | 60 | 0.07 | 0.18 |
| 8 | " | " | 90 | 0.07 | 0.17 |
| 9R | " | 2.5 | 15 | 0.15 | 0.41 |
| 10 | " | " | 30 | 0.07 | 0.18 |
| 11 | " | " | 60 | 0.07 | 0.18 |
| 12 | " | " | 90 | 0.07 | 0.18 |
| 13R | " | " | 120 | 0.07 | 0.17 |
| 14 | " | 4.0 | 30 | 0.07 | 0.17 |
| 15 | " | " | 60 | 0.07 | 0.17 |
| 16 | " | " | 90 | 0.07 | 0.17 |
| 17R | " | 5.0 | 15 | 0.15 | 0.26 |
| 18R | " | " | 30 | 0.14 | 0.23 |
| 19R | " | " | 60 | 0.13 | 0.21 |
| 20R | " | " | 90 | 0.11 | 0.20 |
| 21R | " | " | 120 | 0.07 | 0.19 |
| 22R | M-5 | 1.1 | 60 | 0.13 | 0.17 |
| 23 | " | 1.5 | " | 0.07 | 0.11 |
| 24 | " | 2.5 | " | 0.07 | 0.11 |
| 25 | " | 4.0 | " | 0.07 | 0.11 |
| 26R | " | 5.0 | " | 0.10 | 0.13 |
| 27R | m-11 | 1.1 | " | 0.13 | 0.18 |
| 28 | " | 1.5 | " | 0.07 | 0.11 |
| 29 | " | 2.5 | " | 0.06 | 0.11 |
| 30 | " | 4.5 | " | 0.07 | 0.11 |
| 31R | " | 5.0 | " | 0.10 | 0.14 |

*R shows a comparative sample.
**When the total water washing time was shorter than 60 seconds, Wash (3) was used, and when longer than 90 seconds, Washes (2) or (3) was used.
***After allowing to stand for 8 weeks at 60° C., 70% RH.

From the results shown in Table 1, it can be seen that in the case that the water washing time is shorter than 90 seconds, when the swelling degree is less than the range defined in this invention (Sample Nos. 1 to 4, 22, and 27), the formation of yellow stain directly after processing and after allowing to stand for 8 weeks becomes high, and when the swelling degree is higher than the range of this invention (Sample Nos. 17 to 20, 26 and 31), the yellow stain density is similarly high. Furthermore, when the water washing time is shorter than that defined in this invention, the yellow stain density directly after processing and after allowing to stand for 8 weeks is high even when the swelling degree is in the range of this invention (Sample Nos. 9 and 17).

As described above, it can be seen that the increase of yellow stain directly after processing and after lapsing a time in the case of shortening the water washing time to 30 to 90 seconds can be solved by using a color photographic material having a swelling degreein the range as defined in this invention.

Furthermore, it can be seen that when Magenta Couplers M-5 and m-11 which are described to be preferred in this specification (Sample Nos. 23 to 25 and 28 to 31), the increase of yellow stain after lapsing a time is less than that in the case of using Magenta Coupler (a) and, hence, the use of Magenta Couplers M-5 and m-11 is more preferable.

EXAMPLE 2

The same continuous processing as in Example 1 except that the water washing step was performed as shown below was performed. The amount of the replenisher after water washing was 300 ml per square meter of the color photographic material and the water washing time was 20 seconds for each of Washes (1), (2), and (3), the total time being 60 seconds. The water washing temperature was 30° C.±3° C. The composition of the wash liquid is shown below.

| Wash Liquid | |
|---|---|
| Water | 950 ml |
| Benzotriazole | 1.5 g |
| 1-Hydroxyethylidene-1,1-diphosphonic Acid | 2.0 g |
| Ammonium Alum | 1.0 g |
| pH adjusted to 7.0 with aqueous ammonia | |
| Water to make | 1000 ml |

Using the processing liquids after processing the color photographic paper of 8.25 cm in width as used in Example 1 for 90 days per 180 meters a day, the samples prepared as in Example 1 were processed. Then, as in Example 1, the yellow stain density of each sample directly after processing and after allowing to stand for 8 weeks at 60° C. and 70% RH were measured. The results are shown in Table 2 below.

TABLE 2

| Sample No.* | Light-Sensitive Material: Magenta Coupler | Light-Sensitive Material: Swelling Degree | Total Water Washing Time** (sec) | Yellow Stain Density: Directly After Processing | Yellow Stain Density: After Passing Time |
|---|---|---|---|---|---|
| 32 R | (a) | 1.1 | 60 | 0.18 | 0.58 |
| 33 | " | 1.5 | " | 0.07 | 0.19 |
| 34 | " | 2.5 | " | 0.07 | 0.18 |
| 35 | " | 4.0 | " | 0.07 | 0.17 |
| 36 R | " | 5.0 | " | 0.15 | 0.20 |
| 37 R | M-5 | 1.1 | " | 0.14 | 0.25 |
| 38 | " | 1.5 | " | 0.07 | 0.12 |
| 39 | " | 2.5 | " | 0.07 | 0.11 |
| 40 | " | 4.0 | " | 0.07 | 0.11 |
| 41 R | " | 5.0 | " | 0.09 | 0.19 |
| 42 R | m-11 | 1.1 | " | 0.15 | 0.24 |
| 43 | " | 1.5 | " | 0.07 | 0.17 |
| 44 | " | 2.0 | " | 0.07 | 0.12 |
| 45 | " | 4.0 | " | 0.07 | 0.11 |
| 46 R | " | 5.0 | " | 0.10 | 0.15 |

*R shows a comparative sample.
**The sum of processing times in Washes (1) to (3) each for 20 seconds.

From the results shown in Table 2, it can be seen that even in the processing wherein the amount of the replenisher for the water washing step is greatly reduced, the yellow stain density directly after processing and after allowing to stand for 8 weeks is low in the case of using a color photographic material having a swelling degree in the range as defined in this invention.

On the other hand, it can be also seen that when the swelling degree of color photographic material is higher or lower than the range (1.5 to 4.0) of this invention (Sample Nos. 32, 36, 37, 41, 42, and 46), the yellow stain density is high. Though the invention is effective when the amount of the replenisher for the water washing step is large, it is particularly effective in the case of water saving process of reducing the amount of the replenisher for the water washing step.

EXAMPLE 3

A multilayer color photographic paper having the layer structure shown below was formed on a paper support laminated with polyethylene on both sides thereof. The polyethylene laminate in the side of Layer 1 contained a white pigment ($TiO_2$) and a bluish dye (ultramarine).

| | |
|---|---|
| Layer 1: Blue-Sensitive Emulsion Layer | |
| Silver Chlorobromide Emulsion (See Table A) | 0.30 g/m$^2$ as Ag |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 cc/m$^2$ |
| Layer 2: Color Mixing Preventing Layer | |
| Gelatin | 0.99 g/m$^2$ |
| Color Mixing Preventing Agent (d) | 0.08 g/m$^2$ |
| Layer 3: Green-Sensitive Emulsion Layer | |
| Silver Chlorobromide Emulsion (See Table A) | 0.16 g/m$^2$ as Ag |
| Gelatin | 1.80 g/m$^2$ |
| Magenta Coupler (e) | 0.34 g/m$^2$ |
| Color Image Stabilizer (f) | 0.20 g/m$^2$ |
| Solvent (g) | 0.68 g/m$^2$ |
| Layer 4: Ultraviolet Light Absorptive Layer | |
| Gelatin | 1.60 g/m$^2$ |
| Ultraviolet Light Absorbent (h) | 0.62 g/m$^2$ |
| Color Mixing Preventing Agent (i) | 0.05 g/m$^2$ |
| Solvent (j) | 0.26 cc/m$^2$ |
| Layer 5: Red-Sensitive Emulsion Layer | |
| Silver Chlorobromide Emulsion (See Table A) | 0.26 g/m$^2$ as Ag |
| Gelatin | 0.98 g/m$^2$ |
| Cyan Coupler (k) | 0.38 g/m$^2$ |
| Color Image Stabilizer (l) | 0.17 g/m$^2$ |
| Solvent (m) | 0.23 cc/m$^2$ |
| Layer 6: Ultraviolet Light Absorptive Layer | |
| Gelatin | 0.54 g/m$^2$ |
| Ultraviolet Light Absorbent (h) | 0.21 g/m$^2$ |
| Solvent (j) | 0.09 cc/m$^2$ |
| Layer 7: Protective Layer | |
| Gelatin | 1.33 g/m$^2$ |
| Acrylic-modified Copolymer (modification degree of 17%) of Polyvinyl Alcohol | 0.17 g/m$^2$ |

The silver halide emulsions used above were shown in following Table A.

TABLE A

| Layer | Composition of Emulsion | Form of Emulsion | Mean Grain Size |
|---|---|---|---|
| Blue-Sensitive Emulsion | AgBr: 4 mol % | Cube | 0.95 μm |
| Green-Sensitive Emulsion | AgBr: 10 mol % | Cube | 0.45 μm |
| Red-Sensitive Emulsion | AgBr: 10 mol % | Cube | 0.45 μm |

The coating compositions for the above-described layers were prepared as follows.

Preparation of the coating composition for Layer 1:

To 19.1 g of Yellow Coupler (a) and 4.4 g of Color Image Stabilizer (b) were added 27.2 ml of ethyl acetate and 7.9 ml of Solvent (c), followed by dissolving the components and the solution thus obtained was dispersed by emulsification in 185 ml of an aqueous 10% gelatin solution containing 8 ml of an aqueous 10% sodium dodecylbenzenesulfonate. Separately, 90 g of a blue-sensitive emulsion was prepared by adding a blue-sensitive sensitizing dye shown below to a silver chlorobromide emulsion (silver bromide: 80 mol%, Ag: 70 g/kg) in an amount of $7.0\times10^{-4}$ mol per mol of silver chlorobromide. The aforesaid emulsified dispersion was mixed with the aforesaid blue-sensitive emulsion and then the gelatin concentration was controlled so that the mixture became the composition as described above about Layer 1 to provide the coating composition for Layer 1.

The coating compositions for Layer 2 to Layer 7 were prepared by the similar manner. Each layer also contained 1-oxy-3,5-dichloro-s-triazine sodium salt as a gelatin hardening agent.

The spectral sensitizers for the emulsion layers were as follows.

Blue-Sensitive Emulsion Layer:

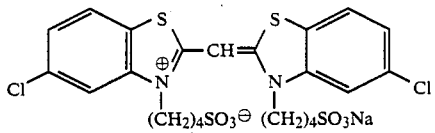

(added $5.0\times10^{-4}$ per mol of silver halide).

Green-Sensitive Emulsion Layer:

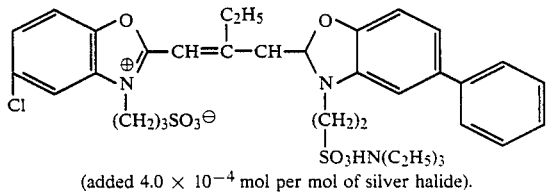

(added $4.0\times10^{-4}$ mol per mol of silver halide).

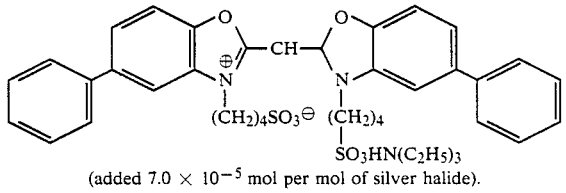

(added $7.0\times10^{-5}$ mol per mol of silver halide).

Red-Sensitive Emulsion Layer:

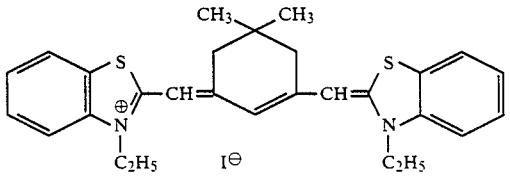

(added $1.0\times10^{-4}$ mol per mol of silver halide).

The irradiation preventing dyes for the emulsion layers used in this example were as follows.

Green-Sensitive Emulsion Layer:

-continued
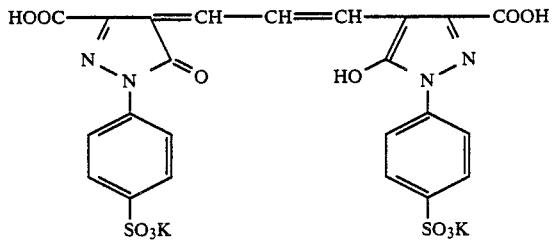
Red-Sensitive Emulsion Layer:
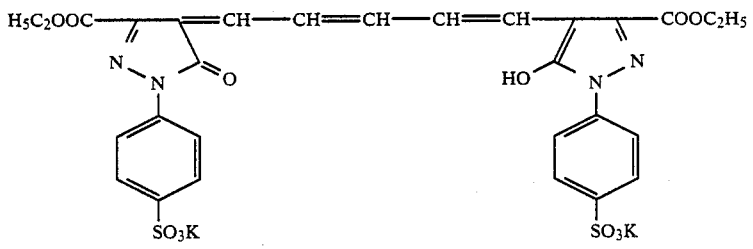
The couplers and other compounds used in this example were as follows.
Yellow Coupler (a)
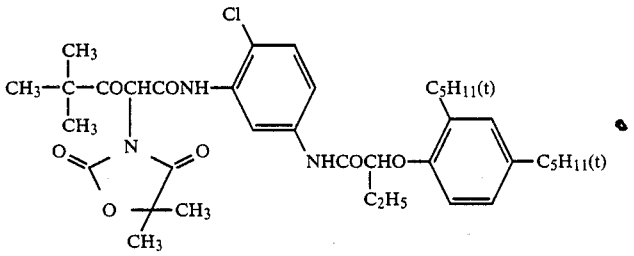
Color Image Stabilizer (b)
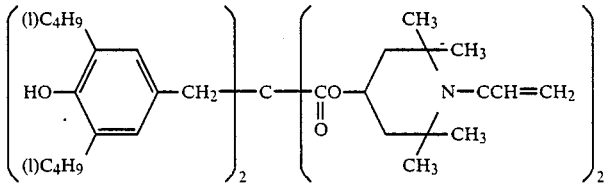
Solvent (c)
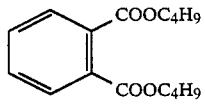
Solvent (d)
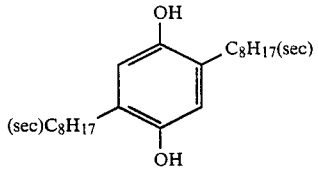
Magenta Coupler (e)
M-6
Color Image Stabilizer (f)

-continued
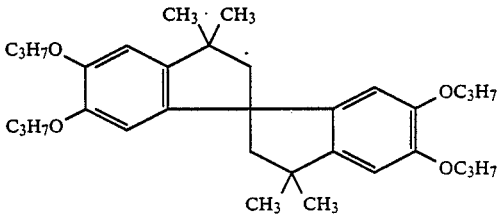
Solvent (g)
2:1 mixture (by weight) of
$(C_8H_{17}O)_3P{=}O$ and (
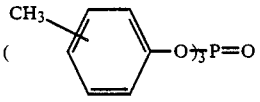
Ultraviolet Avsorbent (h)
1:5:3 mixture (by mol) of
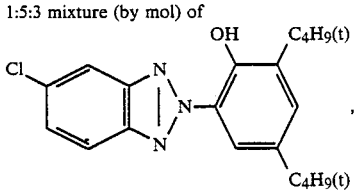
,
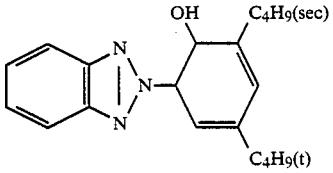
and
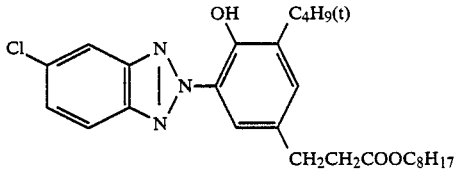
Color Mixing Preventing Agent (i)
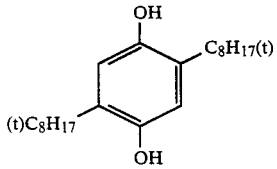
Solvent (j)
(iso $C_9H_{18}O)_3P{=}O$
Cyan Coupler (k)
1:1 mixture (by mol) of
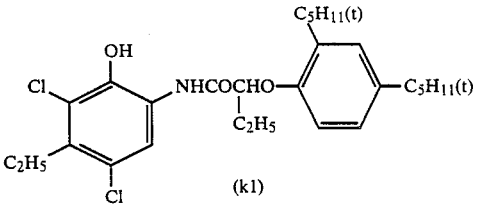
and
(k1)
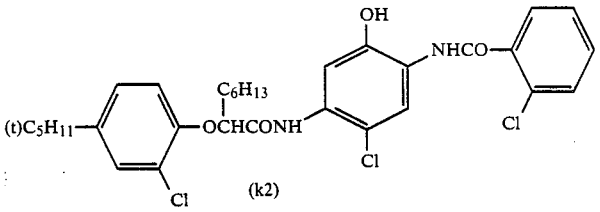
(k2)
Color Image Stabilizer (e)
1:3:3 mixture (by mol) of -continued

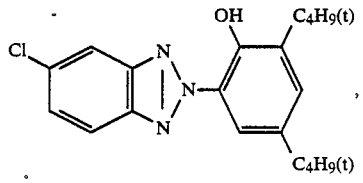

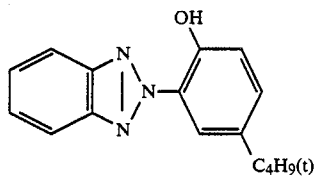

and

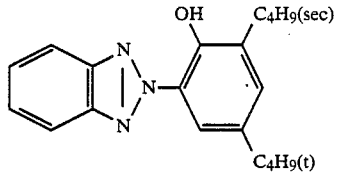

Solvent (m)

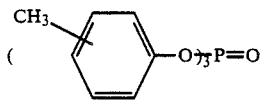

After imagewise exposing each of the color photographic papers, each sample was processed by means of improved Fuji Color Paper Processor PP-600 under the following processing steps. The photographic processing was performed under each condition until the replenisher was replenished in an amount of three times the volume of the color development tank.

The amount of each processing liquid carried over by the color photographic paper was 35 ml per square meter of the color paper.

| Processing Step | Time | Temperature |
|---|---|---|
| Color Development | 45 sec. | 35° C. |
| Bleach Fix | 45 sec. | 35° C. |
| Rinse (1) | 20 sec. | 35° C. |
| Rinse (2) | 20 sec. | 35° C. |
| Rinse (3) | 20 sec. | 35° C. |
| Drying | 50 sec. | 80° C. |
| (The rinse liquid was used as a 3 tank countercurrent system of Rinses (3) → (2) → (1).) | | |

The compositions of the processing liquids used in this example were as follows.

| Color Developer | Tank Liquid | Replenisher |
|---|---|---|
| Water | 800 ml | 800 ml |
| 1-Hydroxyethylidene-1,1-diphosphonic Acid (60% solution) | 1.5 ml | 1.5 ml |
| Lithium Chloride | 1.0 g | 1.0 g |
| Diethylenetriaminetetraacetic Acid | 1.0 g | 1.0 g |
| 4,5-Dihydroxy-m-benzenedisulfonic Acid | 1.0 g | 1.0 g |
| Sodium Sulfite | 0.5 g | 1.0 g |
| Potassium Bromide | 0.1 g | — |
| Sodium Chloride | 1.5 g | — |
| Adenine | 30 mg | 30 mg |
| Potassium Carbonate | 40 g | 40 g |
| N-Ethyl-N-(β-mehanesulfonamidoethyl)-3-methyl-4-aminoaniline Sulfate | 4.5 g | 8.0 g |
| Hydroxylamine Sulfate | 3.0 g | 4.0 g |
| Fluorescent Whitening Agent, Whitex ® 4* | 1.0 g | 2.0 g |
| Poly(ethyleneimine) (50% aqueous solution) | 3.0 g | 3.0 g |
| Water to make | 1000 ml | 1000 ml |
| pH adjusted by KOH | 10.25 | 10.80 |
| Bleach Fix | | |

-continued

| | | |
|---|---|---|
| Water | 400 ml | 400 ml |
| Ammonium Thiosulfate (70%) | 150 ml | 300 ml |
| Sodium Sulfite | 15 g | 15 g |
| Ethylenediaminetetraacetic Acid Iron (III) Ammonium | 55 g | 110 g |
| Ethylenediaminetetraacetic Acid | 5 g | 10 g |
| 2-Mercapto-5-amino-3,4-thiadiazole | 1 g | 1 g |
| Water to make | 1000 ml | 1000 ml |
| pH | 7.0 | 6.5 |
| Rinse Liquid (Tank Liquid and replenisher had the same composition) | | |
| 1-Hydroxyethylidene-1,1-diphosphonic Acid (60%) | | 1.5 ml |
| Nitrilotriacetic Acid | | 1.0 g |
| Nitrilo-N,N,N-trimethylenephosphonic Acid | | 1.0 g |
| Ethylenediaminetetraacetic Acid | | 0.5 g |
| Ethylenediamine-N,N,N',N'-tetramethylenephosphonic Acid | | 1.0 g |
| $BiCl_3$ (aqueous 40% solution) | | 0.50 g |
| $MgSO_4.7H_2O$ | | 0.20 g |
| $ZnSO_4$ | | 0.3 g |
| Ammonium Alum | | 0.5 g |
| 5-Chloro-2-methyl-4-isothiazolin-3-one | | 30 mg |
| 2-Methyl-4-isothiazolin-3-one | | 10 mg |
| 2-Octyl-4-isothiazolin-3-one | | 10 mg |
| Ethylene Glycol | | 1.5 g |
| Sulfanylamide | | 0.1 g |
| 1,2,3-Benzotriazole | | 1.0 g. |
| Ammonium Sulfite (aq. 40% solution) | | 1.0 g |
| Aqueous Ammonia (26%) | | 2.6 ml |
| Polyvinylpyrrolidone | | 1.0 g |
| Fluorescent Whitening Agent (4,4'-Diaminostilbene series) | | 1.0 g |
| Water to make | | 1000 ml |
| pH adjusted to KOH | | 7.0 |

*Trade name, made by Sumitomo Chemical Company, Limited.

In this case, the amount of the replenisher for each processing liquid was as follows.

| | | |
|---|---|---|
| Color Developer: | 160 ml/m$^2$ | |
| Bleach Fix: | 100 ml/m$^2$ | |
| Rinse Liquid (1) | 10 ml/m$^2$ | (0.29 time the carried-over amount) |
| Rinse Liquid (2) | 200 ml/m$^2$ | (6.9 times the carried-over amount) |
| Rinse Liquid (3) | 2100 ml/m$^2$ | (60 times the carried-over |

-continued

| amount) |
|---|

(Rinse was practiced under 3 conditions)

By following the same procedure as the case of preparing color photographic papers in Example 1, color photographic papers containing the magenta couplers and having the swelling degrees as shown in Table 3 below were prepared. After wedge exposing each sample, the sample was processed under the processing condition (changing the rinsing time and the amount of the rinse replenisher) shown in Table 3 below.

In addition, the swelling degree of each level was obtained by changing the condition for allowing to stand of each color photographic paper after coating.

The condition therefor is generally as follows.

| Swelling Degree | Condition |
|---|---|
| 1.0 | 80° C., 20 hours |
| 1.5 | 60° C., 20 hours |
| 2.5 | 40° C., 16 hours |
| 3.5 | 30° C., 16 hours |
| 4.5 | 25° C., 16 hours |

About each sample thus processed, the yellow stain density after allowing to stand for 10 days at 80° C. and 70% RH, the magenta stain density after allowing to stand for 4 weeks at 80° C., and the fading ratio ($D_G$=2.0) of the magenta density after irradiating with a xenon light (85,000 lux, distance 50 cm) for 12 days were measured, and the results obtained are shown in Table 3.

The magenta couplers used were as follows.

Magenta Coupler (b)

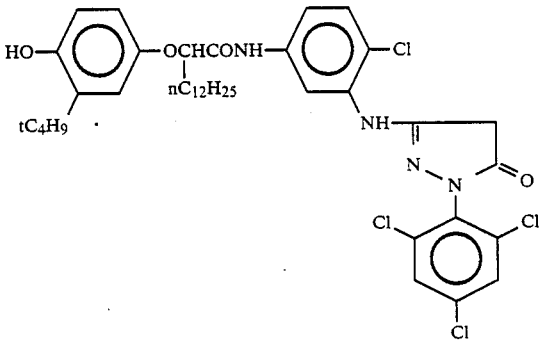

(silver amount: 0.32 g/m$^2$)

Magenta Coupler (c)

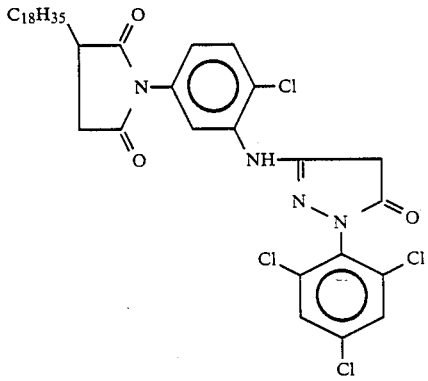

(silver amount: 0.32 g/m$^2$)

Magenta Coupler (d)

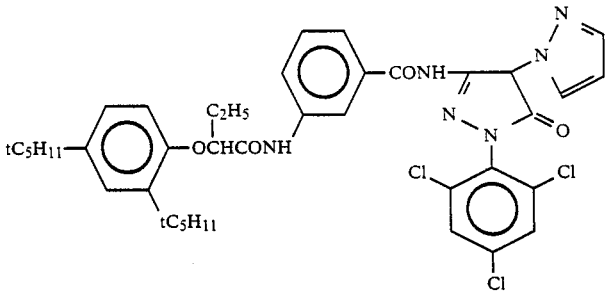

(silver amount: 0.16 mg/m$^2$)

TABLE 3

| Sample No.* | Light-Sensitive Material: Magenta Coupler | Light-Sensitive Material: Swelling Degree | Total Rinse Time (sec) | Replenisher Amount for Rinse (to Carried-over amount) | Yellow Stain | Magenta Stain | Magenta Light-Fading Ratio (%) |
|---|---|---|---|---|---|---|---|
| 47R | (b) | 1.0 | 80 | 6.9 | 0.45 | 0.23 | 38 |
| 48 | " | 1.5 | 80 | 6.9 | 0.21 | 0.16 | 39 |
| 49 | " | 2.5 | 80 | 6.9 | 0.19 | 0.14 | 40 |
| 50 | " | 3.5 | 80 | 6.9 | 0.19 | 0.14 | 42 |
| 51R | " | 4.5 | 80 | 6.9 | 0.39 | 0.18 | 45 |
| 52R | " | 2.5 | 80 | 0.29 | 0.39 | 0.27 | 38 |
| 53 | " | 2.5 | 80 | 60 | 0.19 | 0.14 | 45 |
| 54R | " | 2.5 | 80 | 6.9 | 0.42 | 0.21 | 38 |
| 55R | (c) | 1.0 | 80 | 6.9 | 0.41 | 0.21 | 40 |
| 56 | " | 2.5 | 80 | 6.9 | 0.17 | 0.12 | 42 |
| 57R | (d) | 2.5 | 80 | 6.9 | 0.39 | 0.22 | 47 |
| 58 | " | 2.5 | 80 | 6.9 | 0.13 | 0.10 | 47 |
| 59R | M-5 | 1.0 | 80 | 6.9 | 0.21 | 0.39 | 25 |
| 60 | " | 1.5 | 80 | 6.9 | 0.10 | 0.17 | 26 |
| 61 | " | 2.5 | 80 | 6.9 | 0.09 | 0.17 | 27 |
| 62R | " | 4.5 | 80 | 6.9 | 0.19 | 0.17 | 39 |
| 63R | " | 2.5 | 80 | 0.29 | 0.22 | 0.41 | 24 |
| 64 | " | 2.5 | 80 | 60 | 0.09 | 0.17 | 30 |
| 65R | " | 2.5 | 80 | 6.9 | 0.19 | 0.27 | 26 |
| 66R | M-6 | 1.0 | 80 | 6.9 | 0.20 | 0.27 | 26 |
| 67 | " | 2.5 | 80 | 6.9 | 0.09 | 0.14 | 26 |
| 68R | M-12 | 2.5 | 80 | 6.9 | 0.18 | 0.21 | 24 |
| 69 | " | 2.5 | 80 | 6.9 | 0.09 | 0.13 | 25 |
| 70R | M-27 | 2.5 | 80 | 0.29 | 0.26 | 0.40 | 25 |
| 71 | " | 2.5 | 80 | 6.9 | 0.09 | 0.14 | 26 |
| 72 | M-33 | 2.5 | 80 | 6.9 | 0.09 | 0.14 | 27 |
| 73R | " | 4.5 | 80 | 6.9 | 0.17 | 0.14 | 40 |
| 74 | M-34 | 2.5 | 80 | 60 | 0.09 | 0.12 | 31 |
| 75 | " | 2.5 | 80 | 6.9 | 0.08 | 0.12 | 25 |
| 76R | m-11 | 1.0 | 90 | 6.9 | 0.17 | 0.24 | 23 |
| 77 | " | 2.0 | 90 | 6.9 | 0.09 | 0.14 | 24 |

*R shows a comparative sample.

From the results shown in Table 3, it can be seen that when the swelling degree is lower than that as defined in this invention, the formation of yellow stain and magenta stain is severe (Sample Nos. 47R, 55R, 49R, 66R, and 76R) and that when the swelling degree is higher than that of this invention, the yellow stain is particularly severe and light fading is undesirable. Furthermore, the formation of scratches is likely observed on the surface of the color photographic paper processed (Sample Nos. 51R, 62R, and 73R). Also, it can be seen that when the amount of the replenisher for the rinse liquid is extremely smaller than an ordinary amount of the replenisher for a conventional water saving process, the formation of yellow stain and magenta stain is observed (Sample Nos. 52R, 63R, and 70R) but the water saving process can be effectively performed to a considerable extent by using the process of this invention. Also, even in this invention, the light fading of magenta occurs to some extent when the amount of the replenisher for the rinse liquid is greatly large. Furthermore, when the water washing time is shorter than that as defined in this invention, the formation of yellow stain and magenta stain is observed (Sample Nos. 54R, 57R, 65R, and 68R).

On the other hand, by processing the color photographic material containing the magenta coupler for use in this invention under the processing condition of this invention, the most preferred photographic performance is obtained (Sample Nos. 60, 61, 67, 71, 72, 75, and 77).

EXAMPLE 4

A sample was prepared by forming Layer 1 (the lowermost layer) to Layer 7 (the uppermost layer) on a paper laminated with polyethylene on both sides thereof, followed by subjecting to a corona discharging treatment.

| | |
|---|---|
| **Layer 1: Blue-Sensitive Emulsion Layer** | |
| Silver Chlorobromide Emulsion (silver bromide: 5 mol %) | 290 g/m$^2$ as Ag |
| Yellow Coupler | 600 mg/m$^2$ |
| Fading Preventing Agent (r) | 280 mg/m$^2$ |
| Solvent (p) | 30 mg/m$^2$ |
| Solvent (q) | 15 mg/m$^2$ |
| Gelatin | 1800 mg/m$^2$ |
| **Layer 2: Color Mixing Preventing Layer** | |
| Silver Bromide Emulsion (primitive, grain size: 0.05 μm) | 10 mg/m$^2$ as Ag |
| Color Mixing Preventing Agent (s) | 55 mg/m$^2$ |
| Solvent (p) | 30 mg/m$^2$ |
| Solvent (q) | 15 mg/m$^2$ |
| Gelatin | 800 mg/m$^2$ |
| **Layer 3: Green-Sensitive Emulsion Layer** | |
| Silver Chlorobromide Emulsion (silver bromide: 3 mol %) | 305 mg/m$^2$ as Ag |
| Magenta Coupler | 670 mg/m$^2$ |
| Fading Preventing Agent (t) | 150 mg/m$^2$ |
| Fading Preventing Agent (u) | 10 mg/m$^2$ |
| Solvent (p) | 200 mg/m$^2$ |
| Solvent (q) | 10 mg/m$^2$ |
| Gelatin | 1400 mg/m$^2$ |
| **Layer 4: Color Mixing Preventing Layer** | |
| Fading Preventing Agent (s) | 65 mg/m$^2$ |
| Ultraviolet Light Absorbent (n) | 450 mg/m$^2$ |
| Ultraviolet Light Absorbent (o) | 230 mg/m$^2$ |
| Solvent (p) | 50 mg/m$^2$ |
| Solvent (q) | 50 mg/m$^2$ |
| Gelatin | 1700 mg/m$^2$ |
| **Layer 5: Red-Sensitive Emulsion Layer** | |
| Silver Chlorobromide Emulsion (silver bromide: 1 mol %) | 210 mg/m$^2$ as Ag |
| Cyan Coupler (C-2) | 260 mg/m$^2$ |
| Cyan Coupler (C-1) | 120 mg/m$^2$ |

-continued

| | |
|---|---|
| Fading Preventing Agent (r) | 250 mg/m$^2$ |
| Solvent (p) | 160 mg/m$^2$ |
| Solvent (q) | 100 mg/m$^2$ |
| Gelatin | 1800 mg/m$^2$ |
| Layer 6: Ultraviolet Light Absorptive Layer | |
| Ultraviolet Light Absorbent (n) | 260 mg/m$^2$ |
| Ultraviolet Light Absorbent (o) | 70 mg/m$^2$ |
| Solvent (p) | 300 mg/m$^2$ |
| Solvent (q) | 100 mg/m$^2$ |
| Gelatin | 700 mg/m$^2$ |
| Layer 7: Protective Layer | |
| Gelatin | 700 g/m$^2$ |

A coating composition for the aforesaid Layer 1 was prepared by the following manner. That is, a mixture of 200 g of the yellow coupler shown below, 93.3 g of Fading Preventing Agent (r), 10 g of the high-boiling solvent (p), and 5 g of the solvent (q) added with 600 ml of ethyl acetate as an auxiliary solvent was heated to 60° C. for dissolution, mixed with 3,300 ml of an aqueous 5% gelatin solution containing 330 ml of an aqueous solution of 5% Alkanol ® B (trade name, alkylnaphthalene sulfonate, made by E. I. Du Pont), and the resultant mixture was emulsified using a colloid mill to provide a coupler dispersion. After distilling off the ethyl acetate under reduced pressure, the residue was added to 1,400 g of a silver halide emulsion (96.7 g as Ag, containing 170 g of gelatin) added with a sensitizing dye for the blue-sensitive emulsion layer and 1-methyl-2-mercapto-5-acetylamino-1,3,4-triazole, and 2,600 g of an aqueous 10% gelatin solution was added thereto to provide the coating composition.

The coating composition for Layer 2 to Layer 7 were also prepared according to the aforesaid method for Layer 1.

The compounds used for preparing the color photographic papers were as follows.

(n): 2-(2-Hydroxy-3,5-di-tert-amylphenyl)benzotriazole (o): 2-(2-Hydroxy-3,5-di-tert-butylphenyl)benzotriazole (p): Di(2-ethylhexyl)phthalate (q): Dibutyl Phthalate (r): 2,5-Di-tert-amylphenyl-3,5-di-tert-butylhydroxybenzoate (s): 2,5-Di-tert-octylhydroquinone (t): 1,4-Di-tert-amyl-2,5-dioctylbenzene (u): 2,2'-Methylenebis(4-methyl-6-tert-butylphenol).

Also, for the silver halide emulsion layers, the following sensitizing dyes were used.

Blue-Sensitive Emulsion Layer:

Anhydro-5-methoxy-5'-methyl-3,3'-disulfopropylselenacyanine hydroxide

Green-Sensitive Emulsion Layer:

Anhydro-9-ethyl-5,5'-diphenyl-3,3'-disulfoethyloxacarbocyanine hydroxide

Red-Sensitive Emulsion Layer:

3,3'-Diethyl-5-methoxy-9,9'-(2,2-dimethyl-1,3-propano)thiadicarbocyanine iodide

Also, 1-methyl-2-mercapto-5-acetylamino-1,3,4-triazole was used for each emulsion layer as a stabilizer.

Also, the following irradiation preventing dyes were used.

4-(3-Carboxy-5-hydroxy-4-(3-(3-carboxy-5-oxo-1-(4-sulfonatophenyl)-2-pyrazolin-4-yliden)-1-propenyl)-1-pyrazolyl)benzenesulfonate dipotassium salt N,N'-(4,8-Dihydroxy-9,10-dioxo-3,7-disulfanotoanthracene-1,5-diyl)bis(aminomethanesulfonate) tetrasodium salt Furthermore, 1,2-bis(vinylsulfonyl)ethane was used as a hardening agent for each layer.

The couplers used for making the above-described color photographic materials were as follows.

Yellow Coupler:

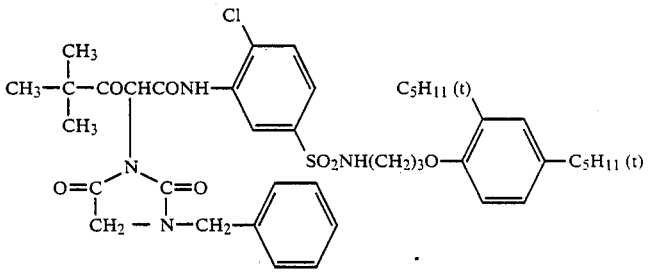

Magenta Coupler:

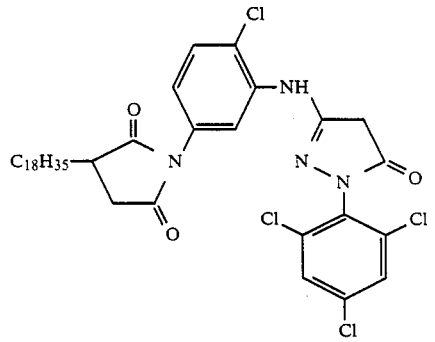

Cyan coupler:

C-1

-continued

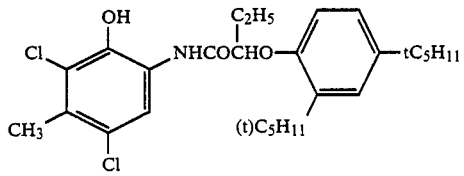

C-2

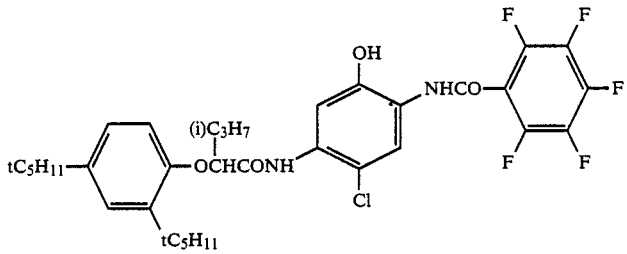

After imagewise exposing each of the multilayer color photographic papers thus obtained, the sample was continuously processed by means of improved Fuji Color Roll Processor FPRP 115 (made by Fuji Photo Film Co., Ltd.) in the following steps until the replenisher was supplied to three times the volume of the color development tank.

| Processing Step | Temperature | Time |
|---|---|---|
| Color Development | 35° C. | 45 sec. |
| Bleach Fix | 35° C. | 45 sec. |
| Rinse (1) | 35° C. | 20 sec. |
| Rinse (2) | 35° C. | 20 sec. |
| Rinse (3) | 35° C. | 20 sec. |
| Rinse (4) | 35° C. | 20 sec. |
| Drying | 80° C. | 60 sec. |

In addition, the rinse step was a countercurrent system of Rinse (4)→Rinse (1).

The color developer used for the above-described color development was as follows.

| Color Developer | Tank Liquid | Replenisher |
|---|---|---|
| Water | 800 ml | 800 ml |
| Diethylenetriaminepentaacetic Acid | 3.0 g | 3.0 g |
| 1-Hydroxyethylidene-1,1-diphosphonic Acid (60%) | 1.5 ml | 1.5 ml |
| Lithium Sulfate | 1.0 g | 1.0 g |
| Potassium Sulfate | 0.05 g | — |
| Sodium Sulfite | 1.7 g | 1.7 g |
| Sodium Chloride | 1.5 g | 0.7 g |
| Adenine | 30 mg | 30 mg |
| 1,2,3-Benzotriazole | 2 mg | 5 mg |
| Potassium Carbonate | 40 g | 40 g |
| N-Ethyl-N-(β-methanesulfonamidoethyl)-3-methyl-4-aminoaniline Sulfite | 5.5 g | 9.0 g |
| Fluorescent Whitening Agent, Whitex ® 4 (trade name, Sumitomo Chemical Company, Limited) | 1.0 g | 2.5 g |
| Water to make | 1000 ml | 1000 ml |
| pH adjusted by KOH | 10.50 | 11.0 |

The composition of the bleach fix used for the above-described bleach fix step was the same as that used in Example 3. Also, the composition of the rinse liquid was the same between the replenisher and the tank liquid and was as follows.

| Rinse Liquid | |
|---|---|
| 5-Chloro-2-methyl-4-isothiazolin-3-one | 40 mg |
| 2-Methyl-4-isothiazolin-3-one | 10 mg |
| 2-Octyl-4-isothiazolin-3-one | 10 mg |
| Bismuth Chloride (40% aqueous solution) | 0.50 g |
| Nitrilo-N,N,N-trimethylenephosphonic Acid (40%) | 1.0 ml |
| 1-Hydroxyethylidene-1,1-diphosphonic Acid (60%) | 2.5 ml |
| Fluorescent Whitening Agent (4,4'-diaminostilbene series) | 1.0 g |
| Aqueous ammonia (26%) | 2 ml |
| Water to make | 1000 ml |
| pH adjusted by KOH | 7.0 |

The amounts of the replenisher for the color developer, bleach fix, and rinse liquid were 160 ml, 60 ml, and 120 ml, respectively, per square meter of the color photographic paper.

Also, color photographic papers were prepared by the same procedure as above except that the magenta coupler was changed, and the swelling degree of each sample was changed or controlled by allowing to stand under each condition as in Example 3 described above. Each of the samples was wedge-exposed and processed as above while changing the rinsing time using the above-described rinse liquid.

About each sample thus processed, the stain density after allowing to stand and the light fading with the passage of time (irradiated by a fluorescent lamp of 3,000 lux at a distance of 30 cm for 4 months) were measured as in Example 3. The results obtained are shown in Table 4 below.

TABLE 4

| Sample No.* | Light-Sensitive Material: Coupler | Light-Sensitive Material: Swelling Degree | Total Rinse Time (sec) | Yellow Stain | Magenta Stain | Magenta Light-Fading |
|---|---|---|---|---|---|---|
| 78R | (c) | 1.0 | 80 | 0.40 | 0.20 | 0.29 |
| 79R | " | 1.2 | " | 0.30 | 0.18 | 0.30 |
| 80 | " | 1.7 | " | 0.19 | 0.14 | 0.30 |
| 81 | " | 2.5 | " | 0.17 | 0.13 | 0.31 |
| 82 | " | 3.0 | " | 0.17 | 0.13 | 0.32 |
| 83 | " | 3.5 | " | 0.18 | 0.13 | 0.33 |
| 84R | " | 4.5 | " | 0.25 | 0.14 | 0.36 |
| 85R | " | 5.0 | " | 0.27 | 0.18 | 0.40 |
| 86R | M-6 | 1.2 | " | 0.21 | 0.25 | 0.20 |
| 87 | " | 2.5 | " | 0.10 | 0.15 | 0.21 |
| 88R | " | 4.5 | " | 0.19 | 0.15 | 0.29 |

TABLE 4-continued

| Sample No.* | Light-Sensitive Material Coupler | Light-Sensitive Material Swelling Degree | Total Rinse Time (sec) | Yellow Stain | Magenta Stain | Magenta Light-Fading |
|---|---|---|---|---|---|---|
| 89R | " | 2.5 | 20 | 0.17 | 0.27 | 0.21 |
| 90 | " | 2.5 | 30 | 0.11 | 0.16 | 0.21 |
| 91 | " | 2.5 | 60 | 0.10 | 0.15 | 0.22 |
| 92R | M-27 | 1.0 | 70 | 0.22 | 0.27 | 0.20 |
| 93 | " | 2.5 | " | 0.09 | 0.14 | 0.20 |
| 94R | " | 5.0 | " | 0.16 | 0.14 | 0.29 |
| 95R | " | 2.5 | 20 | 0.18 | 0.26 | 0.20 |
| 96 | " | 2.5 | 30 | 0.10 | 0.15 | 0.20 |
| 97 | " | 2.5 | 40 | 0.09 | 0.14 | 0.21 |
| 98R | m-12 | 1.2 | 60 | 0.20 | 0.26 | 0.18 |
| 99 | " | 1.7 | 60 | 0.09 | 0.15 | 0.19 |
| 100 | " | 5.0 | 60 | 0.18 | 0.16 | 0.26 |

*R shows a comparative sample.

From the results shown in Table 4, it can be seen that when the swelling degree of the color photographic paper is lower than that in this invention, the formation of the yellow stain and magenta stain is severe (Sample Nos. 78R, 79R, 86R, 92R, and 98R), whereas when the swelling degree is higher than that in this invention, the light fading of magenta occurs (Sample Nos. 84R, 85R, 88R, 94R, and 100R). Also, when the washing time is short, the formation of yellow stain and magenta stain is severe. on the other hand, according to the construction of this invention, good photographic performance is obtained and, also, when the magenta coupler which is preferably used in this invention is used for the color photographic papers, more excellent performance is obtained (Sample Nos. 90, 91, 93, 96, 97, and 99).

EXAMPLE 5

A multilayer color photographic paper was prepared by forming Layer 1 to Layer 7 having the following layer structure on a paper support laminated with polyethylene on both sides thereof. The polyethylene laminate in the side of Layer 1 contained a white pigment ($TiO_2$) and a bluish dye (ultramarine).

| | |
|---|---|
| **Layer 1: Blue-Sensitive Emulsion Layer** | |
| Silver Chlorobromide Emulsion (silver bromide: 1.0 mol %) | 0.30 g/m$^2$ as Ag |
| Gelatin | 1.86 g/m$^2$ |
| Yellow Coupler (a) | 0.82 g/m$^2$ |
| Color Image Stabilizer (b) | 0.19 g/m$^2$ |
| Solvent (c) | 0.34 cc/m$^2$ |
| **Layer 2: Color Mixing Preventing Layer** | |
| Gelatin | 0.99 g/m$^2$ |
| Color Mixing Preventing Agent (d) | 0.08 g/m$^2$ |
| **Layer 3: Green-Sensitive Emulsion Layer** | |
| Silver Chlorobromide Emulsion (silver bromide: 0.5 mol %) | 0.16 g/m$^2$ as Ag |
| Gelatin | 1.80 g/m$^2$ |
| Magenta Coupler (m) | 0.34 g/m$^2$ |
| Color Image Stabilizer (f) | 0.20 g/m$^2$ |
| Solvent (g) | 0.68 g/m$^2$ |
| **Layer 4: Ultraviolet Light Absorbing Layer** | |
| Gelatin | 1.60 g/m$^2$ |
| Ultraviolet Absorbent (h) | 0.62 g/m$^2$ |
| Color Mixing Preventing Agent (i) | 0.05 g/m$^2$ |
| Solvent (j) | 0.26 cc/m$^2$ |
| **Layer 5: Red-Sensitive Emulsion Layer** | |
| Silver Chlorobromide Emulsion (silver bromide: 1.0 mol %) | 0.26 g/m$^2$ as Ag |
| Gelatin | 0.98 g/m$^2$ |
| Cyan Coupler (k) | 0.38 g/m$^2$ |
| Color Image Stabilizer (l) | 0.17 g/m$^2$ |
| Solvent (e) | 0.23 cc/m$^2$ |
| **Layer 6: Ultraviolet Light Absorptive Layer** | |
| Gelatin | 0.54 g/m$^2$ |
| Ultraviolet Light Absorbent (n) | 0.21 g/m$^2$ |
| Solvent (j) | 0.09 cc/m$^2$ |
| **Layer 7: Protective Layer** | |
| Gelatin | 1.33 g/m$^2$ |
| Acrylic-modified copolymer (modified degree of 17%) of polyvinyl alcohol | 0.17 g/m$^2$ |

The coating compositions for the above layers were prepared as follows.

Preparation of the coating composition for Layer 1:

In 27.2 ml of ethyl acetate and 7.9 ml of Solvent (c) were dissolved 19.1 g of Yellow Coupler (a) and 4.4 g of Color Image Stabilizer (b) and the solution was dispersed by emulsification in 185 ml of an aqueous 10% aqueous solution containing 8 ml of an aqueous 10% sodium dodecylbenzenesulfonate.

Separately, 90 g of a blue-sensitive emulsion was prepared by adding a blue-sensitive sensitizing dye shown below to a silver chlorobromide emulsion (silver bromide: 1.0 mol%, containing 70 g/kg of Ag). The aforesaid emulsified dispersion was mixed with the aforesaid silver halide emulsion and the concentration of gelatin was controlled as shown above for Layer 1 to provide the coating composition for Layer 1.

The coating compositions for Layer 2 to Layer 7 were prepared by the similar manner. In addition, each layer contained 1-oxy-3,5-dichloro-s-triazine sodium salt as a gelatin hardening agent.

The spectral sensitizers for the emulsion layers were as follows.

Blue-Sensitive Emulsion Layer:

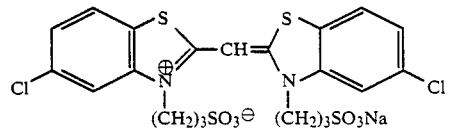

(added 5.0 × $10^{-4}$ mol per mol of silver halide)

Green-Sensitive Emulsion Layer:

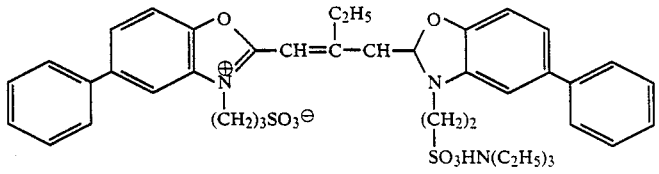

-continued (added $4.0 \times 10^{-4}$ mol per mol of silver halide)

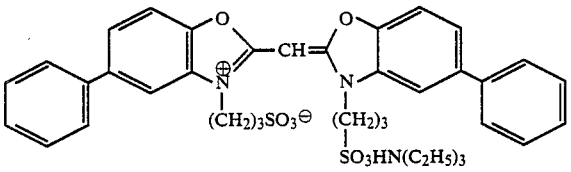

(added $7.0 \times 10^{-5}$ mol per mol of silver halide)

Red-Sensitive Emulsion Layer

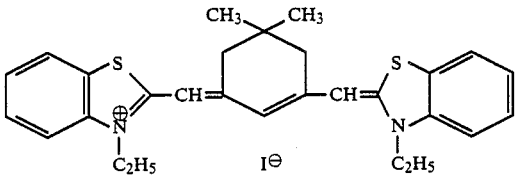

(added $0.9 \times 10^{-4}$ mol per mol of silver halide)

Also, for the emulsion layers described above, the following dyes are used as an irradiation preventing dye.

Green-Sensitive Emulsion Layer:

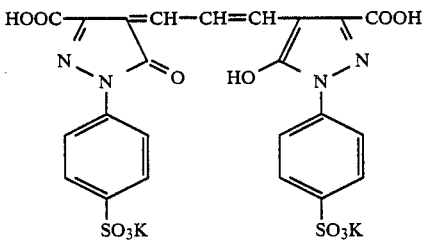

Red-Sensitive Emulsion Layer:

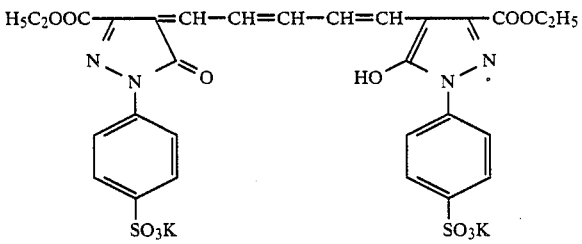

The couplers and other compounds used in this example were as follows.

Yellow Coupler (a)

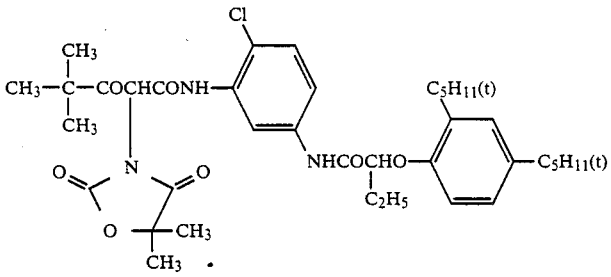

Color Image Stabilizer (b)

-continued
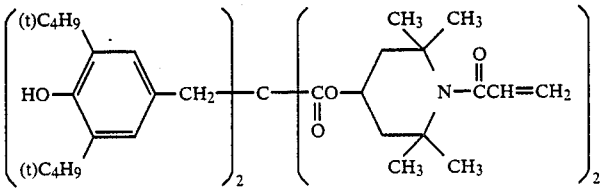
Solvent (c)
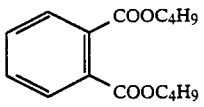
Color Mixing Prevent Agent (d)
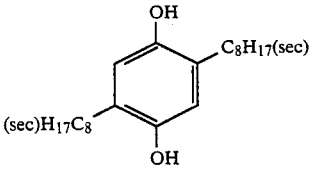
Solvent (e)
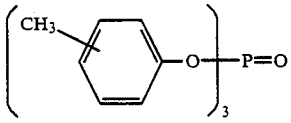
Color Image Stabilizer (f)
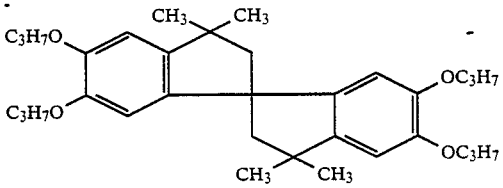
Solvent (g)
2:1 mixture (by weight) of $(C_8H_{17}O)_3-P=O$ and
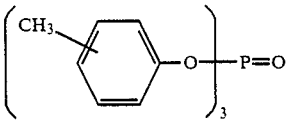
Ultraviolet Light Absorbent (h)
1:5:3 mixture (by mol) of
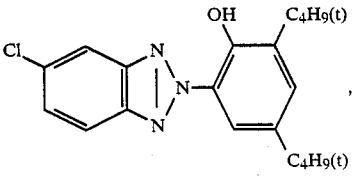
,
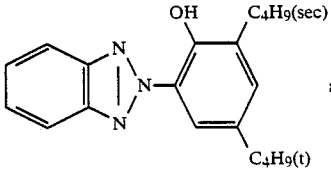
and
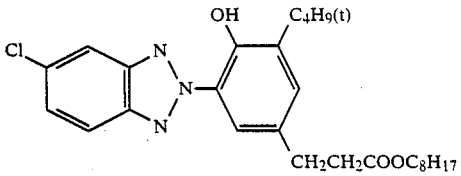
Color Mixing Preventing Agent (i)

-continued

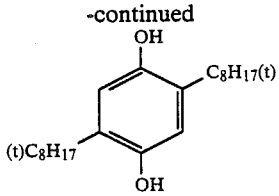

Solvent (g)

$(iso C_9H_{19}O)_3P{=}O$

Cyan Coupler (k)

1:1 mixture (by mol) of

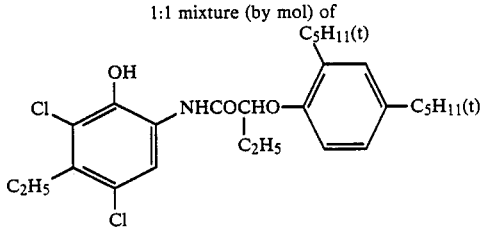

and

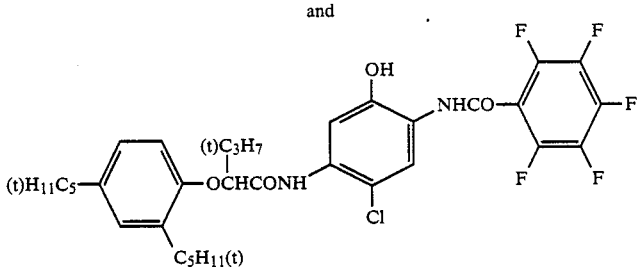

Color Image Stabilizer (1)

1:3:3 mixture (by mol) of

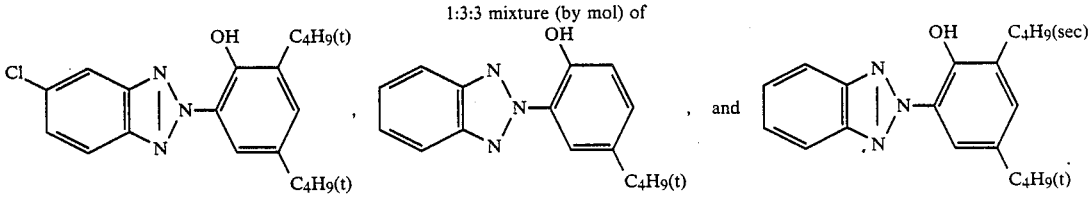

Magenta Coupler (m)

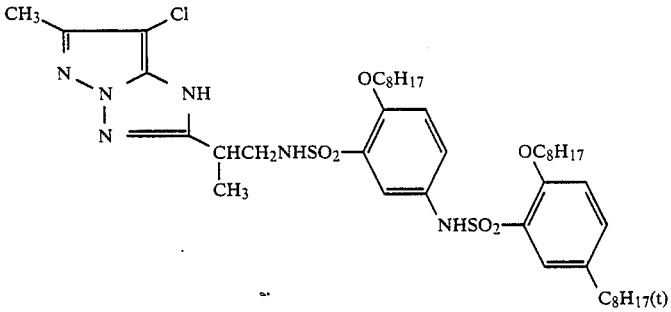

In this case, however, by changing the addition amount of the hardening agent, multilayer color photographic papers having a swelling degree of 1.0, 2.0, 4.0 and 5.0, respectively as shown in Table 5 below were prepared.

The color photographic papers thus obtained were continuously processed by the photographic processing steps as in Example 4. In this case, however, the rinsing time was changed as shown in Table 5. The processing was performed until the amount of the replenisher became three times the volume of the color development tank.

The compositions of the processing liquids used were as follows.

| | Tank liquid | Replenisher |
|---|---|---|
| Color Developer | | |
| Triethanolamine | 8 g | 10 g |
| N,N-Diethylhydroxylamine | 4.2 g | 6.0 g |
| Fluorescent Whitening Agent (4,4-diaminostilbene series) | 3.0 g | 4.0 g |
| Ethylenediaminetetraacetic Acid | 1.0 g | 1.5 g |
| Potassium Carbonate | 30 g | 30 g |
| Sodium Chloride | 1.40 g | 0.10 g |
| 4-Amino-3-methyl-N-ethyl-N-[β- | 5.0 g | 7.0 g |

-continued

| | Tank liquid | Replenisher |
|---|---|---|
| (methanesulfonamido)ethyl]-p-phenylenediamine Sulfate | | |
| Water to make | 1000 ml | 1000 ml |
| pH | 10.10 | 10.50 |
| Bleach Fix (The composition of the tank liquid and the replenisher was the same). | | |
| EDTA Fe(III) $NH_4.2H_2O$ | 60 g | |
| $EDTA.2Na.2H_2O$ | 4 g | |
| Ammonium Thiosulfate (70%) | 120 ml | |
| Sodium Sulfite | 16 g | |
| Glacial Acetic Acid | 7 g | |
| Water to make | 1000 ml | |
| pH | 5.5 | |
| Rinse Liquid (The composition of the tank liquid and the replenisher was the same.) | | |
| $EDTA.2Na.2H_2O$ | 0.4 g | |
| Water to make | 1000 ml | |
| pH | 7.0 | |

The amount of the replenisher for each processing liquid per square meter of the color photographic paper was as follows.

| | |
|---|---|
| Color Developer | 160 ml |
| Bleach Fix | 100 ml |
| Rinse Liquid | 200 ml |

As in Example 4 described above, the stain density and light fading of magenta of each sample after allowing to stand since the processing in each running test were measured. The results obtained are shown in Table 5 below.

TABLE 5

| Sample No.* | Swelling Degree | Total Rinse Time (sec) | Yellow Stain | Magenta Stain | Magenta Light-Fading |
|---|---|---|---|---|---|
| 101R | 1.2 | 90 | 0.20 | 0.24 | 0.21 |
| 102 | 2.0 | 90 | 0.12 | 0.13 | 0.20 |
| 103 | 4.0 | 90 | 0.12 | 0.14 | 0.20 |
| 104R | 5.0 | 90 | 0.18 | 0.18 | 0.26 |
| 105R | 1.2 | 60 | 0.22 | 0.26 | 0.21 |
| 106 | 2.0 | 60 | 0.13 | 0.13 | 0.21 |
| 107 | 4.0 | 60 | 0.13 | 0.14 | 0.21 |
| 108R | 5.0 | 60 | 0.21 | 0.25 | 0.30 |
| 109R | 1.2 | 20 | 0.26 | 0.32 | 0.21 |
| 110R | 2.0 | 20 | 0.19 | 0.18 | 0.21 |
| 111R | 4.0 | 20 | 0.20 | 0.19 | 0.22 |
| 112R | 5.0 | 20 | 0.23 | 0.20 | 0.31 |

*R shows a comparative sample.

As shown in Table 5, it can be seen that by the process of this invention, the increase of the yellow stain and magenta stain with the passage of time after processing is less and the occurrence of light fading of magenta is less, whereas when the total rinsing time is less than 30 seconds, the formation of these stains is increased and when the swelling degree of the color paper is over 4, the light fading of magenta increases greatly.

Now, as described above, according to the process of this invention, excellent color images forming less stains directly after processing and after lapsing a long time since the processing can be obtained even in the case of development using a shortened water washing time of from 30 to 90 seconds. Also, if the water washing step is a water saving step, excellent color images can be obtained. Furthermore, by processing a color photographic material containing the magenta coupler specified in this invention, excellent color images showing particularly less stain formation with the passage of time after the processing can be obtained.

While the invention has been described in detail and with reference to specific embodiments thereof, it will be apparent to one skilled in the art that various changes and modifications can be made therein without departing from the spirit and scope thereof.

What is claimed is:

1. An image forming process which comprises, in the photographic processing of a silver halide color photographic material containing cyan, magenta and yellow dye forming couplers, processing the color photographic material in a continuous manner with a color developer containing a p-phenylenediamine-based color developing agent for a color developer processing time of 30 seconds to 2 minutes, said color photographic material having a swelling degree of the photographic layer(s) of from 2.0 to 3.5 in the water washing step for a total water washing processing time of from 30 to 90 seconds.

2. An image forming process as claimed in claim 1, wherein the amount of the washing water replenisher for the water washing step is from 0.5 to 50 times the carried-over amount from the pre-bath per unit area of the color photographic material.

3. An image forming process as claimed in claim 1, wherein the silver halide color photographic material contains therein at least one magenta coupler represented by the following formula (I) or (II):

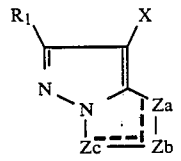

(I)

wherein $R_1$ represents a hydrogen atom or a substituent; X represents a hydrogen atom or a group capable of splitting off by coupling reaction with the oxidation product of an aromatic primary amine developing agent; and Za, Zb, and Zc each represents a methine, a substituted methine, =N—, or —NH—; and one of the Za—Zb bond and the Zb—Zc bond is a double bond and the other is a single bond, provided that when the Zb—Zc bond is a carbon-carbon double bond, it may form a part of an aromatic ring, and the magenta coupler may form a dimer or more oligomer or polymer at said $R_1$ or X and that when Za, Zb, or Zc is a substituted methine, the magenta coupler may form a dimer or more oligomer or polymer by the substituted methine;

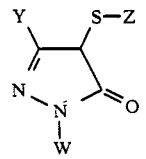

(II)

wherein W represents a substituted aryl group; Z represents a substituted or unsubstituted alkyl group, a substituted or unsubstituted aryl group, or a substituted or unsubstituted heterocyclic group; and Y represents a substituted or unsubstituted acylamino group, a substituted or unsubstituted ureido group, or a substituted or unsubstituted anilino group.

4. An image forming process as claimed in claim 1, wherein the total water washing time is from 40 to 70 seconds.

5. An image forming process as claimed in claim 1, wherein the water washing step is a multistage countercurrent water washing step.

6. An image forming process as claimed in claim 2, wherein the amount of the washing water replenisher for the water washing step is from 3 to 30 times the carried-over amount from the pre-bath per unit area of the color photographic material.

7. An image forming process as claimed in claim 3, wherein said magenta coupler represented by formula (I) is a magenta coupler represented by following formula (V) or (VI):

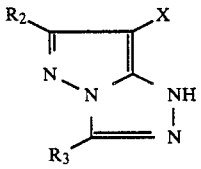

(V)

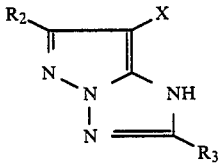

(VI)

wherein $R_2$ and $R_3$ each represents a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; and X represents a hydrogen atom or a group capable of splitting off by coupling reaction with the oxidation product of an aromatic primary amine developing agent, provided that $R_2$, $R_3$, or X may be a divalent group to thereby form a bis-compound and that when the moiety shown by formula (V) or (VI) is in a vinyl monomer, $R_2$ or $R_3$ may be a simple bond or a connecting group through which the moiety shown by formula (V) or (VI) is bonded to a vinyl group.

8. An image forming process as claimed in claim 3, wherein said magenta coupler represented by formula (II) is a magenta coupler represented by following formula (IX):

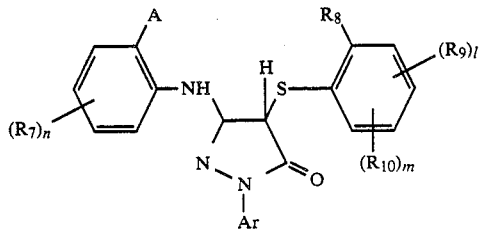

(IX)

wherein Ar represents a phenyl group substituted by at least one halogen atom, alkyl group, alkoxy group, alkoxycarbonyl group or cyano group; A represents a halogen atom or an alkoxy group; $R_7$ represents a hydrogen atom, a halogen atom, an alkyl group, an alkoxy group, an acylamino group, a sulfonamido group, a sulfamoyl group, a carbamoyl group, a diacylamino group, an alkoxycarbonyl group, an alkoxysulfonyl group, an aryloxysulfonyl group, an alkanesulfonyl group, an arylsulfonyl group, an alkylthio group, an arylthio group, an alkoxycarbonylamino group, a ureido group, an acyl group, a nitro group, or a carboxy group; $R_8$ represents a halogen atom, a hydroxyl group, an amino group, an alkyl group, an alkoxy group, an aryloxy group, or an aryl group; $R_9$ represents a hydrogen atom, an amino group, an acylamino group, a ureido group, an alkoxycarbonylamino group, an imido group, a sulfonamido group, a sulfamoylamino group, a nitro group, an alkoxycarbonyl group, a carbamoyl group, an acyl group, a cyano group, or an alkylthio group; $R_{10}$ represents a hydrogen atom, a halogen atom, a hydroxyl group, an alkyl group, an alkoxy group, or an aryl group; at least one of said $R_8$ and $R_{10}$ represents an alkoxy group; m represents an integer of from 1 to 3; n represents an integer of from 1 to 4; and l represents an integer of from 1 to 3.

9. An image forming process as claimed in claim 1, wherein the silver halide is silver chloride or silver chlorobromide.

10. An image forming process as claimed in claim 9, wherein said silver chlorobromide contains at least 10 mol% silver bromide.

11. An image forming process as claimed in claim 1, wherein the silver halide has a monodispersed grain size distribution.

12. An image forming process as claimed in claim 1, wherein the color developer contains a p-phenylenediamine derivative and a hydroxylamine.

13. An image forming process as claimed in claim 12, wherein said hydroxylamine is a hydroxylamine substituted by two alkyl groups.

* * * * *